US009701464B2

(12) United States Patent
Kochanowski

(10) Patent No.: US 9,701,464 B2
(45) Date of Patent: Jul. 11, 2017

(54) REVERSIBLY FOLDABLE FREIGHT CONTAINER

(71) Applicant: George E. Kochanowski, Springboro, OH (US)

(72) Inventor: George E. Kochanowski, Springboro, OH (US)

( * ) Notice: Subject to any disclaimer, the term of this patent is extended or adjusted under 35 U.S.C. 154(b) by 60 days.

(21) Appl. No.: 14/935,913

(22) Filed: Nov. 9, 2015

(65) Prior Publication Data

US 2016/0122124 A1 May 5, 2016

Related U.S. Application Data

(63) Continuation of application No. 14/238,893, filed as application No. PCT/US2012/050699 on Aug. 14, 2012, now Pat. No. 9,180,024.
(Continued)

(51) Int. Cl.
*B65D 88/52* (2006.01)
*B65D 90/00* (2006.01)
(Continued)

(52) U.S. Cl.
CPC ..... *B65D 88/524* (2013.01); *B65D 88/121* (2013.01); *B65D 88/52* (2013.01);
(Continued)

(58) Field of Classification Search
CPC ..... B65D 88/121; B65D 88/52; B65D 88/524
See application file for complete search history.

(56) References Cited

U.S. PATENT DOCUMENTS 1,377,382 A 5/1921 Wyman
1,609,259 A 11/1926 Macnider et al.
(Continued)

FOREIGN PATENT DOCUMENTS

DE 10141791 3/2003
DE 202009004012 9/2010
(Continued)

OTHER PUBLICATIONS

Priyo, "Maximizing Space," Innovation, Issue 10, Sep. 2008, 7 pp.
(Continued)

*Primary Examiner* — Anthony Stashick
*Assistant Examiner* — Mollie Impink
(74) *Attorney, Agent, or Firm* — Brooks, Cameron & Huebsch, PLLC

(57) ABSTRACT

The present disclosure provides a reversibly foldable freight container having a roof structure, a floor structure and sidewall structures. The reversibly foldable freight container further includes a front wall and a rear wall, where the front wall includes front wall corner posts, a front door hinge on at least one of the front wall corner posts and a front door joined to the front door hinge. The rear wall includes rear wall corner posts, a hinge on the rear wall corner posts and a rear wall door joined to the hinge, where the rear wall door can pivot on the hinge to extend adjacent an exterior surface of the sidewall structure or can pivot into the volume of the reversibly foldable freight container. In an unfolded state the reversibly foldable freight container has a predefined width measured at a predetermined point on each of two of the rear wall corner posts. A plurality of jointed members in the floor structure allows the reversibly foldable freight container in an unfolded state to move toward a folded state so that the predetermined points on the rear wall corner posts do not extend beyond the predefined width of the reversibly foldable freight container in the unfolded state.

20 Claims, 38 Drawing Sheets

Related U.S. Application Data

(60) Provisional application No. 61/575,198, filed on Aug. 15, 2011.

(51) Int. Cl.
*B65D 88/12* (2006.01)
*E05D 11/10* (2006.01)
*E05D 3/06* (2006.01)

(52) U.S. Cl.
CPC ..... *B65D 90/008* (2013.01); *E05D 3/06* (2013.01); *E05D 11/1007* (2013.01); *E05Y 2900/516* (2013.01)

(56) References Cited

U.S. PATENT DOCUMENTS

| | | | |
|---|---|---|---|
| 1,686,222 | A | 10/1928 | Adler |
| 2,142,305 | A | 1/1939 | Davis |
| 2,232,346 | A | 2/1941 | Sikes |
| 2,361,743 | A | 10/1944 | Butler |
| 2,741,391 | A | 4/1956 | Belanger |
| 2,761,581 | A | 9/1956 | Cohee |
| 2,868,407 | A | 1/1959 | Woodcock |
| 3,004,682 | A | 10/1961 | Bertolini et al. |
| 3,078,957 | A | 2/1963 | Larson |
| 3,128,897 | A | 4/1964 | Wilkins |
| 3,398,850 | A | 8/1968 | Kennard |
| 3,403,806 | A | 10/1968 | Pohl |
| 3,410,328 | A | 11/1968 | Sasai |
| 3,480,174 | A | 11/1969 | Sherwood |
| 3,570,698 | A | 3/1971 | Dougherty |
| 3,612,330 | A | 10/1971 | Baer |
| 3,612,338 | A | 10/1971 | Ekman |
| 3,684,122 | A | 8/1972 | Bonomi |
| 3,752,349 | A | 8/1973 | Rana |
| 3,765,556 | A | 10/1973 | Baer |
| 3,907,147 | A | 9/1975 | Goobeck |
| 3,937,363 | A | 2/1976 | Anderson |
| 4,112,635 | A | 9/1978 | Rylander |
| 4,122,638 | A | 10/1978 | O'Brian et al. |
| 4,191,419 | A | 3/1980 | Kirkpatrick |
| 4,214,669 | A | 7/1980 | McQuiston |
| 4,577,772 | A | 3/1986 | Bigliardi |
| 4,793,507 | A | 12/1988 | Delplanque |
| 5,107,639 | A | 4/1992 | Morin et al. |
| 5,190,179 | A | 3/1993 | Richter et al. |
| 5,257,830 | A | 11/1993 | Pflueger |
| 5,501,353 | A | 3/1996 | Warren |
| 5,878,903 | A | 3/1999 | Ung |
| 5,890,612 | A | 4/1999 | Coppi |
| 6,032,815 | A | 3/2000 | Elstone |
| 6,108,982 | A | 8/2000 | Davison |
| 6,109,469 | A | 8/2000 | Clive-Smith |
| 6,112,929 | A | 9/2000 | Ota |
| 6,164,476 | A | 12/2000 | Rene et al. |
| 6,182,849 | B1 | 2/2001 | Elstone, Sr. |
| 6,299,009 | B1 | 10/2001 | Ryziuk et al. |
| 6,357,194 | B1 | 3/2002 | Jones, Jr. |
| 7,296,704 | B2 | 11/2007 | Ferrini |
| 7,703,632 | B2 | 4/2010 | Kochanowski |
| 2006/0016807 | A1 | 1/2006 | Hsu et al. |
| 2008/0029508 | A1 | 2/2008 | Kochanowski |
| 2010/0089917 | A1 | 4/2010 | Gilbert et al. |
| 2010/0292063 | A1 | 11/2010 | Chawla et al. |

FOREIGN PATENT DOCUMENTS

| | | |
|---|---|---|
| EP | 0832825 | 4/1998 |
| EP | 1702864 | 9/2006 |
| GB | 2450676 | 1/2009 |
| JP | 2002160793 | 6/2002 |
| JP | 2002264993 | 9/2002 |
| WO | 2006024104 | 3/2006 |

OTHER PUBLICATIONS

International Search Report and Written Opinion of international application No. PCT/US2012/050699, mailed Jan. 21, 2013 (17 pgs).

REVERSIBLY FOLDABLE FREIGHT CONTAINER

This application is a Continuation Application of U.S. National Stage application Ser. No. 14/238,893, filed Feb. 14, 2014, published as U.S. Publication No. 2014-0299596 on Oct. 9, 2014 and Issued as U.S. Pat. No. 9,181,024 on Nov. 10, 2015, which is a U.S. 371 National Stage Application of International Application Number PCT/US2012/050699, filed Aug. 14, 2012 and published as WO 2013/025676 on Feb. 21, 2013, which claims the benefit of U.S. Provisional Patent Application No. 61/575,198, filed Aug. 15, 2011, the entire contents of which is incorporated herein by reference in its entirety.

FIELD OF DISCLOSURE

Embodiments of the present disclosure are directed to a freight container; more specifically, a reversibly foldable freight container.

BACKGROUND

Freight containers are used for transferring goods from one location to another location. Freight containers may be transferred via a number of different modes such as, overseas transfer, rail transfer, air transfer, and tractor trailer transfer.

To help improve efficiencies freight containers that are used to transfer goods have been standardized. One such standardization is overseen by the International Organization for Standardization, which may be referred to as "ISO." The ISO publishes and maintains standards for freight containers. These ISO standards for freight containers help provide that each freight container has similar physical properties. Examples of these physical properties include, but are not limited to, width, height, depth, base, maximum load, and shape of the cargo containers.

SUMMARY

The present disclosure provides a reversibly foldable freight container. The reversibly foldable freight container includes a roof structure; a floor structure opposite the roof structure; sidewall structures between the floor structure and the roof structure, each of the sidewall structures having an exterior surface and an interior surface opposite the exterior surface; a front wall joined with the roof structure, the floor structure and the sidewall structures, the front wall including front wall corner posts, a front door hinge on at least one of the front wall corner posts and a front door joined to the front door hinge; a rear wall joined with the roof structure, the floor structure and the sidewall structures, where the roof structure, the floor structure, the interior surface of the sidewall structures and the rear wall define a volume of the reversibly foldable freight container, the rear wall including rear wall corner posts, a hinge on the rear wall corner posts and a rear wall door joined to the hinge, where the hinge can be locked to the rear wall corner posts in a first predetermined position so that the rear wall door can pivot on the hinge to extend adjacent the exterior surface of the sidewall structure or can be un-locked to the rear wall corner posts in a second predetermined position so that the rear wall door can pivot into the volume of the reversibly foldable freight container and extend adjacent the interior surface of the sidewall structure, and where in an unfolded state the reversibly foldable freight container has a predefined width measured at a predetermined point on each of two of the rear wall corner posts and a plurality of jointed members in the floor structure, where each of the jointed members includes: a first elongate section having a first surface defining a first oblong opening; a second elongate section having a second surface defining a second oblong opening; and a fastener passing through the first oblong opening and the second opening to connect the first elongate section and the second elongate section, where the first oblong opening and the second oblong opening move relative each other and the fastener as the jointed member transitions from a first predetermined state having a minimum overlap of the first oblong opening and the second oblong opening towards a second predetermined state having a maximum overlap of the first oblong opening and the second oblong opening relative the minimum overlap, whereas the reversibly foldable freight container in an unfolded state moves toward a folded state the first oblong opening and the second oblong opening move relative each other and the fastener so that the predetermined points on the rear wall corner posts do not extend beyond the predefined width of the reversibly foldable freight container in the unfolded state.

The reversibly foldable freight container can also include a roof structure; a floor structure opposite the roof structure; sidewall structures between the floor structure and the roof structure, each of the sidewall structures having an exterior surface and an interior surface opposite the exterior surface; a front wall joined with the roof structure, the floor structure and the sidewall structures, the front wall including front wall corner posts, a front door hinge on at least one of the front wall corner posts and a front door joined to the front door hinge; a rear wall joined with the roof structure, the floor structure and the sidewall structures, where the roof structure, the floor structure, the interior surface of the sidewall structures and the rear wall define a volume of the reversibly foldable freight container, the rear wall including rear wall corner posts, a hinge on the rear wall corner posts and a rear wall door joined to the hinge, where the hinge can be locked to the rear wall corner posts in a first predetermined position so that the rear wall door can pivot on the hinge to extend adjacent the exterior surface of the sidewall structure or can be un-locked to the rear wall corner posts in a second predetermined position so that the rear wall door can pivot into the volume of the reversibly foldable freight container and extend adjacent the interior surface of the sidewall structure, and where in an unfolded state the reversibly foldable freight container has a predefined width measured at a predetermined point on each of two of the rear wall corner posts and a plurality of jointed members in the floor structure, where each of the jointed members includes: a first elongate section having a first surface defining a first oblong opening, a first abutment member and a first member end opposite the first abutment member; a second elongate section having a second surface defining a second oblong opening, a second abutment member and a second member end opposite the second abutment member; and a fastener passing through the first oblong opening and the oblong second opening to connect the first elongate section and the second elongate section; where the first oblong opening and the second oblong opening move relative each other and the fastener as the jointed member transitions from a first predetermined state towards a second predetermined state; where in the first predetermined state the first abutment member and the second abutment member are in physical contact and a portion of the first surface and a portion of the second surface are in physical contact with the fastener; and a distance between the first member end of the first elongate section and the second member end of the second elongate section provides a defined maximum length of the jointed member; where the distance between the first member end of the first elongate section and the second member end of the second elongate section does not exceed the defined maximum length as the jointed member transitions from the first predetermined state towards the second predetermined state.

The present disclosure also provides a method. The method includes positioning a front door of a front wall of a reversibly foldable freight container inside a volume defined by the reversibly foldable freight container; shortening locking rods mounted to a rear door of the rear wall to position cams mounted on the locking rods directly adjacent the rear door; and moving the locking rods, cams and the rear door of the rear wall through an end frame of the rear wall to position the rear door of the rear wall inside the volume of defined by the reversibly foldable freight container. The end frame of each of the front wall and the end wall include corner posts, a sill member and a header member, where the corner posts are between the sill member and the header member, and where the method includes moving the still member and the header member of the end frame of each of the rear wall and the front wall to extend in a similar longitudinal direction of the corner posts of each end frame.

The method can also include reversibly folding a roof structure and a floor structure opposite the roof structure into the volume of defined by the reversibly foldable freight container. Reversibly folding the floor structure does not transfer opposing lateral force to sidewall structures of the reversibly foldable freight container as the reversibly foldable freight container is moved from an unfolded state towards a folded state. Reversibly folding causes the floor structure to always move in a direction that would not increase the predefined width of the reversibly foldable freight container beyond eight (8) feet as provided in ISO 668 Fifth Edition 1995 Dec. 15.

A predefined width of the reversibly foldable freight measured at corner fittings of the reversibly foldable freight container does not extend beyond the predefined width of eight (8) feet provided in ISO 668 Fifth Edition 1995 Dec. 15. The floor structure includes a plurality of jointed members, where each of the jointed members includes a first elongate section having a surface defining a first oblong opening, a second elongate section having a surface defining a second oblong opening, and a pin passing through the first oblong opening and the second opening to connect the first elongate section and the second elongate section, where reversibly folding the floor structure includes causing the first oblong opening and the second oblong opening to move relative each other and the pin so that the floor structure always moves in a direction that will not increase the predefined width of the reversibly foldable freight container beyond eight (8) feet as provided in ISO 668 Fifth Edition 1995 Dec. 15.

The method can also include positioning the front door of the front wall of a reversibly foldable freight container inside the volume defined by the reversibly foldable freight container that includes unlocking from the end frame a portion of a truss attached to the door. The locking rods mounted to the door of the rear wall can be extended to position cams mounted on the locking rods directly adjacent a cam keeper on the end frame of the rear wall. The cams mounted on the locking rods can be secured to the cam keepers on the end frame of the rear wall.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

Figure 1A:
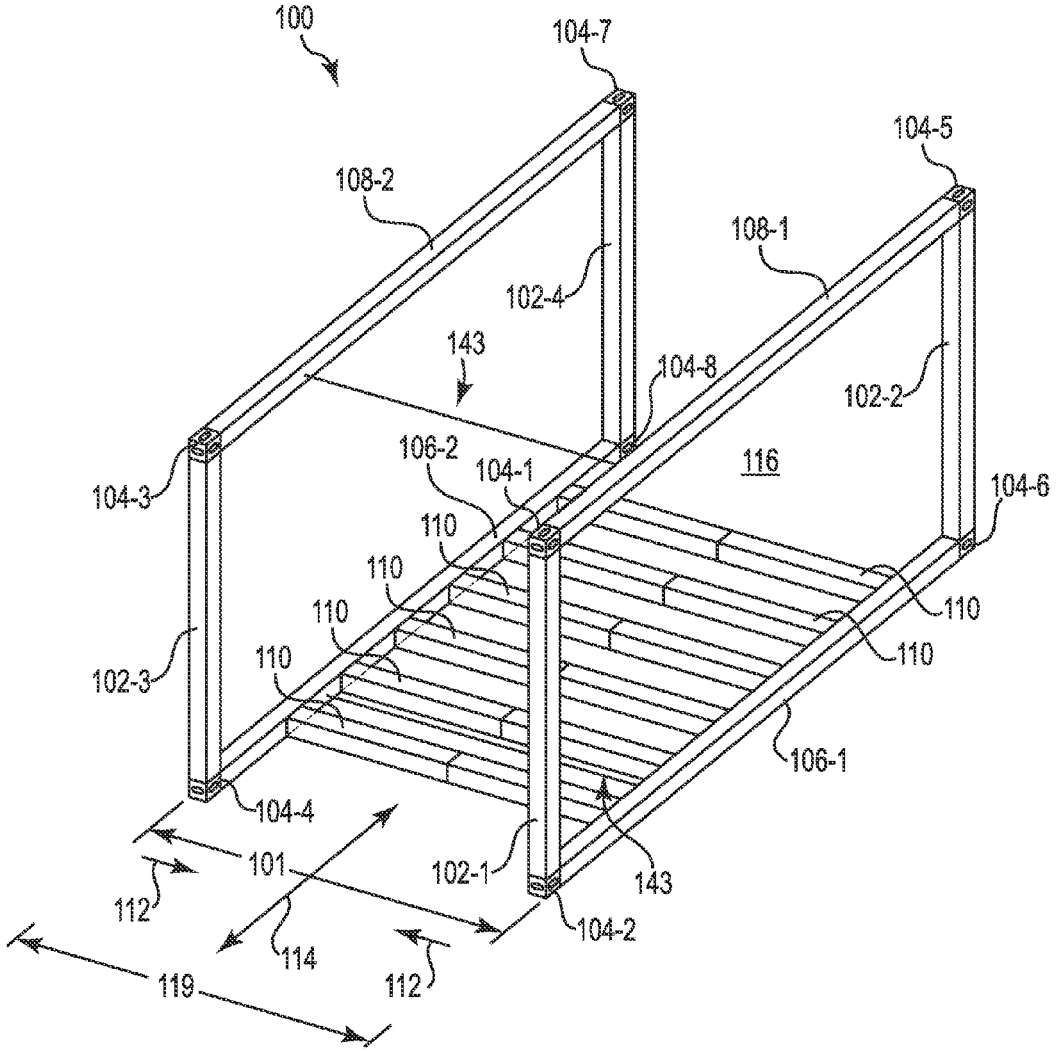
FIGS. 1A-1B illustrate a reversibly foldable freight container according to the present disclosure, where portions of the reversibly foldable freight container have been removed to show detail.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.). The figures herein follow a numbering convention in which the first digit or digits correspond to the drawing figure number and the remaining digits identify an element in the drawing. Similar elements between different figures may be identified by the use of similar digits. For example, 354 may reference element "54" in FIG. 3, and a similar element may be referenced as 454 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

Freight containers (also known as containers, ship containers, intermodal containers and/or ISO containers, among other names) can be transported by rail, air, road and/or water. Freight containers are often times transported empty. Because the freight container occupies the same volume whether it contains goods or not, the cost (both financial and environmental) to transport an empty freight container can be equivalent to the cost of transporting a full freight container. For example, the same number of trucks (e.g., five) would be needed to transport the same number of empty freight containers (e.g., five). In addition, freight containers often times sit empty at storage facilities and/or transportation hubs. Regardless of where the freight container is located (in transit or in storage) the volume an empty freight container occupies is not being used to its full potential.

One solution to these issues would be a reversibly foldable freight container. Having a reversibly foldable freight container would allow for an "empty" freight container to be folded to achieve a volume that is smaller than its fully expanded state. The extra volume acquired by at least partially folding the reversibly foldable freight container could then be used to accommodate other at least partially folded reversibly foldable freight containers, provide additional volume for unfolded (e.g., regular) freight containers and/or reversibly foldable freight containers in their fully expanded state. So, for example, a number of reversibly foldable freight containers that are empty (e.g., five) could be folded and nested in such a way that one truck could transport the number of empty reversibly foldable freight containers. As a result the environmental and cost savings are expected to be significant.

Embodiments of the present disclosure provide for a reversibly foldable freight container, as discussed herein. For one or more embodiments, the reversibly foldable freight container conforms to the International Organization for Standardization (ISO) standard. For example, the reversibly foldable freight container, as disclosed herein, conforms to ISO standard 688 and ISO standard 1496 (and the amendments to ISO standard 1496), each incorporated herein by reference. As discussed herein, the commercial standards for freight containers are set by the ISO. The ISO sets the commercial standards for almost every aspect of the freight container. Such commercial standards include, but are not limited to, the design, dimensions, dimensional tolerances, freight transport, ratings, weight (mass), center of gravity, load capacity, hoisting tests, symbols, marking, position, stacking tests, weather resistance, and mechanical testing of the freight container, among others.

The reversibly foldable freight container, as discussed herein, includes a plurality of a jointed member, as disclosed herein. The reversibly foldable freight container of the present disclosure can transition from an unfolded state to a folded state without expanding the reversibly foldable freight container beyond a predefined width of the unfolded state. The reversibly foldable freight container may transition from the folded state back to the unfolded state, and is thus reversibly foldable. As used herein a "folded state" of the reversibly foldable freight container is a state that does not include the unfolded state, as discussed herein. The folded state can include, but is not limited to, the second predetermined state of the reversibly foldable freight container.

Figure 1B:
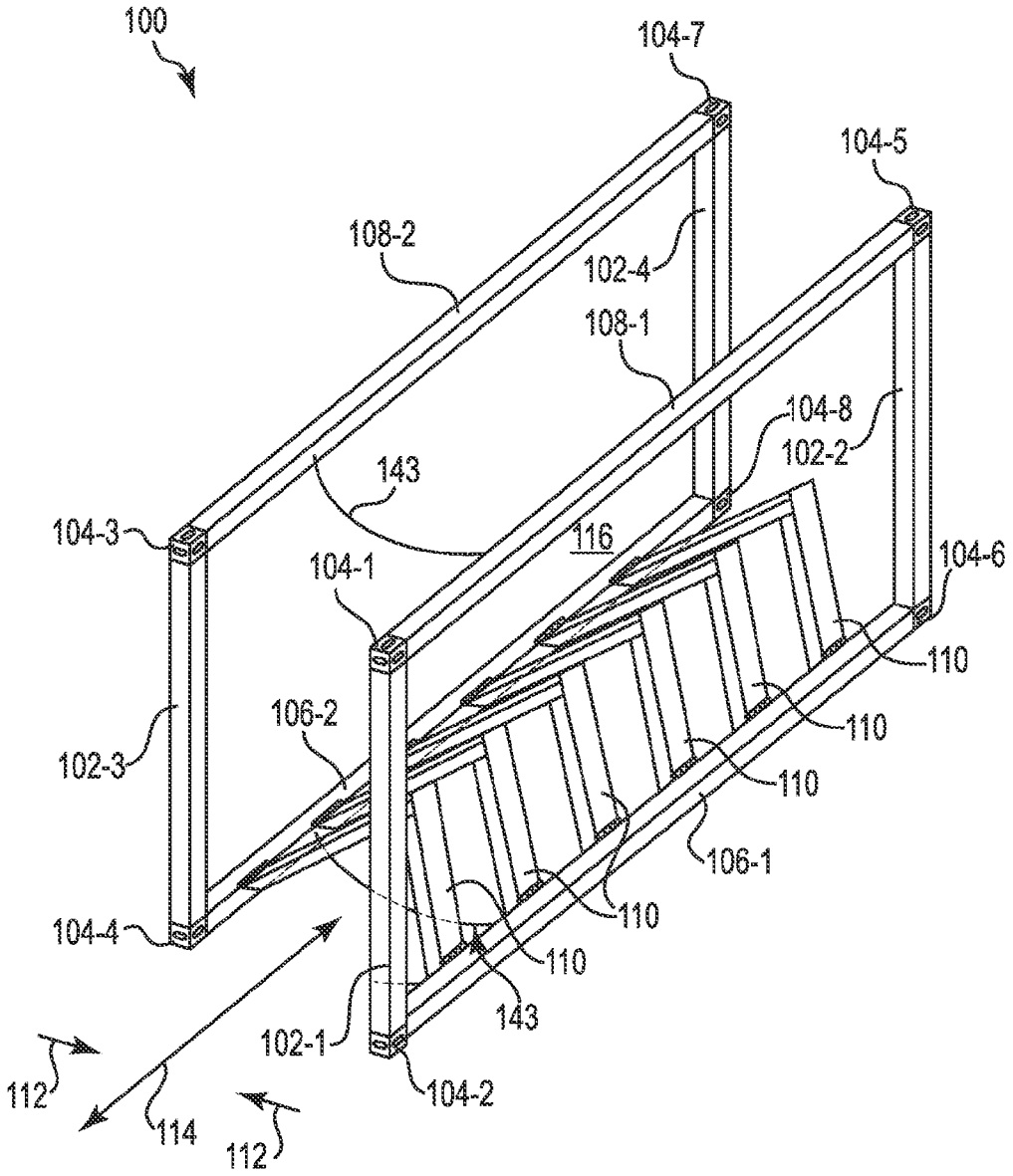

FIGS. 1A and 1B illustrate a reversibly foldable freight container 100, in partial view, according to one or more embodiments of the present disclosure. In FIGS. 1A and 1B portions of the reversibly foldable freight container 100 have been removed (e.g., portions of the roof structure, portions of the sidewall structures, portions of the floor structure, portions of the front wall and rear wall, portions of the door assembly, etc.) to allow the location and relative position of the jointed member 110, which in this embodiment acts as a cross member of the reversibly foldable freight container 100, to be more clearly seen. The reversibly foldable freight container 100 illustrated in FIG. 1A is shown in an unfolded state.

As illustrated in FIG. 1A, the reversibly foldable freight container 100 includes a first corner post 102-1, a second corner post 102-2, a third corner post 102-3, and a fourth corner post 102-4. The corner posts 102-1 through 102-4 are load bearing vertical support members that are both rigid and unfoldable. In addition, the corner posts 102-1 through 102-4 are of sufficient strength to support the weight of a number of other fully loaded freight containers stacked upon the reversibly foldable freight container 100. Each of the corner posts 102-1 through 102-4 includes a corner fitting 104-1 through 104-8. The corner fittings 104-1 through 104-8 may be employed for griping, moving, placing, and/or securing the reversibly foldable freight container 100. In one embodiment, the corner posts 102-1 through 102-4 and the corner fittings 104-1 through 104-8 comply with the ISO standards for freight containers, such as ISO standard 688 and ISO standard 1496 (and the amendments to ISO standard 1496), among others. In the unfolded state a predefined width 101 of the reversibly foldable freight container 100 is eight (8) feet (measured from the corner fittings) as provided in ISO 668 Fifth Edition 1995 Dec. 15.

The reversibly foldable freight container 100 also includes a first bottom side rail 106-1 and a second bottom side rail 106-2. As illustrated, the first bottom side rail 106-1 is located between the first corner post 102-1 and the second corner post 102-2, and the second bottom side rail 106-2 is located between the third corner post 102-3 and the fourth corner post 102-4. The reversibly foldable freight container 100 further includes a first upper side rail 108-1 and a second upper side rail 108-2. The first upper side rail 108-1 may be located between the first corner post 102-1 and the second corner post 102-2. The second upper side rail 108-2 may be located between the third corner post 102-3 and the fourth corner post 102-4.

The reversibly foldable freight container 100 further includes a jointed member 110 according to the present disclosure. As illustrated, the first and second bottom side rails 106-1 and 106-2 are joined by two or more of the jointed members 110. The jointed member 110 acts as a "cross member" in the reversibly foldable freight container 100 when the reversibly foldable freight container 100 is in an unfolded state. Functioning as a cross member, the jointed member 110 acts as a beam to help carry a structural load placed on a floor structure of the reversibly foldable freight container 100. To this end, the joined member 110 of the present disclosure can help carry a structural load as prescribed in ISO standard 1496. Unlike a typical cross member, however, the joined member 110 of the present disclosure can then be used to help the reversibly foldable freight container 100 to reversibly fold in a lateral direction 112, relative a longitudinal direction 114 of the upper and bottom side rails 106 and 108.

Referring now to FIG. 1B, there is shown the reversibly foldable freight container 100 in at least a partially folded state. As illustrated in FIG. 1B, the jointed member 110 of the reversibly foldable freight container 100 folds into a volume 116 defined by the reversibly foldable freight container 100. As the jointed member 110 folds, the corner posts 102-1 through 102-4 and the corner fittings 104-1 through 104-8 are drawn closer together laterally. Once again, this reduction in the volume 116 and the "foot-print" (e.g., area) of the reversibly foldable freight container 100 from an unfolded state (e.g. FIG. 1A) can be accomplished, as least in part, due to the presence of the jointed members 110.

As discussed more fully herein, one major obstacle overcome by the joined member 110 of the present disclosure is its ability to not only act as a structural member or beam capable of helping to support a load as prescribed in ISO standard 1496 when in an unfolded state, but also its surprising ability to transition to a folded state without having any portion of the jointed member 110 extending beyond its defined maximum length 119 as defined in an unfolded state (see FIG. 1A). This defined maximum length 119 of the jointed member 110 can be the maximum length of the jointed member in an unfolded state. So, the jointed member of the present disclosure can transition from an unfolded state to a folded state without causing any portion of the jointed member (e.g., the ends of the joined member that help define the defined maximum length) to extend beyond its defined maximum length. As a result, the reversibly foldable freight container can transition from the unfolded state towards the folded state without any portion of the reversibly foldable freight container extending beyond its predefined width 101. This issue is presented as follows.

Figure 2:
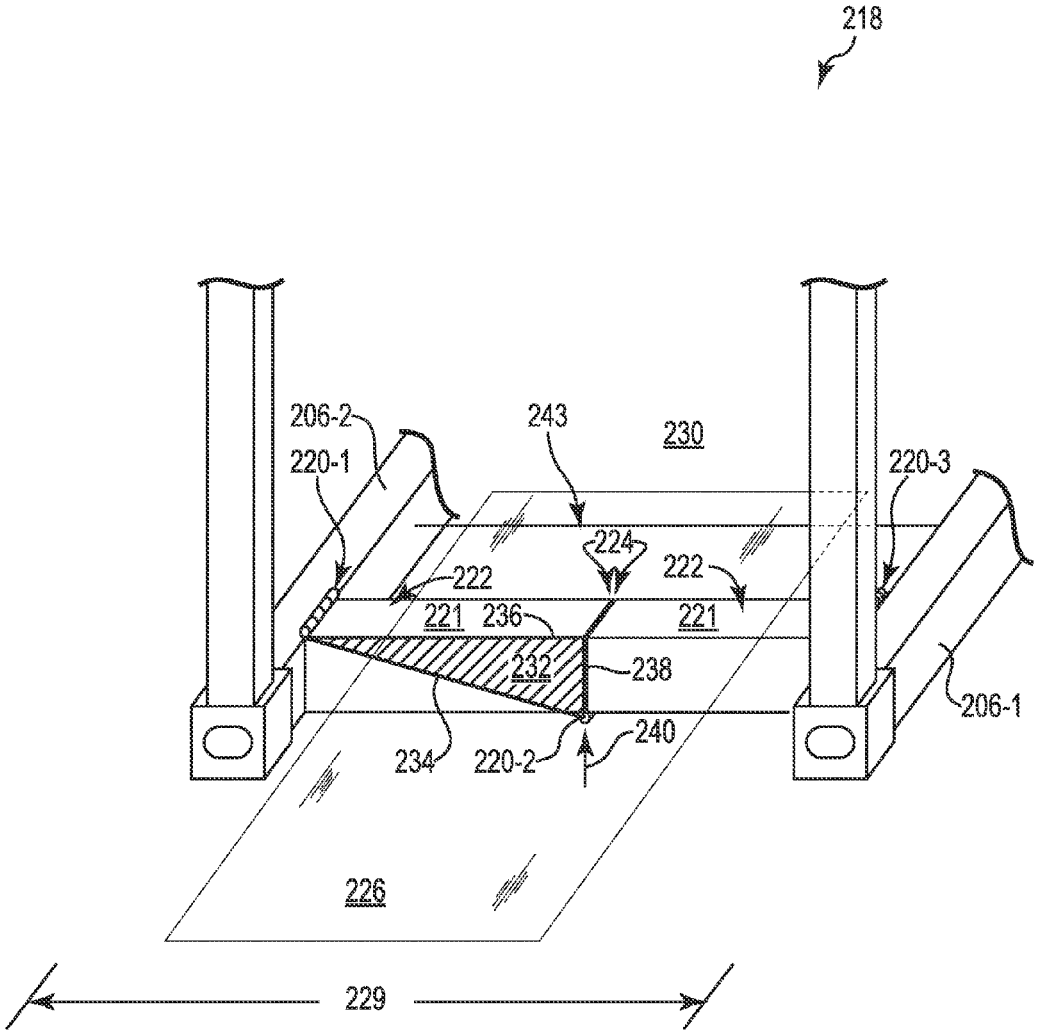
FIG. 2 illustrates an end view of a freight container shown in partial view.

Referring to FIG. 2, there is shown an end view of a freight container 218. The freight container 218 is shown in a partial view, where portions of the floor structure (e.g., the wood flooring), sidewall structure, end frames (e.g., front wall and rear wall) and door assembly have been removed to better illustrate the issues encountered with trying to fold the freight container 218. The freight container 218 does not include the jointed member of the present disclosure, but rather is shown with hinges 220-1 through 220-3 that connect two portions (e.g., halves) of a cross member 222. Conventional thinking would dictate that the hinges 220-1 through 220-3 should act as a bearing that not only connects the halves of the cross members 222 together and to the bottom side rails 206-1 and 206-2 of the freight container 218, but also allows for the cross member 222 to fold into a volume 230 of the freight container 218.

The cross members 222 can have a variety of cross sectional shapes. Such cross-sectional shapes can include box (e.g. rectangular or square), C-channel, Z-beam and I-beam cross sectional shapes. As illustrated, these cross-sectional shapes allow for surfaces 224 of the cross members 222 to abut each other when in the unfolded state. When abutted, the surfaces 224 of cross-member 222 come under compression, with help from the hinge 220-1 to prevent the upper surface 221 of the cross-member 222 from extending below a plane 226 when a structural load is placed on the floor of the freight container 218. The plane 226 is an imaginary flat surface on which a straight line joining any two points would wholly lie. So, in the present embodiment, any two points on the upper surface 221 of the cross-member 222 would lie in the plane 226.

As illustrated, the placement of the hinges 220-1 through 220-3 would appear to allow for the floor structure of the freight container 218 to fold within a maximum defined width 229. This, however, is not the case. As illustrated, the cross member 222 of the freight container 218 is in the unfolded state and has a maximum defined width 229. Also illustrated in freight container 218 are three hinges 220-1 through 220-3 which appear to allow for the cross member 222 of the freight container 218 to fold up into the volume 230 defined by the freight container 218. Examining the relative location of the three hinges 220-1 through 220-3 the corners of a right triangle 232 (shown with shading) are present. The right triangle 232 includes a hypotenuse 234 that is longer than either of a first leg 236 or a second leg 238 of the right triangle 232. As appreciated, the greater the length of the second leg 238 the longer the hypotenuse 234. The length of the second leg 238 can change depending upon the load the freight container 218 is intended to carry.

It can also be seen that in the unfolded state the length of two of the first legs 236 helps to define the maximum defined width 229 of the freight container 218. Now, as the freight container 218 begins to fold from an unfolded state the width of the freight container 218 will have to become greater than the maximum defined width 229 to accommodate the length of the hypotenuse 234. So, if the cross member 222 were to move along the direction of travel 240 there would not be enough width available for the two portions that makes up the cross member 222 to move from or return to the unfolded state (e.g., the condition where the floor of the freight container 218 is parallel with the plane 226). This issue is referred to herein as "the hypotenuse issue."

If the two portions that makes up the cross member 222 were to be forced to move along the direction of travel 240 the overall width of the freight container 218 will have to increase beyond its maximum defined width 229. Therefore, when transitioning a container from an unfolded state to a folded state it may be desirable to provide that the width of the container does not expand beyond its maximum defined width 229 in the unfolded state.

If the two portions that makes up the cross member 222 were to be forced to move along the direction of travel 240 at least one of following may happen: (1) the overall width of the freight container 218 will have to increase beyond its maximum defined width 229; (2) the portions that make up the cross member 222 will have to bend or deform (elastically or non-elastically); and/or (3) the first, second and/or third hinge 220-1, 220-2, 220-3 will deform and/or break. The issues become more apparent when a structure 243 is used with the freight container 218, such as a roof structure and/or a lateral bracing member, each having a fixed length and/or width that cannot, or should not, be extended beyond the maximum defined width 229 of the freight container 218. Examples of such lateral bracing members can includes, but are not limited to, cables, structural beams, rods and/or tubes that can be used to help brace and support the freight container 218 in an unfolded state. As will be appreciated, one or more of these structures (e.g., the roof structure, a lateral bracing member, one or more of the hinges, and/or the cross member 222, among other structures) could be damaged as the freight container 218 folds from an unfolded state.

Regardless of what does happen one thing is almost certain, due to the hypotenuse issue discussed herein expanding the freight container 218 beyond its maximum defined width 229 may result in weakening of the freight container 218 (e.g., the hinges 220-1 through 220-3, the cross member 222 and/or the structure 243) such that it would no longer be able to support a load (e.g. no longer be in compliance with the ISO standards) thus rendering the freight container 218 unfit for its intended purpose. Therefore, when transitioning a container from an unfolded state to a folded state it may be desirable to provide that the width of the container does not expand beyond its maximum defined width 229 in the unfolded state.

The joined member used in the reversibly foldable freight container of the present disclosure helps to address the hypotenuse issue discussed herein. The jointed member, as disclosed herein, allows the reversibly foldable freight container 100 to transition from an unfolded state to a folded state without expanding beyond the predefined width 101 of the container in the unfolded state. As discussed herein, the jointed member 110 is configured in such a way that during the folding process the length of the hypotenuse changes (e.g., is accommodated). From the folded state the container may transition back to the unfolded state, and is thus reversibly foldable.

In addition, when a structure 143 is used with the reversibly foldable freight container 100 (e.g., such as a roof structure and/or a lateral bracing member) the jointed member 110 allows the reversibly foldable freight container 100 to reversibly fold within a fixed length and/or width of the structure 143. Examples of such structures 143 can include, but are not limited to, cables, structural beams, rods and/or tubes that can be used to help brace and support the reversibly foldable freight container 100 in an unfolded state. As will be understood reading the present disclosure these structures (e.g., the roof structure, a lateral bracing member, one or more of the hinges, and/or the jointed member 110, among other structures) will not be damaged as the reversibly foldable freight container 100 folds from an unfolded state.

As discussed herein, the jointed member is configured in such a way that during the folding process the length of the hypotenuse changes (e.g., is accommodated) thereby preventing damage to the jointed member, associated hinges and structures (e.g., 143). From the folded state the reversibly foldable freight container may transition back to the unfolded state, and is thus reversibly foldable.

As used in the reversibly foldable freight container 100, the joined member 110 can act as a beam. As used herein, a beam is a structural element that is capable of withstanding a load primarily by resisting bending. For various embodiments, the joined member can be configured as a beam, or as part of a beam, for the reversibly foldable freight container 100. In addition to acting as a beam, however, the joined member of the present disclosure also allows for the reversibly foldable freight container 100 to fold. When in a folded state, the reversibly foldable freight container occupies a volume that is less than that of the reversibly foldable freight container in an unfolded state. So, when in the folded state the structure occupies a volume and/or an area that is less than that of the structure in an unfolded state.

Another significant advantage of the jointed member used in the reversibly foldable freight container 100 of the present disclosure is its surprising ability to fold within a defined maximum length of the jointed member (e.g., the defined maximum length can be a maximum length of the jointed member). This defined maximum length of the jointed member can be the length of the jointed member in an unfolded state. So, the jointed member of the present disclosure can transition from an unfolded state to a folded state without causing any portion of the jointed member (e.g., the ends of the joined member that help define the defined maximum length) to extend beyond its defined maximum length. The following discussion will help to further clarify the problem that the jointed member of the present disclosure has helped to overcome.

Figure 3:
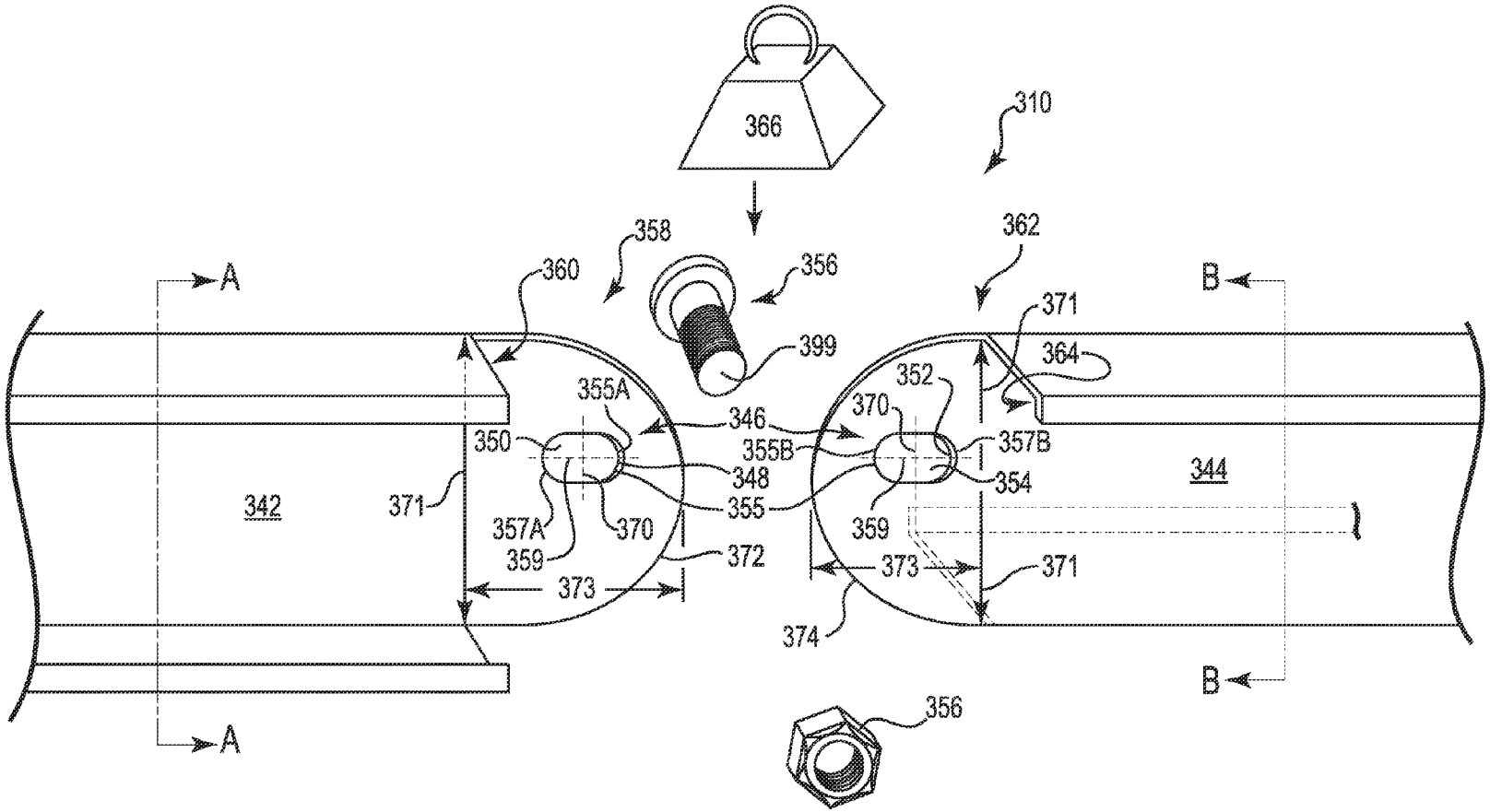
FIG. 3 illustrates an exploded view of a jointed member according to the present disclosure.

Referring now to FIG. 3, there is illustrated, in an exploded view, the jointed member 310. As illustrated, the jointed member 310 includes a first elongate section 342 and a second elongate section 344. Each of the first elongate section 342 and the second elongate section 344 can have a length that is equal. Alternatively, one of the first elongate section 342 and the second elongate section 344 can be longer than the other elongate section. The jointed member provided herein is also discussed in a co-pending application entitled "Jointed Member" (docket #128.0020005, U.S. application Ser. No. 14/239,041), which is incorporated herein by reference in its entirety.

In one or more embodiments, each of the first elongate section 342 and the second elongate section 344 has an oblong opening 346. As discussed herein, an oblong opening, such as 346 among the others discussed herein, can have an obround shape or a double D shape. As such, the word oblong, as used herein, can be replaced with either the word "obround" or "double D" as so desired. Obround is defined as consisting of two semicircles connected by parallel lines tangent to their end points. Double D is defined as consisting of two arcs connected by parallel lines tangent to their end points. As used herein, an obround or double D shape does not include a circular shape.

As illustrated, the first elongate section 342 has a first surface 348 defining a first oblong opening 350 through the first elongate section 342, and the second elongate section 344 has a second surface 352 defining a second oblong opening 354 through the second elongate section 344. As illustrated, each of the surfaces 348 and 352 has a first end 355 (marked as 355-A for the first oblong opening 350, and marked as 355-B for the second oblong opening 354) and a second end 357 (marked as 357-A for the first oblong opening 350, and marked as 357-B for the second oblong opening 354), where the second end 357 is opposite the first end 355 along a longitudinal axis 359 of each of the first oblong opening 350 and the second oblong opening 354.

The joined member 310 also includes a fastener 356, a portion of which passes through the first and second oblong opening 350 and 354. As will be discussed more fully herein, the fastener 356 may pass through the first oblong opening 350 and the second oblong opening 354. The fastener 356 is then secured in position to help hold the first elongate section 342 and the second elongate section 344 together (e.g., the fastener 356 mechanically joins the first elongate section 342 and the second elongate section 344).

While the fastener 356 mechanically joins the first elongate section 342 and the second elongate section 344, the first elongate section 342 and the second elongate section 344 are also able to slide relative to each other and to rotate about the fastener 356. This ability of the first elongate section 342 and the second elongate section 344 to slide relative each other allows for a change in the length of the hypotenuse as the jointed member 310 folds, thereby preventing damage to the jointed member, associated hinges and structures, as discussed herein. This ability to both slide relative each other and to rotate about the fastener 356 provides at least two of the features that allow the jointed member 310 to overcome the hypotenuse issue. This aspect of the invention will be discussed more fully herein.

The use of a variety of fastener 356 is possible. For example, the fastener 356 can be in the form of a bolt or a rivet. The bolt can have a threaded portion at or adjacent a first end for receiving a nut and a head at a second end opposite the first end. The nut and the head of the bolt can have a diameter relative the first oblong opening 350 and the second oblong opening 354 that prevents either from passing through the openings 350 and 354 (e.g., only the body of the bolt passes through the openings 350 and 354). A washer can also be used between the head and nut of the bolt to help prevent either from passing through the openings 350 and 354.

Examples of bolts can include, but are not limited to, structural bolts, hex bolts, or carriage bolts, among others. The nut used with the bolt can be a locknut, castellated nut, a slotted nut, a distorted thread locknut, an interfering thread nut, or a split beam nut, among others. A jam nut can also be used with the nut if desired. Examples of a rivet include a solid rivet having a shaft that can pass through and a head that does not pass through the openings 350 and 354. A shop head can then be formed on the rivet that fastens the first elongate section 342 and the second elongate section 344. Regardless of which fastener is used, however, the fastener 356 is not tightened so much as to prevent the first elongate section 342 and the second elongate section 344 of the jointed member 310 from sliding relative to each other and rotating about the fastener 356.

As discussed herein, the fastener 356 passes through the first oblong opening 350 and the second oblong opening 354 to connect the first elongate section 342 and the second elongate section 344. For one or more of the embodiments, the first oblong opening 350 and the second oblong opening 354 move relative each other and relative the fastener 356 as the jointed member 310 transitions from a first predetermined state to a second predetermined state. For the present disclosure, the first predetermined state can be the unfolded state of the jointed member 310. In the unfolded state the jointed member 310 can only move towards its second predetermined state.

As illustrated herein, the fastener 356 has an axial center 399 (e.g., a longitudinal axis around which the fastener 356 can rotate) that moves along (e.g., essentially parallel with) the longitudinal axis 359 of the first oblong opening 350 and the second oblong opening 354 as the jointed member 310 transitions from a first predetermined state to a second predetermined state. The cross-sectional shape of the fastener 356 is of a size and a shape that allows the fastener 356 to travel along the longitudinal axis 359 of the first oblong opening 350 and the second oblong opening 354 as the jointed member 310 transitions from a first predetermined state to a second predetermined state without any significant amount of travel along the minor axis 370 of the first oblong opening 350 and the second oblong opening 354. So, for example, the distance between the parallel lines tangent to the end points of the two semicircles of the first and second obround openings 350 and 354 is approximately the diameter of the portion of the fastener 356, illustrated herein, that passes through the first and second obround openings 350 and 354.

Figure 4:
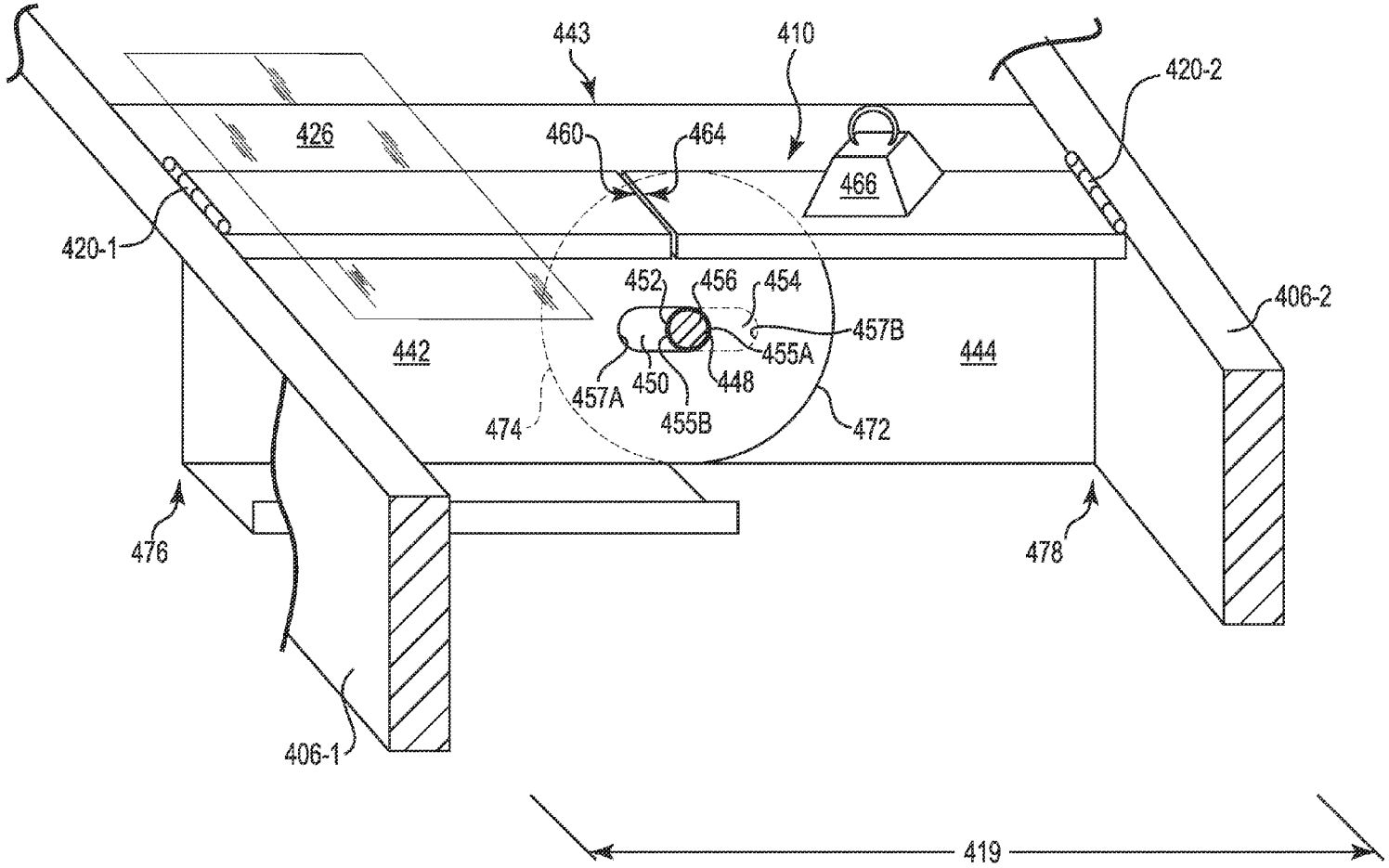
FIG. 4 illustrates a jointed member according to the present disclosure.
Figure 6:
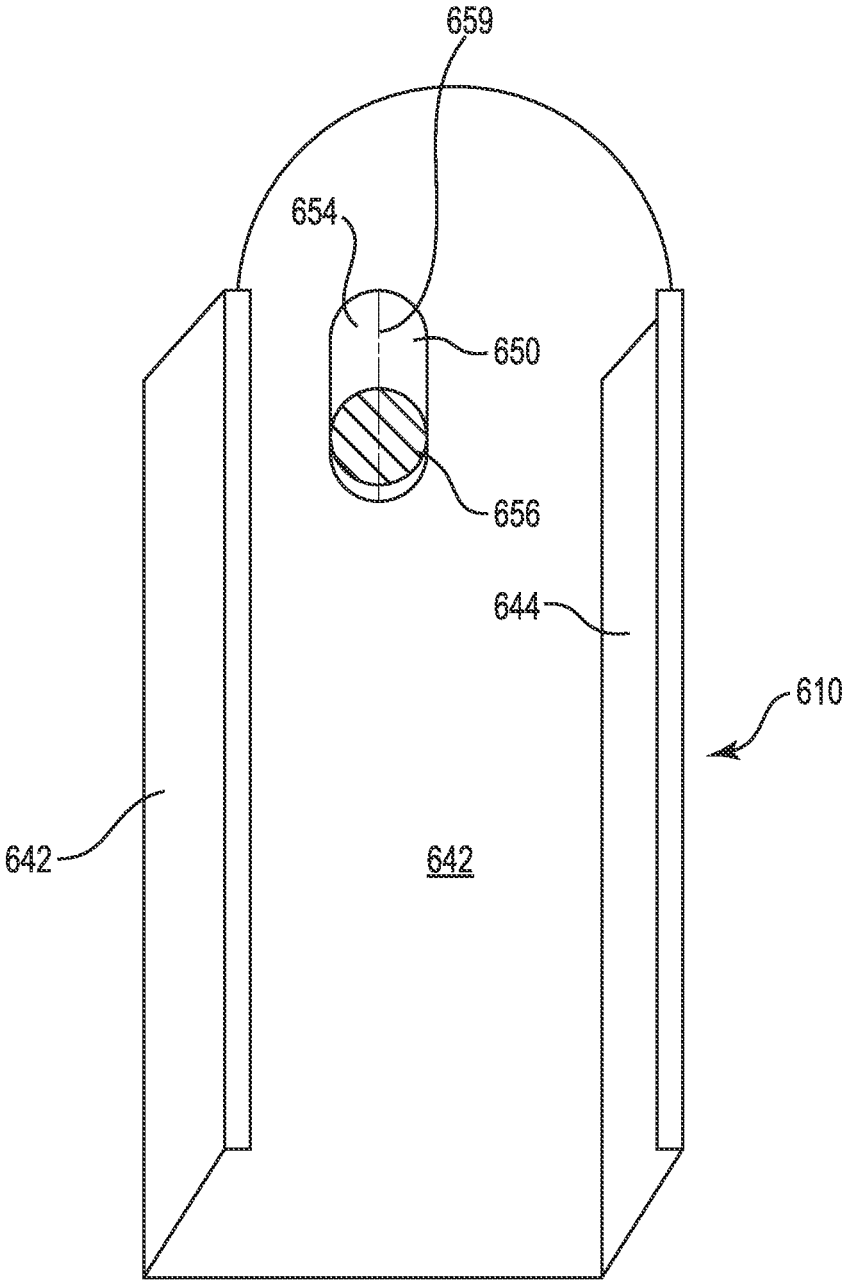
FIG. 6 illustrates a portion of the jointed member according to the present disclosure.

Referring now to FIG. 4, there is illustrated the first elongate section 442 and the second elongate section 444 of the jointed member 410 in the first predetermined state. In the first predetermined state the first oblong opening 450 and the second oblong opening 454 have a minimum overlap relative to the second predetermined state (an embodiment of the second predetermined state is shown in FIG. 6 and discussed more fully herein) of the jointed member 410 and the amount of overlap in the positions between the first and second predetermined states.

Specifically, the amount of overlap shown in FIG. 4 for the first predetermined state is approximately the cross sectional area of the portion of the fastener 456, shown from an end view, that passes through the openings 450 and 454. In one embodiment, the area of the overlap is equal to the cross sectional area of the portion of the fastener 456 that passes through the openings 450 and 454. For either embodiment discussed in this paragraph, the first oblong opening 450 and the second oblong opening 454 when in their first predetermined state also define a shape that corresponds to the cross-sectional shape of the portion of the fastener 456 that passes through the openings 450 and 454.

Referring again to FIG. 3, the surface 348 defining the first oblong opening 350 and the surface 352 defining the second oblong opening 354 each include the first end 355 and the second end 357 opposite the first end 355. The first end 355 and the second end 357 are each in the shape of an arc that helps the surfaces 348, 352 to form a circular shape when in the first predetermined state (seen in FIG. 4). For other embodiments, the first end 355 and/or the second end 357 may include one or more shapes including but not limited, a polygonal shape, a non-polygonal shape, and combinations thereof. In addition, the first oblong opening and the second oblong opening, as discussed herein, can be positioned at a number of different locations along a height 371 and/or a width 373 of a first end 358 of the first elongate section 342 and a first end 362 of the second elongate section 344.

So, as illustrated in FIG. 4, in the first predetermined state the first oblong opening 450 and the second oblong opening 454 provide a circular shape that corresponds to a circular cross-sectional shape of the portion of the fastener 456 that passes through the openings 450 and 454. In addition to have the same shape, the area defined by the first oblong opening 450 and the second oblong opening 454 in the first predetermined state is the cross sectional area of the portion of the fastener 456 that passes through the openings 450 and 454. As appreciated and as will be discussed herein, both the cross sectional area of the portion of the fastener 456 that passes through the openings 450 and 454 and the area defined by the first oblong opening 450 and the second oblong opening 454 in the first predetermined state are not so exacting that the first elongate section 442 and the second elongate section 444 bind so as to be unable to slide relative to each other and to rotate about the fastener 456.

In the first predetermined state a portion of the first surface 448 and a portion of the second surface 452 are in physical contact with the fastener 456 that passes through the openings 450 and 454. In other words, a portion of the surface 448 and a portion of the surface 452 sit or rest against a portion of the fastener 456 that passes through the openings 450 and 454 when in the first predetermined state.

As illustrated in FIG. 3, the first elongate section 342 includes the first end 358 having a first abutment member 360 and the second elongate section 344 includes the first end 362 having a second abutment member 364. In the first predetermined state the first abutment member 360 and the second abutment member 364 are in physical contact and a portion of the first surface 348 and a portion of the second surface 352 are in physical contact with the fastener 356. In other words, the first abutment member 360 and the second abutment member 364 abut when the jointed member 310 is in the first predetermined state. FIG. 4 provides an illustration of the first abutment member 460 and the second abutment member 464 in the first predetermined state, where the abutment members 460 and 464 abut.

Referring again to FIG. 3, when the jointed member 310 is in the first predetermined state, or the unfolded state, and a structural load 366 is applied to the joined member 310 causes the first abutment member 360 and the second abutment member 364 to come under compression (e.g., each abutment member 360 and 364 applies a compressive force to the other). At the same time a portion of the surface 348 of the first oblong opening 350 and the surface 352 of the second oblong opening 354 apply a shearing stress to the portion of the fastener 356 that passes through the openings 350 and 354. For example, the shearing stress in the first predetermined state is applied to the fastener 356 by the first end 355 of both the first surface 348 (355-A) and the second surface 352 (355-B). As such, in the first predetermined state the fastener 356 is not free to move along the longitudinal axis 359 of the first oblong opening 350 and the second oblong opening 354. As a result, the structural load 366 is held in the first predetermined state on the jointed member 310, which has the compressive forces of the first abutment member 360 and the second abutment member 364 helping to offset the shear stress applied to the portion of the fastener 356 that passes through the openings 350 and 354.

As illustrated in FIG. 3 the first oblong opening 350 and the second oblong opening 354 have an obround shape each with the longitudinal axis 359 (a major axis) that is longer than a minor axis 370. The longitudinal axis 359 and the minor axis 370 can each have symmetry relative to each other. In addition, the length of the longitudinal axis 359 is greater than the length of the minor axis 370. For example, a ratio of a length of the longitudinal axis 359 to a length of the minor axis 370 are in a range of 10.0:1.0 to 1.1 to 1.0, 8.0:1.0 to 1.1:1.0, or 5.0:1.0 to 1.1:1.0. As used herein, "axis" does not necessarily imply symmetry, although for one or more embodiments the oblong opening may be symmetric about the major axis, the minor axis, or both axes. As used herein, "axis" refers to a straight line about which a geometric feature, e.g. an oblong opening, may be thought of as rotatable.

As illustrated in FIG. 3, the first end 358 of the first elongate section 342 further includes a surface 372 defining an arc, in this case a semi-circle, and the first end 362 of the second elongate section 344 further includes a surface 374 defining an arc, in this case a semi-circle. The surfaces 372 and 374 in the shape of an arc allow either the first end 358 of the first elongate section 342 or the first end 362 of the second elongate section 344 to move relative each other without interfering with either abutment member 360 or 364. For example, as the jointed member 310 transitions from the first predetermined state towards the second predetermined state the first end 358 of the first elongate section 342 can move relative the second abutment member 364 on the second elongate section 344. The shape of the surface 372 accommodates a travel path that does not come into contact with the second abutment member 364 on the second elongate section 344. Shapes other than an arc are possible and include, but are not limited to a polygonal shape, a non-polygonal shape, and combinations thereof.

As discussed herein, FIG. 4 illustrates an embodiment of the first elongate section 442 and the second elongate section 444 of the jointed member 410 in the first predetermined state, which may be referred to as an unfolded state. In the first predetermined state the first oblong opening 450 and the second oblong opening 454 have a minimum overlap relative to the second predetermined state (shown in FIG. 6 and discussed more fully herein) of the jointed member 410 and the amount of overlap in many of the positions between the first and second predetermined states. Specifically, the amount of overlap shown in FIG. 4 for the first predetermined state is approximately the cross sectional area of the portion of the fastener 456 (shown in cross section) that passes through the openings 450 and 454. In one embodiment, the area of the overlap is equal to the cross sectional area of the portion of the fastener 456 that passes through the openings 450 and 454. For either embodiment discussed in this paragraph, the first oblong opening 450 and the second oblong opening 454 when in their first predetermined state also define a shape that corresponds to the cross-sectional shape of the portion of the fastener 456 that passes through the openings 450 and 454.

FIG. 4 also illustrates the relative position of the first abutment member 460 and the second abutment member 464 in the first predetermined state. As illustrated, the first elongate section 442 of the jointed member 410 includes a first member end 476 that is opposite the first abutment member 460. Similarly, the second elongate section 444 of the jointed member 410 includes a second member end 478 that is opposite the second abutment member 464. In the first predetermined state, as shown in FIG. 4, a distance between the first member end 476 of the first elongate section 442 and the second member end 478 of the second elongate section 444 provides the defined maximum length 419 of the jointed member 410. As discussed with respect to FIG. 5A-5E, the distance between the first member end 476 of the first elongate section 442 and the second member end 478 of the second elongate section 444 does not exceed the defined maximum length 419 as the jointed member 410 transitions from the first predetermined state towards the second predetermined state.

A hinge 420-1 connects the first member end 476 of the first elongate section 442 to a side rail 406-1, such as the first bottom side rail discussed with respect to FIG. 1. Similarly, hinge 420-2 connects the second member end 478 of the second elongate section 444 to a side rail 406-2, such as the second bottom side rail discussed with respect to FIG. 1. FIG. 4 also shows defined maximum length 419 of the jointed member 410. As illustrated in FIGS. 5A-5D, the jointed member transitions from its first predetermined state (e.g., unfolded state) towards its second predetermined state (e.g., folded state) without having any portion of the jointed member extending beyond its defined maximum length 419 as defined in its first predetermined state.

FIG. 4 illustrates that when the jointed member 410 supports a structural load 466 the forces are distributed so as to cause the first abutment member 460 and the second abutment member 464 to be in compression and the surfaces 448 and 452 of the first and second oblong openings 450 and 454 to apply a shearing stress to the fastener 456. For example, the first end 455-A and the second end 455-B can apply a least a portion of the shearing stress to the fastener 456. It is also possible that the ends 476 and 478 of the first elongate section 442 and the second elongate section 444, respectively, can apply a compressive force against their respective side rails 406-1 and 406-2 as a result of the jointed member 410 supporting the structural load 466. In one embodiment, the ability of the ends 476 and 478 of the first elongate section 442 and the second elongate section 444 to apply a compressive force against their respective side rails 406-1 and 406-2 can eliminate the need for the first abutment member 460 and the second abutment member 464. This is because in supporting the structural load 466 the shearing stress applied at the surfaces 448 and 452 are offset by the compressive forces applied between the ends 476 and 478 and their respective side rails 406-1 and 406-2.

FIG. 4 further illustrates that as the structural load 466 is held in the first predetermined state on the jointed member 410 the first abutment member 460 and the second abutment member 464, under a compressive force, and the surfaces 448 and 452 applying the shearing stress to the fastener 456, with help from the hinges 420-1 and 420-2, prevent the jointed member 410 from bending or deflecting to any significant degree away from the plane 426. In one embodiment, structure 443, illustrated as a cable, can be used to help prevent the jointed member 410 from bending or deflecting to any significant degree away from the plane 426. Because a function of structure 443 is to prevent the jointed member 410 from bending or deflecting to any significant degree away from the plane 426, structure 443 would also prevent the jointed member 410 from folding, as discussed herein, but for the ability of the jointed member 410 to overcome the hypotenuse issue discussed herein.

The static interaction of the first abutment member 460 and the second abutment member 464, under a compressive force, and the surfaces 448 and 452 applying the shearing stress to the fastener 456, with help from the hinges 420-1 and 420-2, allow the joined member 410 of the present disclosure to carry the structural load 446 (e.g., as prescribed in ISO standard 1496).

Referring now to FIGS. 5A-5D there is shown the jointed member 510 transitioning from the first predetermined state towards the second predetermined state without any portion of the jointed member 510 extending beyond its defined maximum length 519. During this transition the first oblong opening, the second oblong opening, and the fastener can move relative each other. This relative movement helps to provide that the reversibly foldable freight container transitions from the first predetermined state towards the second predetermined state (e.g., a folded state) without expanding beyond either the defined maximum length 519 or the predefined width provided in the first predetermined state, while neither bowing or damaging the jointed member, a pivotal connection (e.g., a hinge) or a structure of the container. In other words, this relative movement has an effect of overcoming the hypotenuse issue discussed herein.

The jointed member 510 can fold in a way that the components of the reversibly foldable freight container do not extend beyond their predefined width (e.g., ISO standard width). The joined member 510 has the attributes of a compound hinge. Specifically, the joined member 510 has two distinct and separate axes of rotation that are used during the folding and/or the un-folding of the jointed member 510.

FIGS. 5A-5D illustrate the first elongate section 542 connected to a first bottom side rail 506-1 by a hinge 520-1 and the second elongate section 544 connected to a second bottom side rail 506-2 by a hinge 520-2. FIGS. 5A-5D also illustrate the first elongate section 542 and the second elongate section 544 joined by the fastener 556 that passes through the first and second oblong opening 550 and 554, respectively. The fastener 556 is shown in cross-section in FIG. 5A-5E to better illustrate its relationship to the first and second oblong opening 550 and 554 as the jointed member 510 moves from the first predetermined, or unfolded, position towards the second predetermined, or the folded position.

Figure 5A:
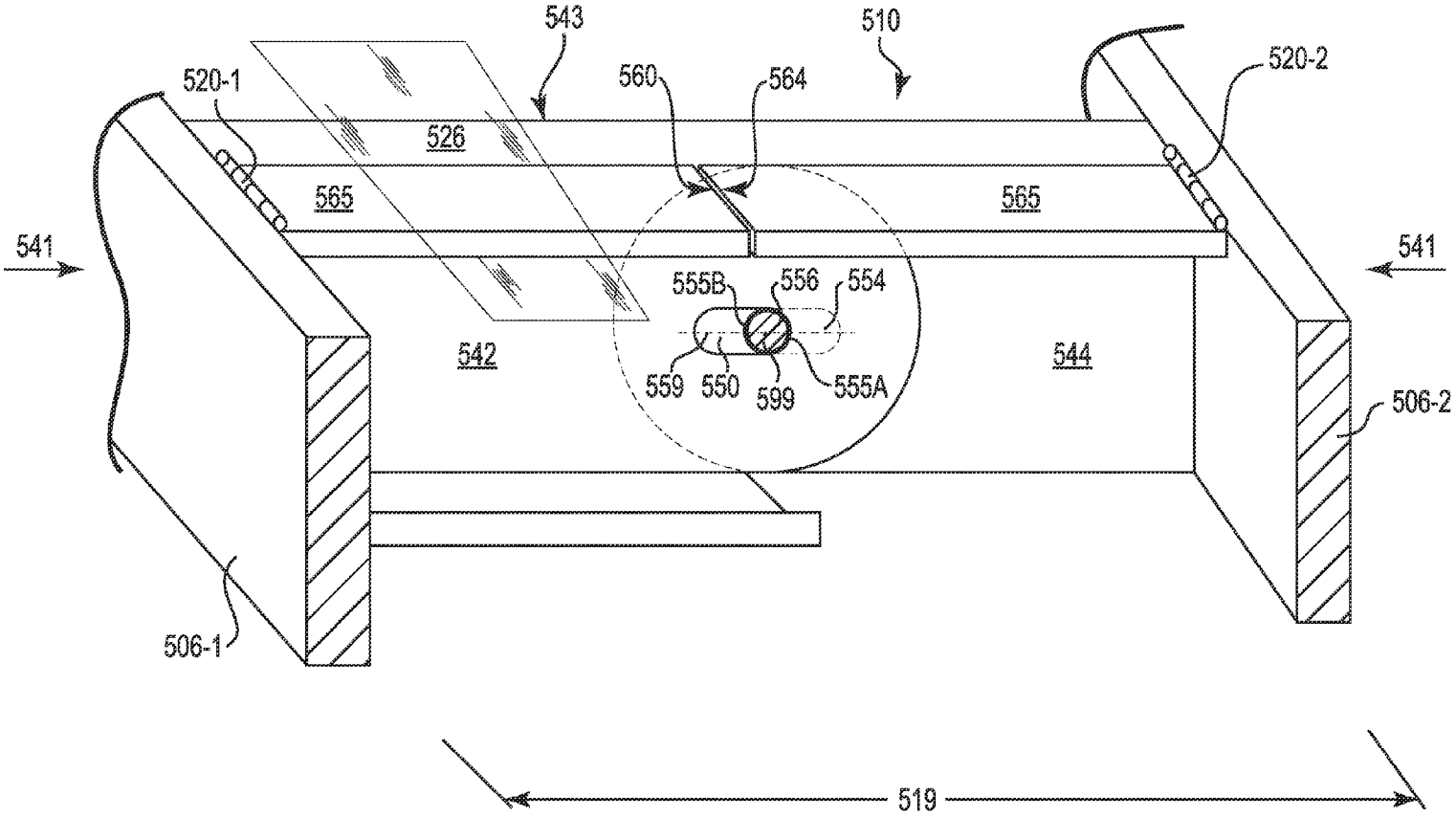
FIGS. 5A-5F illustrate a jointed member according to the present disclosure.

In FIG. 5A the jointed member 510 is shown in its first predetermined state having its defined maximum length 519. In this first predetermined state: the first and second abutment members 560 and 564 are in contact; the overlap of the first and second oblong openings 550 and 554 is at a minimum relative the second predetermined state (seen in FIG. 6); and the surfaces 548 and 552 of the first elongate section 542 and the second elongate section 544 define the cross-sectional shape of the portion of the fastener 556 passing through the first and second oblong openings 550 and 554. FIG. 5A also shows an upper surface 565 of the first and second elongate sections 542 and 544. Plane 526 contacts the upper surface 565. When the jointed member 510 carries a structural load 566 the upper surface 565 of the abutment members 560 and 564 continue to contact the plane 526.

Figure 5B:
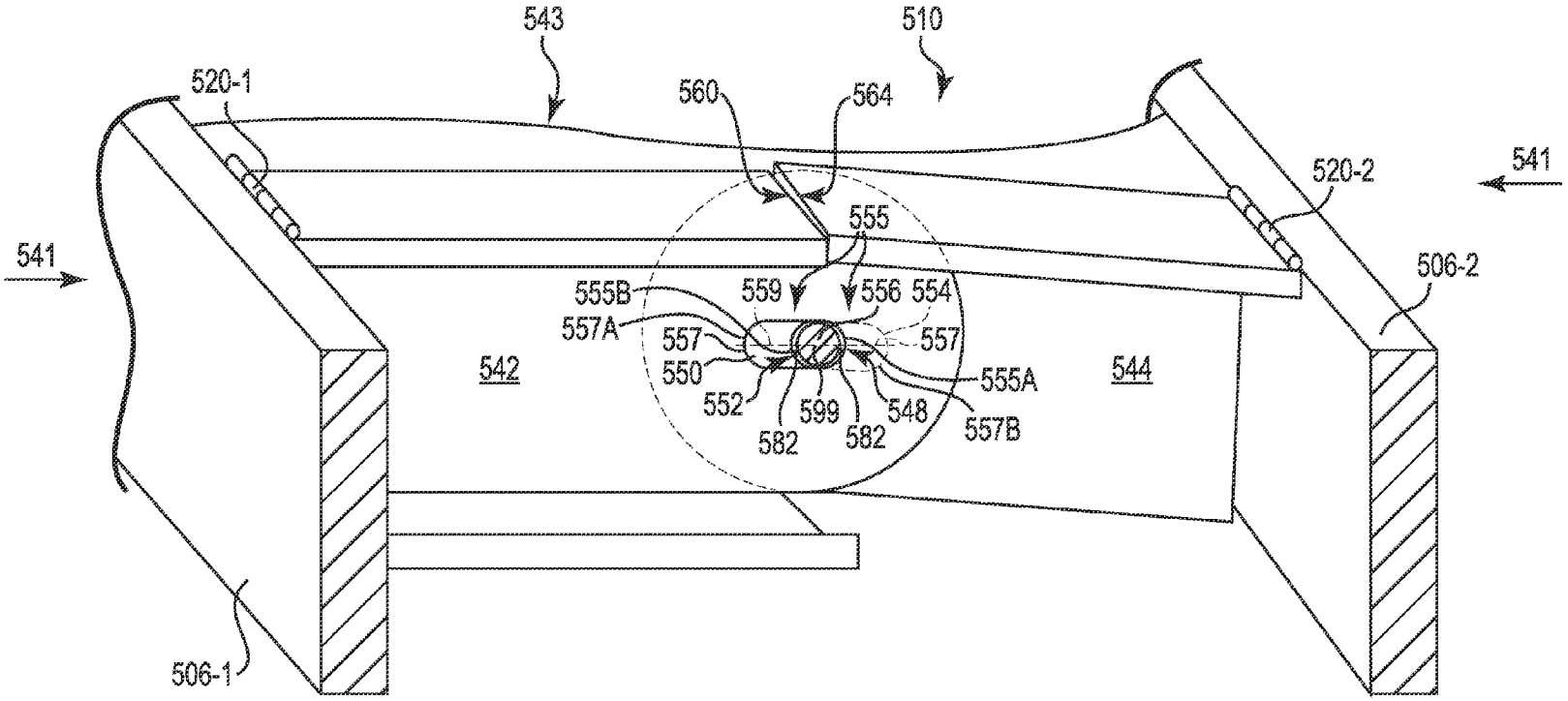

As the jointed member 510 begins to fold different portions of the jointed member 510 move so as to rotate around predefined points of rotation (e.g., a first axis of rotation), to slide relative one or more of the other parts of the jointed member 510 and/or to shift relative positions at different stages of the folding process. Referring now to FIG. 5B, the jointed member 510 is shown beginning to fold from its first predetermined state, as seen in FIG. 5A, towards the second predetermined state, as seen in FIG. 6. As illustrated in FIG. 5B, the first abutment member 560 and the second abutment member 564 define a first point of rotation around a first axis of rotation for the first elongate section 542 and the second elongate section 544. In other words, the first point of rotation around which the first elongate section 542 and the second elongate section 544 rotate is defined at the point of contact between the first abutment member 560 and the second abutment member 564. Rotation about this first point of rotation may be caused, at least in part, to a force applied to the joined member in the direction 541.

As the first elongate section 542 and the second elongate section 544 rotate around the first point of rotation defined by the first abutment member 560 and the second abutment member 564 the surfaces 548 and 552 defining the first oblong opening 550 and the second oblong opening 554 move relative each other. The fastener 556 can also move (e.g., laterally) within the first oblong opening 550 and/or the second oblong opening 554 as the jointed member 510 transitions from the first predetermined state towards the second predetermined state. In transitioning towards the second predetermined state the fastener 556 is mobile within the first oblong opening 550 and/or the second oblong opening 554. As discussed herein, the axial center 599 of the fastener 556 moves along (e.g., essentially parallel with) the longitudinal axis 559 of the first oblong opening 550 and the second oblong opening 554 as the jointed member 510 transitions from a first predetermined state to a second predetermined state. The cross-sectional shape of the fastener 556 is of a size and a shape that allows the fastener 556 to travel along the longitudinal axis 559 of the first oblong opening 550 and the second oblong opening 554 as the jointed member 510 transitions from a first predetermined state to a second predetermined state without any significant amount of travel along the minor axis 570 of the first oblong opening 550 and the second oblong opening 554. So, for example, the distance between the parallel lines tangent to the end points of the two semicircles of the first and second obround openings 550 and 554 is approximately the diameter of the portion of the fastener 556, illustrated herein, that passes through the first and second obround openings 550 and 554.

As illustrated in FIG. 5B, the fastener 556 has moved laterally (e.g. in a direction coincident with the longitudinal axis 559) within the first oblong opening 550. Likewise, the fastener 556 may move laterally within the second oblong opening 554 (e.g. in a direction coincident with the longitudinal axis 559).

FIG. 5B shows how a gap 582 develops between the fastener 556 and the first end 555 of the surfaces defining the first oblong opening 550 (555-A) and the second oblong opening 554 (555-B). The jointed member 510 can rotate around a point of contact (e.g., a predetermined point of contact) between the first abutment member 560 and the second abutment member 564 until the second ends 557 of the first oblong opening 550 (557-A) and the second oblong opening 554 (557-B) contact the fastener 556, for example. As such, the axis of rotation changes as the jointed member 510 transitions from the first predetermined state to the second predetermined state. For example, the axis of rotation changes as the jointed member 510 transitions from its first predetermined state until the second ends 557 of the first oblong opening 550 (557-A) and the second oblong opening 554 (557-B) contact the fastener 556.

Figure 5C:
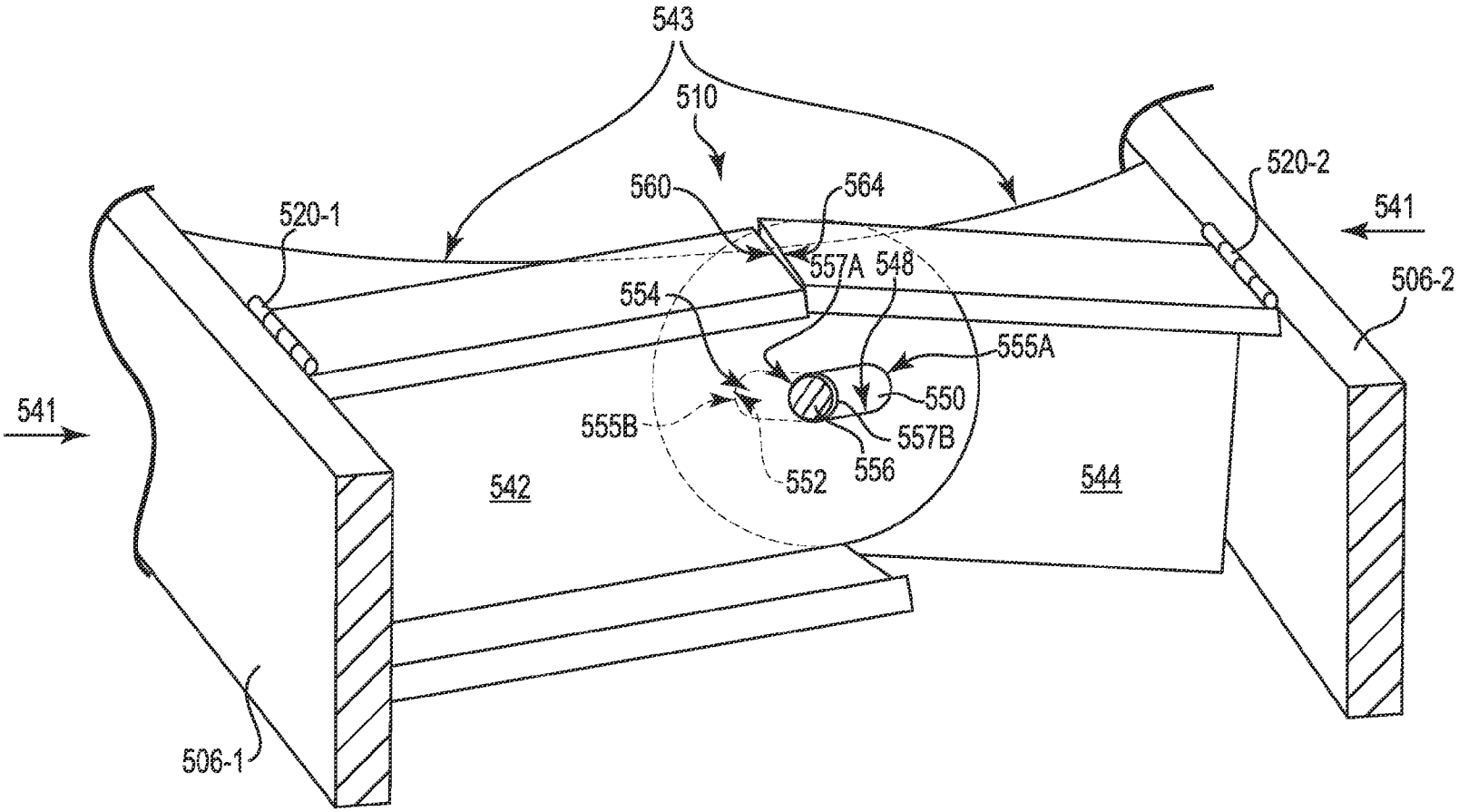

This embodiment, where the second ends 557 of the first oblong opening 550 (557-A) and the second oblong opening 554 (557-B) contact the fastener 556, is illustrated in FIG. 5C. FIG. 5C also illustrates that the point of rotation now shifts from the first point of rotation, defined by the first abutment member 560 and the second abutment member 564, to a second point of rotation on a second axis of rotation that is formed by the second end 557 of both the first surface 548 of the first oblong opening 550 (557-A) and the second surface 552 of the second oblong opening 554 (557-B) when positioned against the fastener 556. This second point of rotation around a second axis of rotation for the first abutment member 560 and the second abutment member 564 is different than the first point of rotation discussed herein. As before, the rotation about this second point of rotation may be caused, at least in part, to a force applied to the joined member in the direction 541.

As illustrated in FIGS. 5A-5C, the first elongate section 542 and the second elongate section 544 rotate around (e.g., turn on) the first point of rotation prior to rotating around (e.g., turning on) the second point of rotation as the jointed member 510 transitions from the first predetermined state towards the second predetermined state. Also, as illustrated in FIG. 5C the first end 555 of each of the first surface 548 (555-A) and the second surface 552 (555-B) does not contact the fastener 556 when the second end 557 of both the first surface 548 (557-A) and the second surface 552 (557-B) are seated against the fastener 556.

In shifting from the first point of rotation to the second point of rotation the length of the hypotenuse of the jointed member 510 changes from an initial value when the jointed member 510 is in the first predetermined state (as discussed herein) to a shorter value, relative the initial value, such as when the point of rotation shifts to the point of contact between the second end 557 of the first oblong opening 550 (557-A) and the second oblong opening 554 (557-B) and the fastener 556.

Figure 5D:
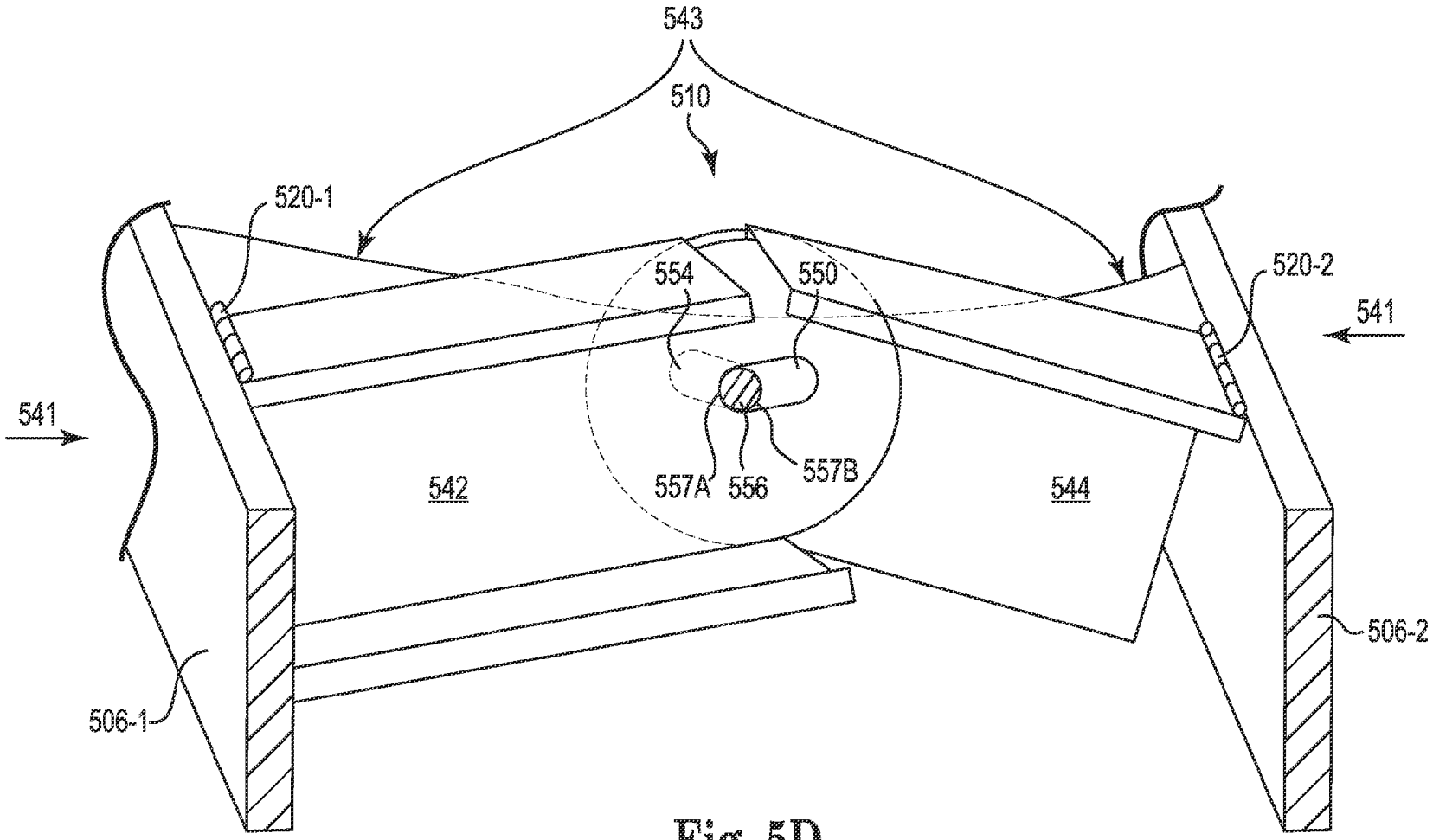
Figure 5E:
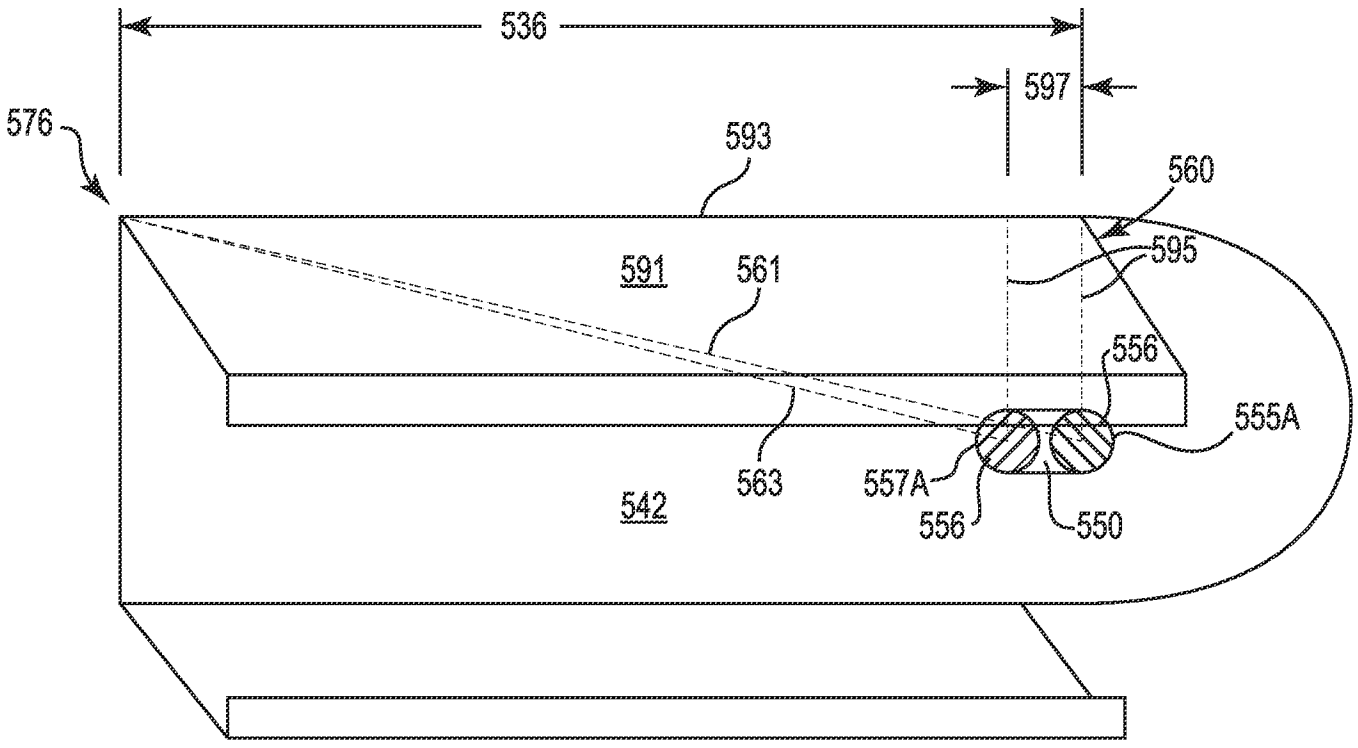
Figure 5F:
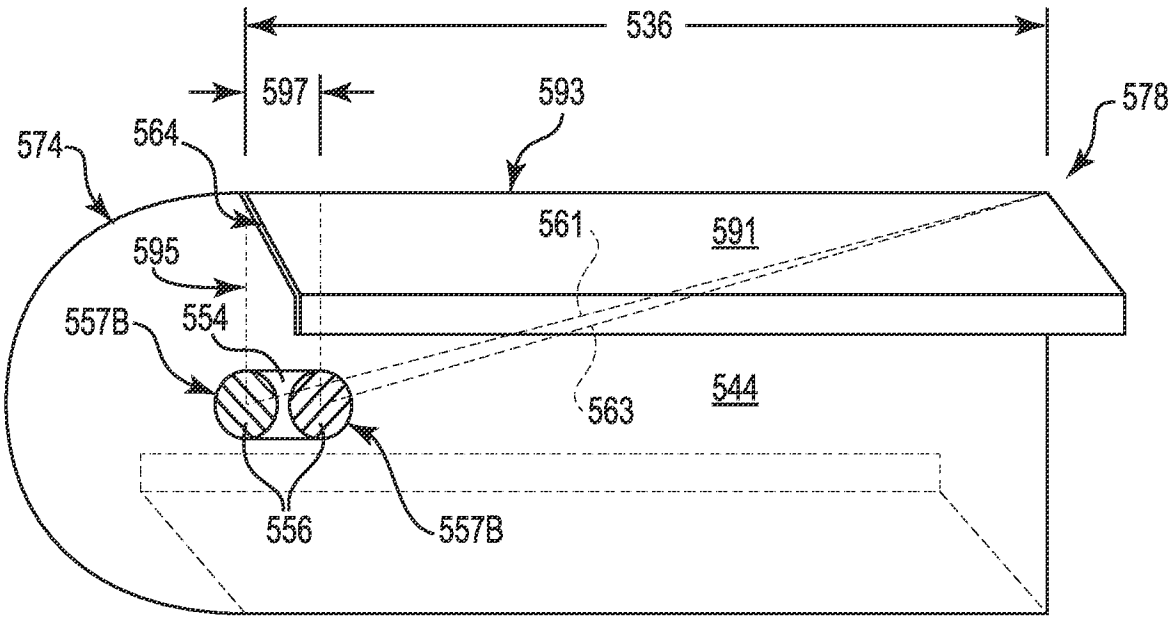

FIGS. 5E and 5F can be used to illustrate this change in the length of the hypotenuse of the jointed member 510. The broken lines 561 and 563 in FIGS. 5E and 5F show the hypotenuse of jointed member 510 when the jointed member is at either the first point of rotation or the second point of rotation. In FIG. 5E, there is shown the first elongate section 542, where in the first predetermined state the fastener 556, the first abutment member 560 and the first member end 576, all in a common plane, define a right triangle 591 of the first elongate section 542, where a hypotenuse of the right triangle 591 is between the fastener 556 and the first member end 576 and a first leg 536 of the right triangle 591 is defined by the first member end 576 and the perpendicular intersection of a first line 593 extending from the first member end 576 and a second line 595 extending from the geometric center of the fastener 556, where the first and second lines 593 and 595 are in the common plane.

As illustrated in FIG. 5E, when in the first predetermined state broken line 561 shows the hypotenuse of jointed member 510. When the point of rotation shifts to the second point of rotation the broken line 563 shows the now shortened hypotenuse, relative the hypotenuse in the first predetermined state. In addition to being shorter than broken line 561, the hypotenuse shown by broken line 563 can be equal to or shorter than the first leg 536 of the right triangle 591 of the first elongate section 542 when the jointed member is in the first predetermined state. In this way, the jointed member 510 having the now shortened hypotenuse can pass through, for example, the defined maximum length 519, as discussed herein.

Similarly, in FIG. 5F there is shown the second elongate section 544, where in the first predetermined state the fastener 556, the second abutment member 564 and the second member end 578, all in a common plane, define a right triangle 591 of the second elongate section 544, where a hypotenuse of the right triangle 591 is between the fastener 556 and the second member end 578 and a first leg 536 of the right triangle 591 is defined by the second member end 578 and the perpendicular intersection of a first line 593 extending from the second member end 578 and a second line 595 extending from the geometric center of the fastener 556, where the first and second lines 593 and 595 are in the common plane.

As illustrated in FIGS. 5E and 5F, in the first predetermined state the hypotenuse has a length that is greater than a length of the first leg 536. However, as the first abutment member 560 and the second abutment member 564 rotate about the second point of rotation the length of the hypotenuse changes as the geometric center of the fastener 556 moves along a length 597 between the first and second ends of the oblong openings 550 and 554. This allows the hypotenuse (as shown by broken line 563) to be no greater than the length of the first leg 536 of the right triangle 591 of the first elongate section 542. As such, as the first abutment member 560 and the second abutment member 564 rotate about the second point of rotation the length between the fastener 556 and the first member end 576, both in the common plane, is no greater than the length of the first leg 536 of the right triangle 591 of the first elongate section 542. Similarly, as the first abutment member 560 and the second abutment member 564 rotate about the second point of rotation the length between the fastener 556 and the second member end 578, both in the common plane, is no greater than the length of the first leg 536 of the right triangle 591 of the second elongate section 544.

As discussed herein, the defined maximum length 519 in the first predetermined state can be twice the length of the first leg 536 of the right triangle 591 of the first elongate section 542 or the second elongate section 544. As the jointed member 510 begins to fold the first point of rotation near or at a the point where the first abutment member 560 and the second abutment member 564 are in contact. As the jointed member 510 continues to fold the point of rotation shifts to the second point of rotation, when the second end 557 of the first oblong opening 550 and the second oblong opening 554 contact the fastener 556, for example. At this point, the hypotenuse of each of the elongate members of the jointed member has been effectively changed to a length equal to or less than that of the first leg 536. The first elongate section 542 and the second elongate section 544 of the jointed member 510 can then continue to fold towards the second predetermined state without extending beyond the defined maximum length 519 defined in the first predetermined state. For un-folding of the jointed member 510 a force opposite the force 541, for example, may be applied to the folded jointed member to cause the jointed member 510 to return to its first predetermined state as seen in FIG. 5A. In returning to its first predetermined state the defined maximum length 519 is not exceeded.

Referring now to FIG. 6, there is shown an embodiment of the jointed member 610 in the second predetermined state in which the first oblong opening and the second oblong opening can have their maximum overlap relative the first predetermined state. FIG. 6 illustrates the second predetermined state having a maximum overlap of the first oblong opening 650 and the second oblong opening 654 relative the minimum overlap, as discussed herein. In the embodiment illustrated in FIG. 6 the fastener 656 is free to move along the longitudinal axes 659 of the first oblong opening and the second oblong when the first oblong opening and the second oblong opening are in the second predetermined state.

In the second predetermined state, FIG. 6 shows the first oblong opening 650 completely overlapping the second oblong opening 654. While FIG. 6 illustrates a complete overlap of the first oblong opening 650 and the second oblong opening 654 it is intended that the overlap may be substantially complete, e.g. due to machine tolerances and so forth. This relationship between the first oblong opening 650 and second oblong opening 654 may be considered the maximum overlap of the first oblong opening and the second oblong opening relative the minimum overlap, as discussed herein. In other words a value of an area of the maximum overlap cannot be further increased by repositioning either the first elongate section or the second elongate section.

In the perspective view provided by FIG. 6 the second elongate section 644 is hidden from view by the first elongate section 642. In this second predetermined state the first elongate section 642 including the first oblong opening 650 is aligned with the second elongate section 644 including the second oblong opening 654. In other words, the first elongate section 642 is opposed the second elongate section 644. Herein the first elongate section 642 is opposed the second elongate section 644 when the longitudinal axis of the first elongate section 642 and the longitudinal axis of the second elongate section 644 are substantially parallel and the jointed member 610 is not in the first predetermined state. When the first elongate section 642 opposes the second elongate section 644, the longitudinal axes of the first elongate section 642 and the second elongate section 644 are in a position that is substantially perpendicular relative to the longitudinal axes of the first elongate section 642 and the second elongate second 644 in the first predetermined state. When the first elongate section 642 opposes the second elongate section 644, the jointed member 610 is considered to be in a folded state.

It is appreciated, however, that the jointed member as discussed herein can be placed into one or more intermediate positions between the first predetermined position (as seen in FIGS. 4 and 5A) and the second predetermined position (as seen in FIG. 6). For example, FIGS. 5B-5D illustrate intermediate positions between the first predetermined position and the second predetermined position.

Figure 7:
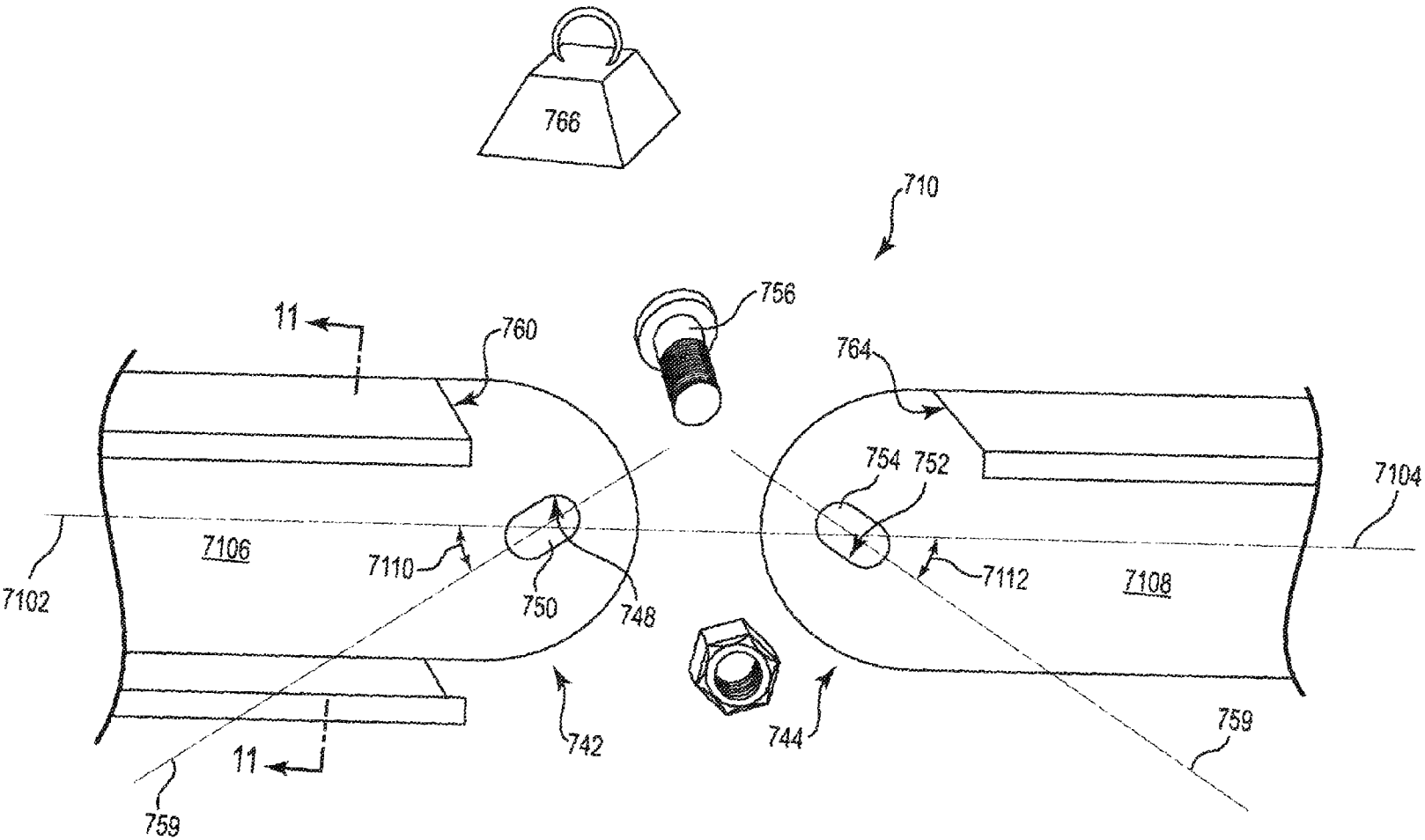
FIG. 7 illustrates an exploded view of a jointed member according to the present disclosure.

FIG. 7 illustrates an exploded view of an embodiment of the first elongate section 742 and the second elongate section 744 and the fastener 756 of the jointed member 710 of the present disclosure. The first elongate section 742 includes a longitudinal axis 7102 and the second elongate section 744 includes a longitudinal axis 7104. In the first predetermined state the longitudinal axis 7102 of the first elongate section 742 is substantially coplanar with the longitudinal axis 7104 of the second elongate section 744. For example, the longitudinal axis 7102 may bisect the first elongate section 742 and the longitudinal axis 7104 may bisect the second elongate section 744. In the first predetermined state the longitudinal axis 7102 and the longitudinal axis 7104 are substantially parallel, e.g. both of the axes lie in a plane that is perpendicular to a first major surface 7106 of the first elongate section 742 and a first major surface 7108 of the second elongate section 744.

A first angle 7110 formed from the longitudinal axis 759 of the first oblong opening 750 and the longitudinal axis 7102 of the first elongate section 742 has a value from 0 degrees to 45 degrees. For example the first angle 7110 may have a value of 0 degrees, 15 degrees, 20 degrees, 25 degrees 30 degrees, 35 degrees or 45 degrees. Similarly, a second angle 7112 formed from the longitudinal axis 759 of the second oblong opening 754 and the longitudinal axis 7104 of the second elongate section 744 has a value from 0 degrees to 45 degrees. For example the second angle 7112 may have a value of 0 degrees, 15 degrees, 20 degrees, 25 degrees 30 degrees, 35 degrees or 45 degrees.

In the present embodiment, the first surface 748 defines the first oblong opening 750 through the first elongate section 742, and the second surface 752 defines the second oblong opening 754 through the second elongate section 744. In the first predetermined state, or the unfolded state, a structural load 766 applied to the joined member 710 causes the first abutment member 760 and the second abutment member 764 to come under compression (e.g., each abutment member 760 and 764 applies a compressive force to the other). As the same time a portion of the surface 748 of the first oblong opening 750 and a portion of the surface 752 of the second oblong opening 754 apply a shearing stress to the portion of the fastener 756 that passes through the openings 750 and 754. As a result, the structural load 766 is held in the first predetermined state on the jointed member 710, which has the compressive forces of the first abutment member 760 and the second abutment member 764 help to offset the shear stress applied to the portion of the fastener 756 that passes through the openings 750 and 754. As illustrated in FIG. 7 the first oblong opening 750 and the second oblong opening 754 have an obround shape.

Figure 8A:
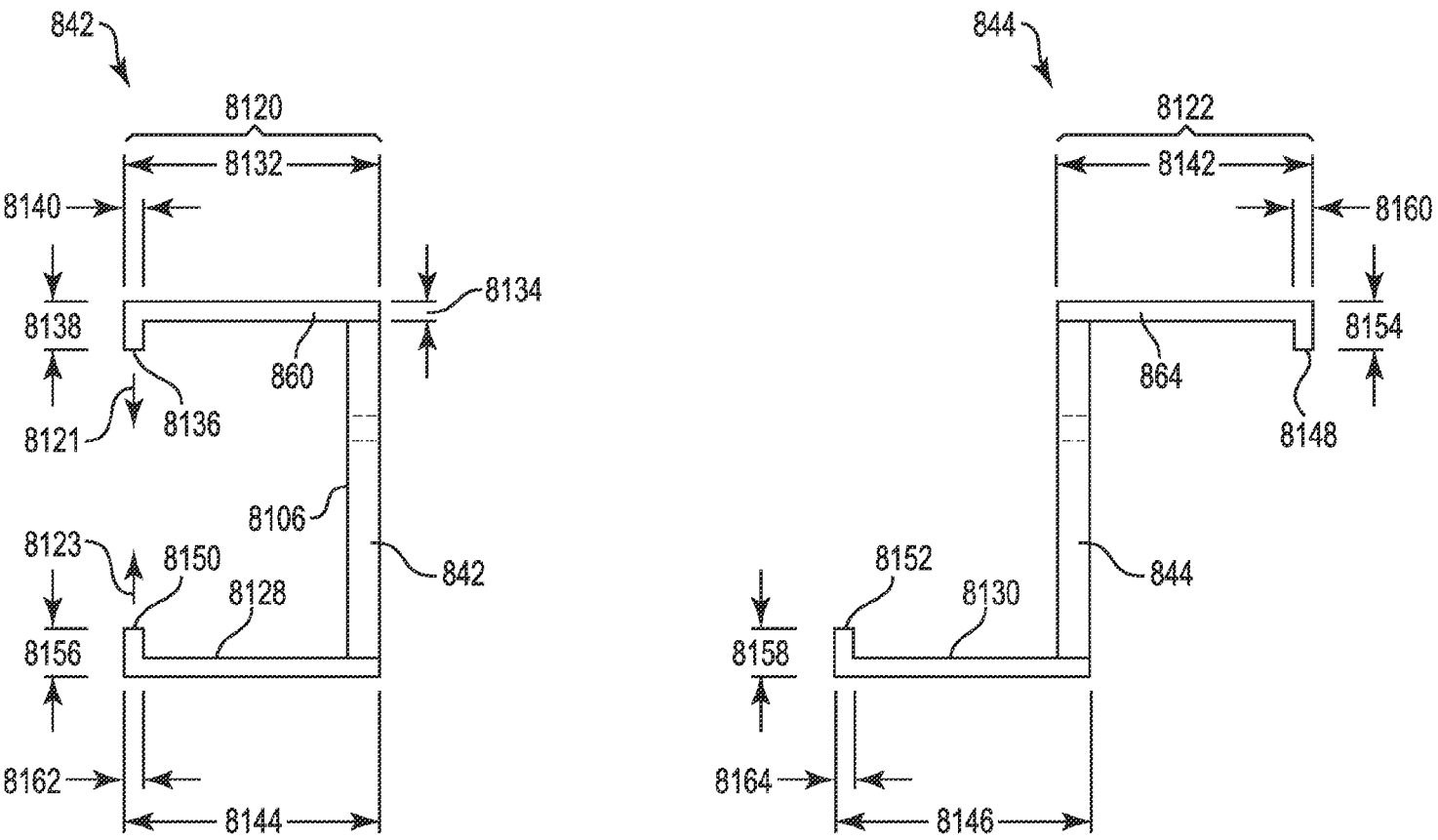
FIGS. 8A-8C illustrate a portion of the jointed member according to the present disclosure.

FIG. 8A illustrates the first elongate section 842 taken along cut line A-A, as illustrated in FIG. 3, and the second elongate section 844 taken along cut line B-B, as illustrated in FIG. 3. The first elongate section 842 has a width 8120 and the second elongate section 844 has a width 8122. For differing applications, the width 8120 and the width 8122 may have various values. The first elongate section 842 includes a first abutment member 860 and the second elongate section 844 includes a second abutment member 864. The first elongate section 842 includes a third abutment member 8128. The second elongate section 844 includes an adjunct member 8130. The first abutment member 860, the second abutment member 864, the third abutment member 8128 and/or the adjunct member 8130 may be referred to as a flange or a return.

For differing applications, the first abutment member 860 may have a width 8132 of various values. For example, when the jointed member is employed for the reversibly foldable freight container, the width 8132 may have a value in a range from 1.0 centimeter to 25.0 centimeters. For differing applications, the first abutment member 860 may have a height 8134 of various values. For example, when the jointed member is employed for the reversibly foldable freight container the height 8134 may have a value in a range from 0.1 centimeters to 5.0 centimeters. As appreciated values for the width 8132 and the height 8134 can be dependent upon the application in which the jointed member is to be used.

The first abutment member 860 may include a reinforcement section 8136. The reinforcement section 8136 may have a width 8138 of differing values. For example, the width 8138 may have a value in a range from 0.5 centimeters to 10.0 centimeters. The reinforcement section 8136 may have a height 8140 of differing values. For example, the height 8140 may have a value in a range from 0.1 centimeters to 5.0 centimeters. As appreciated values for the width 8138 and the height 8140 can be dependent upon the application in which the jointed member is to be used.

Similar to the first abutment member, the second abutment member 864, the third abutment member 8128, and the adjunct member 8130 may have a width 8142, 8144, and 8146 respectively. Each of the widths 8142, 8144, and 8146 may have a value in a range from 1.0 centimeter to 25.0 centimeters. As appreciated values for the widths 8142, 8144, 8146 can be dependent upon the application in which the jointed member is to be used.

Additionally similar to the first abutment member, the second abutment member 864, the third abutment member 8128, and the adjunct member 8130 may each have a reinforcement section 8148, 8150, and 8152 respectively. Each of the reinforcement sections 8148, 8150, and 8152 may have a width 8154, 8156, and 8158 respectively having a value in a range from 0.5 centimeters to 10.0 centimeters. Each of the reinforcement sections 8148, 8150, and 8152 may have a height 8160, 8162, and 8164 respectively having a value in a range from 0.1 centimeters to 5.0 centimeters. The reinforcement sections may help provide strength, e.g. resistance to movement in a non-movable direction.

As illustrated in FIG. 8A, the reinforcement section 8136 and the reinforcement section 8150 extend towards one another. For example, a first line that is perpendicular to and passes through the first major face 8106 may intersect the reinforcement section 8136 while a second line that is perpendicular to and passes through the first major face 8106 may intersect the reinforcement section 8150. When the reinforcement section 8136 and the reinforcement section 8150 extend towards one another these reinforcement sections extend in opposite directions. As illustrated in FIG. 8A, the reinforcement section 8136 extends in a first direction 8121 and the reinforcement section 8150 extends in a second direction 8123 that is opposite of the first direction 8121.

Figure 8B:
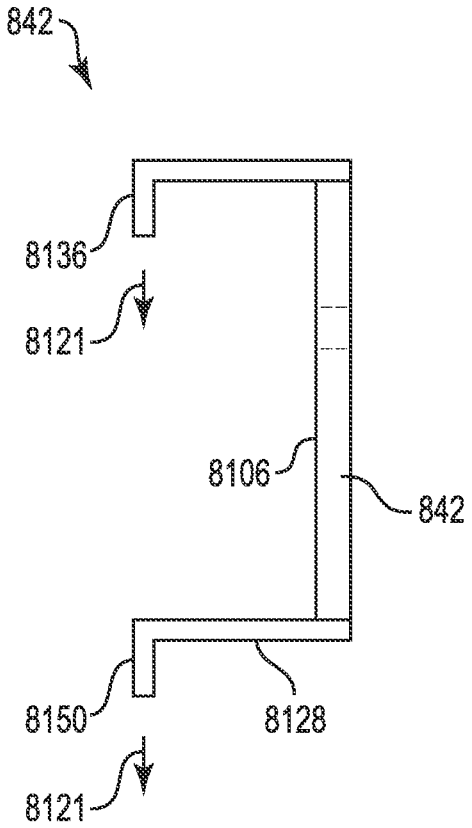

FIG. 8B illustrates an alternative embodiment of the first elongate section 842. As illustrated, the reinforcement section 8136 extends towards the reinforcement section 8150 while the reinforcement section 8150 extends away from the reinforcement section 8136. For example, a first line that is perpendicular to and passes through the first major face 8106 may intersect the reinforcement section 8136 while a second line that is perpendicular to and passes through the first major face 8106 cannot intersect the reinforcement section 8150. As illustrated in FIG. 8B, the reinforcement section 8136 extends in the first direction 8121 and the reinforcement section 8150 extends in the first direction 8121.

Figure 8C:
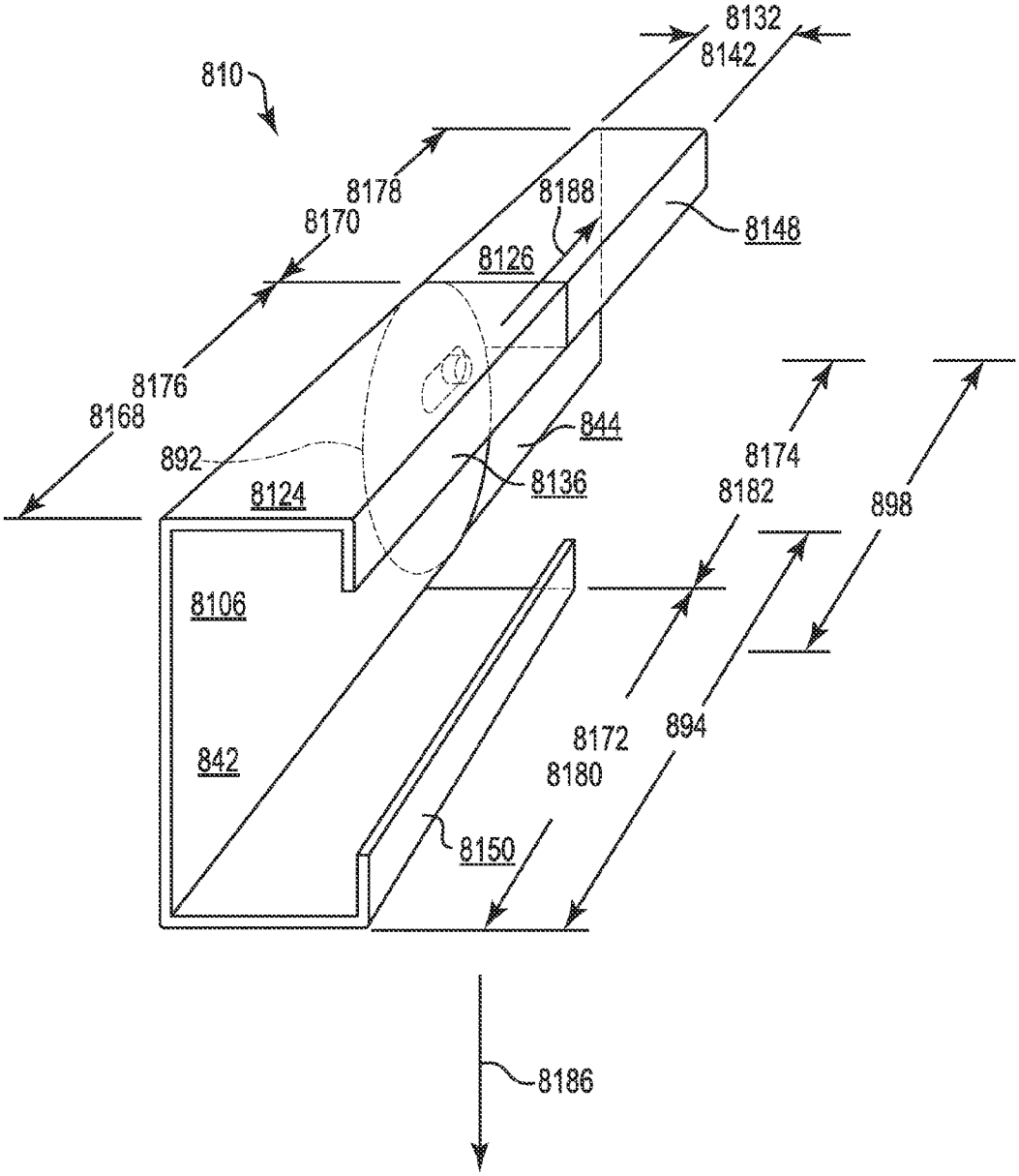

FIG. 8C illustrates the jointed member 810 in the first predetermined state. The first abutment member 860, the second abutment member 864, the third abutment member 8128, and the adjunct member, which are hidden from view in FIG. 8C, may each have a length 8168, 8170, 8172, respectively. For differing applications, the first abutment member, the second abutment member, the third abutment member, and the adjunct member may have various values of length. For one or more embodiments, the first abutment member, the second abutment member, the third abutment member, and the adjunct member each respectively have a length in a range from a value greater than zero (0) meters (e.g., 0.25 meters) to 1.5 meters. As appreciated values for the length of the first abutment member, the second abutment member, the third abutment member, and the adjunct member can be dependent upon the application in which the jointed member is to be used.

The reinforcement sections 8136, 8148, 8150 and 8152, which are hidden from view in FIG. 8C, may each have a length 8176, 8178, 8180, and 8182 respectively. For differing applications, reinforcement sections may have various values. For one or more embodiments, the lengths 8176, 8178, 8180, and 8182 each respectively have a value greater than zero (0) meters (e.g., 0.25 meters) to 1.5 meters. As appreciated values for the length of the first abutment member, the second abutment member, the third abutment member, and the adjunct member can be dependent upon the application in which the jointed member is to be used.

One or more of the lengths 8168, 8172 and one or more of the lengths 8176, 8180, may have a value that is less than a length 894 of the first elongate section 842. For one or more embodiments, one or more of the lengths 8170, 8174 and one or more of the lengths 8178, 8182, may have a value that is less than a length 898 of the second elongate section 844. As illustrated in FIG. 8C, when the jointed member 810 is in the first predetermined state the first abutment member 860 and the second abutment member 864 extend in a first direction, e.g. direction 8188. Additionally, the third abutment member 8128 may extend in the first direction 8188.

As illustrated in FIG. 8C, when the jointed member 810 is in the first predetermined state the first abutment member 860 abuts the second abutment member 864. The contact between the first abutment member 860 and the second abutment member 864 helps to prevent the jointed member 810 from moving from the first predetermined state toward a direction 8186, e.g. the non-moveable direction.

Figure 9A:
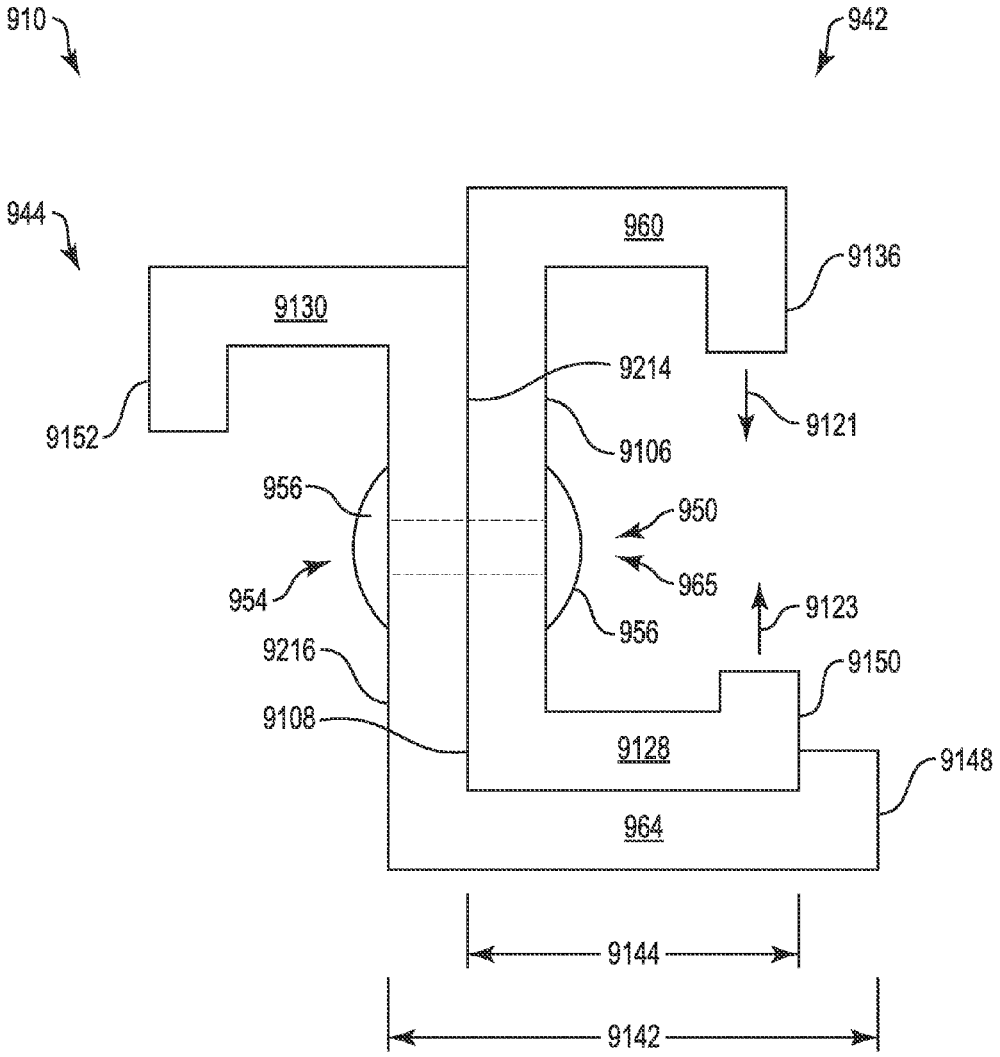
FIGS. 9A-9B illustrate a portion of the jointed member according to the present disclosure.

Referring now to FIG. 9A, there is illustrated a cross sectional view of the jointed member 910 in its second predetermined state. In FIG. 9A, first elongate section 942 opposes the second elongate section 944 and the jointed member 910 is considered to be in the second predetermined state.

As illustrated in FIG. 9A, when the jointed member 910 is in the second predetermined state the third abutment member 9128 abuts the second abutment member 964. The contact between the third abutment member 9128 and the second abutment member 964 may help to maintain the jointed member 910 in the second predetermined state. Because the third abutment member 9128 abuts the second abutment member 964 in the second predetermined state, the second predetermined state may be considered in a stopped state. For the embodiment of FIG. 9A, the reinforcement section 9136 extends in the first direction 9121 and the reinforcement section 9150 extends in the second direction 9123 that is opposite of the first direction 9121.

For one or more embodiments, the width 9142 of the second abutment member 964 may have a value greater than the width 9144 of the third abutment member 9128. This greater width may help provide that in the second predetermined state the first elongate section 942 fits within (e.g. is nested into) a portion of the second elongate section 944.

As discussed herein the first oblong opening 950 and the second oblong opening 954 overlap to receive the fastener 956. Fastener 956 may pass through the first oblong opening 950 and the second opening 954 to connect the first elongate section 942 and the second elongate section 944. The fastener may have various cross sectional geometries including, but not limited to, a round cross sectional geometry, an oval cross sectional geometry, and a square cross sectional geometry. The fastener may be selected to best fit the first oblong opening and/or the second oblong opening. The first oblong opening 950 and the second opening 954 may be obround in shape.

For one or more embodiments, the fastener 956 may be integral with the first elongate section 942. For such embodiments, the first elongate section 942 does not include the first oblong opening. For these embodiments the fastener moves relative the second oblong opening 954 as the jointed member 910 transitions from the first predetermined state to the second predetermined state. For these embodiments the fastener 956 moves laterally within the second oblong opening 954.

For one or more embodiments, the fastener 956 may be integral with the second elongate section 944. For such embodiments, the second elongate section does not include the first oblong opening. For these embodiments the fastener moves relative the first oblong opening 950 as the jointed member 910 transitions from the first predetermined state to the second predetermined state. For these embodiments the fastener 956 moves laterally within the first oblong opening 950.

Figure 9B:
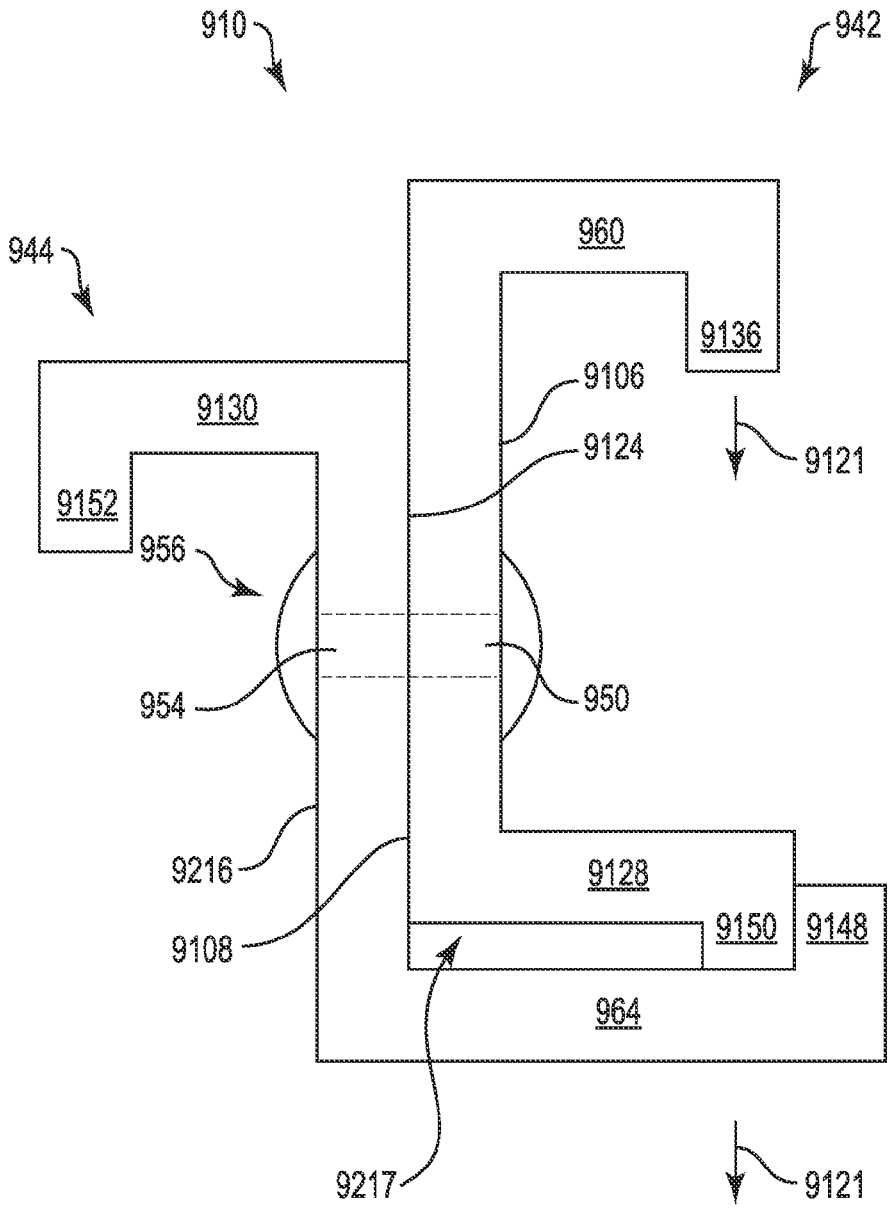

FIG. 9B illustrates a portion of the jointed member 910 according to one or more embodiments of the present disclosure. FIG. 9B illustrates the jointed member 910 taken from the same perspective as FIG. 9A. However, for the embodiment of FIG. 9B the reinforcement section 9136 extends in the first direction 9121 and the reinforcement section 9150 also extends in the first direction 9121. In FIG. 9B, first elongate section 942 opposes the second elongate section 944 and the jointed member 910 is considered to be in the second predetermined state.

For the one or more embodiments, a surface of the second abutment member 964, a surface of the third abutment member 9128, a surface of the reinforcement section 9150, and the first major surface 9108 define an opening 9217. The opening 9217 may help provide a space for a component (e.g. screws) that protrudes from the second elongate section 944 into the opening 9217.

As discussed the jointed member may employed for a reversibly foldable freight container, as is discussed herein. The jointed member, as disclosed herein, may however be employed for various applications that include a transition from an unfolded state to a folded state without expanding beyond the defined maximum length of the jointed member in the unfolded state, while neither bowing or damaging the jointed member, a pivotal connection (e.g., a hinge) or a structure, (as discussed herein), of the container.

Embodiments of the present disclosure provide reversibly foldable structures. The reversibly foldable structures, as discussed herein, include the jointed member as disclosed herein. As such, these reversibly foldable structures may transition from an unfolded state to a second predetermined state without expanding the reversibly foldable structure beyond the defined maximum length of the jointed member in the unfolded state. As discussed, the jointed member includes the first elongate section having the surface defining the first oblong opening, the second elongate section having the surface defining the second oblong opening, and the fastener passing through the first oblong opening and the second opening to connect the first elongate section and the second elongate section, where the first oblong opening and the second oblong opening move relative each other and the fastener as the jointed member transitions from the first predetermined state having the minimum overlap of the first oblong opening and the second oblong opening towards the second predetermined state.

Figure 10:
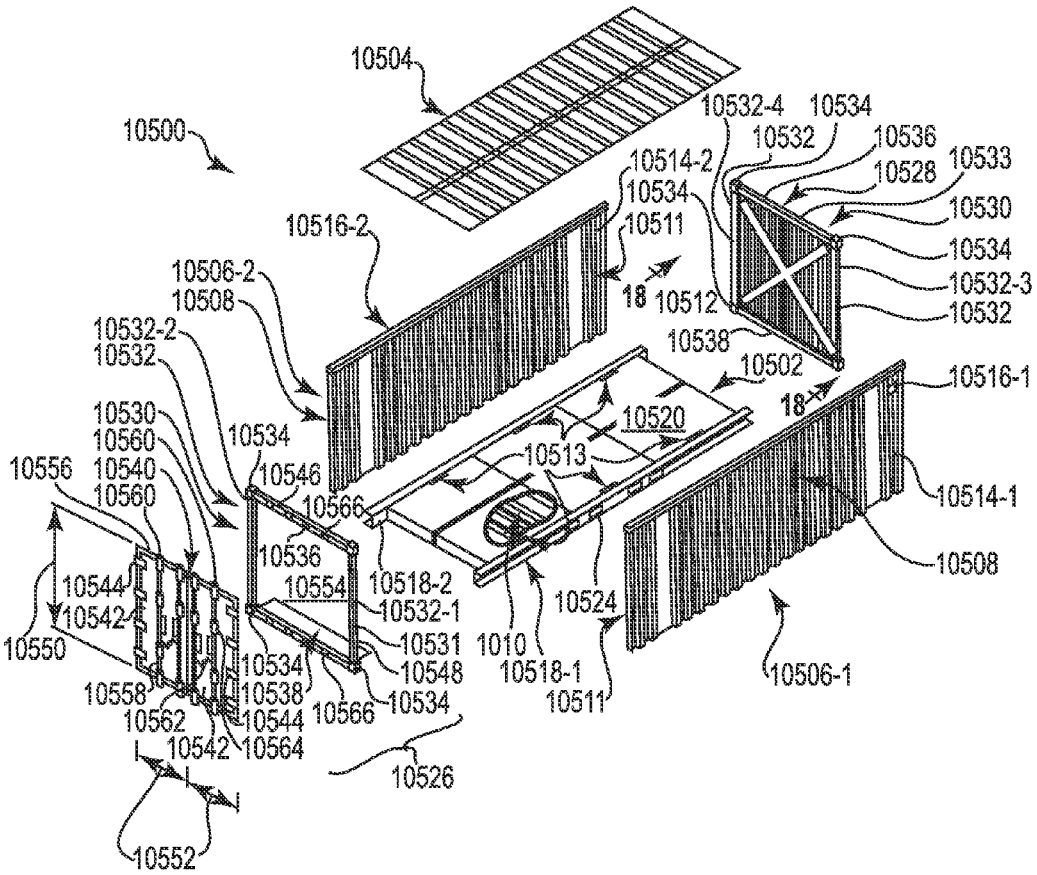
FIG. 10 provides an exploded view of a freight container according to the present disclosure.

FIG. 10 illustrates an exploded view of a reversibly foldable freight container 10500 according to one or more embodiments of the present disclosure. The reversibly foldable freight container 10500 includes a floor structure 10502, a roof structure 10504 opposite the floor structure 10502, a first sidewall structure 10506-1 and a second sidewall structure 10506-2, where both the first sidewall structure 10506-1 and the second sidewall structure 10506-2 join the floor structure 10502 and the roof structure 10504. Each of the sidewall structures 10506-1 and 10506-2 has an exterior surface 10508 and an interior surface 10511, where the interior surface 10511 of the sidewall structures 10506-1 and 10506-2, the floor structure 10502 and the roof structure 10504 at least partially defines a volume 10512 of the reversibly foldable freight container 10500.

The first sidewall structure 10506-1 includes a first sidewall panel 10514-1 that is joined to a first upper side rail 10516-1 and a first bottom side rail 10518-1. The second sidewall structure 10506-2 includes a second sidewall panel 10514-2 that is joined to a second upper side rail 10516-2 and a second bottom side rail 10518-2. The floor structure 10502 includes flooring 10520 that is attached to jointed members 1010 according to the present disclosure, where a portion of the flooring 10520 has been removed to show the jointed members 1010. One or more of a hinge 10513 joins the first member end of each of the plurality of jointed members 1010 to the first bottom side rail 10518-1 and the second member end of each of the plurality of jointed members 1010 to the second bottom side rail 10518-2. The bottom side rail 10518 can further include forklift pockets 10524.

The reversibly foldable freight container 10500 further includes a rear wall 10526 and a front wall 10528. Each of the rear wall 10526 and the front wall 10528 include an end frame 10530 joined with the roof structure 10504, the floor structure 10502 and the sidewall structures 10506-1 and 10506-2. The end frame 10530 includes corner posts 10532, corner fittings 10534, a header 10536 and a sill 10538. The end frame 10530 for the rear wall 10526 is referred to herein as the rear wall end frame 10531 and the end frame 10530 for the front wall 10528 is referred to herein as the front wall end frame 10533. The corner posts 10532 for the rear wall 10526 are referred to herein as the rear wall corner posts 10532-1 and 10532-2 and for the front wall 10528 are referred to herein as the front wall corner posts 10532-3 and 10532-4.

The rear wall 10526 includes a door assembly 10540. The door assembly 10540 can include a door 10542 attached to the rear wall end frame 10531 of the rear wall 10526 with hinges 10544, as will be discussed more fully herein. The door assembly 10540 and the hinge 10544 provided herein are also discussed in a co-pending application entitled "Door Assembly for Freight Container" U.S. application Ser. No. 14/238,881, which is incorporated herein by reference in its entirety.

The rear wall end frame 10531 includes the header 10536, which is also referred to as a rear wall header member 10546 for the door assembly 10540, and the sill 10538, which is also referred to as a rear wall sill member 10548 for the door assembly 10540. The rear wall corner posts 10532-1 and 10532-2 extend between and couple the rear wall sill member 10548 and the rear wall header member 10546.

FIG. 10 provides an embodiment of the door assembly 10540 that includes two of the doors 10542, where one of each door 10542 is attached by the hinges 10544 to one of each of the rear wall corner posts 10532-1 and 10532-2. Each door 10542 has a height 10550 and a width 10552 that allows the door 10542 to fit within an area 10554 defined by the rear wall end frame 10531. The door 10542 can further include a gasket 10556 around a perimeter of the door 10542 to help provide weatherproofing on the exterior portion of the rear wall 10526.

The door 10542 further includes a locking rod 10558 having a cam 10560 and a handle 10562. The locking rod 10558 can be mounted to the door 10542 with a bearing bracket assembly 10564, where the locking rod 10558 turns within and is guided by the bearing bracket assembly 10564 to engage and disengage the cam 10560 and a cam keeper 10566. The cam keeper 10566 is mounted on the rear wall end frame 10531. In one embodiment, the cam keeper 10566 is mounted on the rear wall header member 10546 and the rear wall sill member 10548 of the rear wall end frame 10531 of the rear wall 10526.

The locking rod 10558 mounted to the door 10542 can move between a first predetermined position where the cam 10560 is aligned with and can engage the cam keeper 10566, as discussed above, and a second predetermined position. In the second predetermined position the cam 10560 is disengaged from the cam keeper 10566 and has a position relative the rear wall end frame 10531 that allows the cam 10560 and the door 10542 to travel through the area 10554, past the rear wall end frame 10531 and the cam keeper 10566 of the rear wall 10526, and into the volume 10512 of the reversibly foldable freight container 10500. In other words, in the second predetermined position portions of the locking rod 10558 have been moved, as described herein, so as to position the cam 10560 directly adjacent the surface of the door 10542 so that the door 10542 can be opened into the volume 10512 of the reversibly foldable freight container 10500. As discussed herein, opening the door 10542 into the volume 10512 of the reversibly foldable freight container 10500 is accomplished, in addition to having the locking rod 10558 in the second predetermined position, with the use of the hinge 10544 of the present disclosure, as will be more fully discussed herein.

The first predetermined position is shown in FIG. 10, where the cam 10560 and the cam keeper 10566 are positioned relative each other so the cam 10560 can engage and disengage the cam keeper 10566 positioned on the rear wall end frame 10531.

Figure 11:
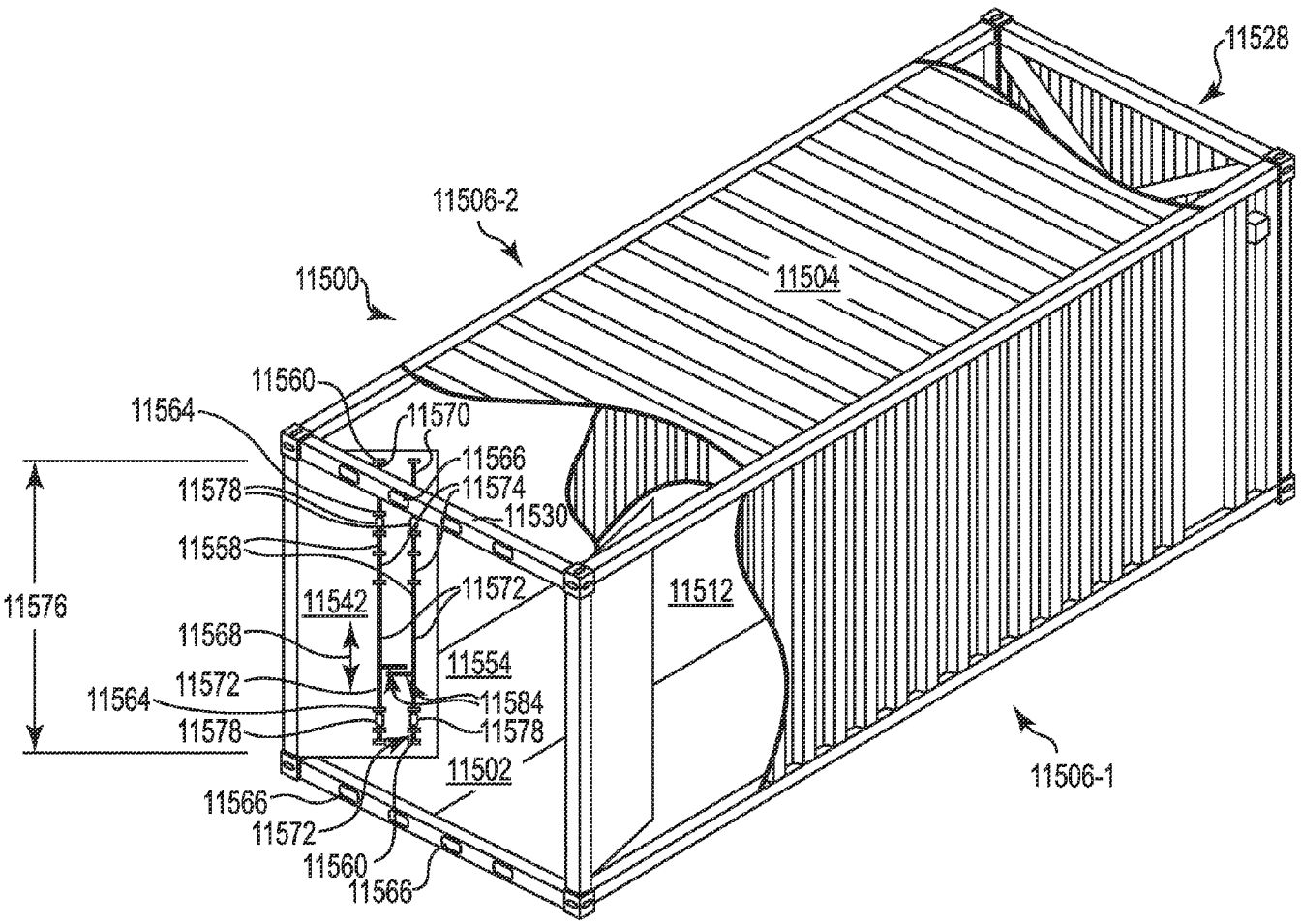
FIG. 11 provides a perspective view of a freight container according to the present disclosure.

FIG. 11 provides an illustration of the cam 11560 in at least one embodiment of the second predetermined position relative the cam keeper 11566. As illustrated in FIG. 11, the cam 11560 has been positioned, relative the first predetermined position, so that the cam 11560 is no longer aligned so as to engage and/or disengage the cam keeper 11566. The cam 11560 is also positioned relative the rear wall end frame 11530 such that the cam 11560 can pass through the area 11554 defined by the rear wall end frame 11530 as the door 11542 travels into the volume 11512 of the reversibly foldable freight container 11500, where the volume 11512 can be defined, at least in part, by the floor structure 11502, the roof structure 11504, the sidewall structures 11506-1 and 11506-2 and the rear wall 11528 (shown with cutaways to help better illustrate the position of the doors 11542 in the volume 11512 defined by the reversibly foldable freight container 11500.

Moving the cam 11560 between the first predetermined position and the second predetermined position can be accomplished in a number of different ways. For example, the locking rod 11558 can have two or more portions that can telescope along a longitudinal axis 11568 of the locking rod 11558. The locking rod 11558 can include a first portion 11570 and a second portion 11572 joined to the first portion 11570 with a connection shaft 11574. The first portion 11570 and the second portion 11572 can telescope relative the connection shaft 11574 to change a length 11576 of the locking rod 11558. For example, the first portion 11570 and the second portion 11572 can travel along the connection shaft 11574 between the first predetermined position and the second predetermined position.

As illustrated, the connection shaft 11574 can be held in place on the door 11542 with a combination of the bearing bracket assembly 11564 and an anti-rack ring 11578. The anti-rack ring 11578 can be joined to the connection shaft 11574 on either end of the bearing bracket assembly 11564 such that the shaft 11574 can rotate in the bearing bracket assembly 11564 by turning handle 11584, but will not pass vertically, relative the floor structure 11502 and/or the roof structure 11504, through the bearing bracket assembly 11564 (e.g., the connection shaft 11574 will not move up and/or down relative the bearing bracket assembly 11564) due to the presences of the anti-rack ring 11578.

Figure 12A:
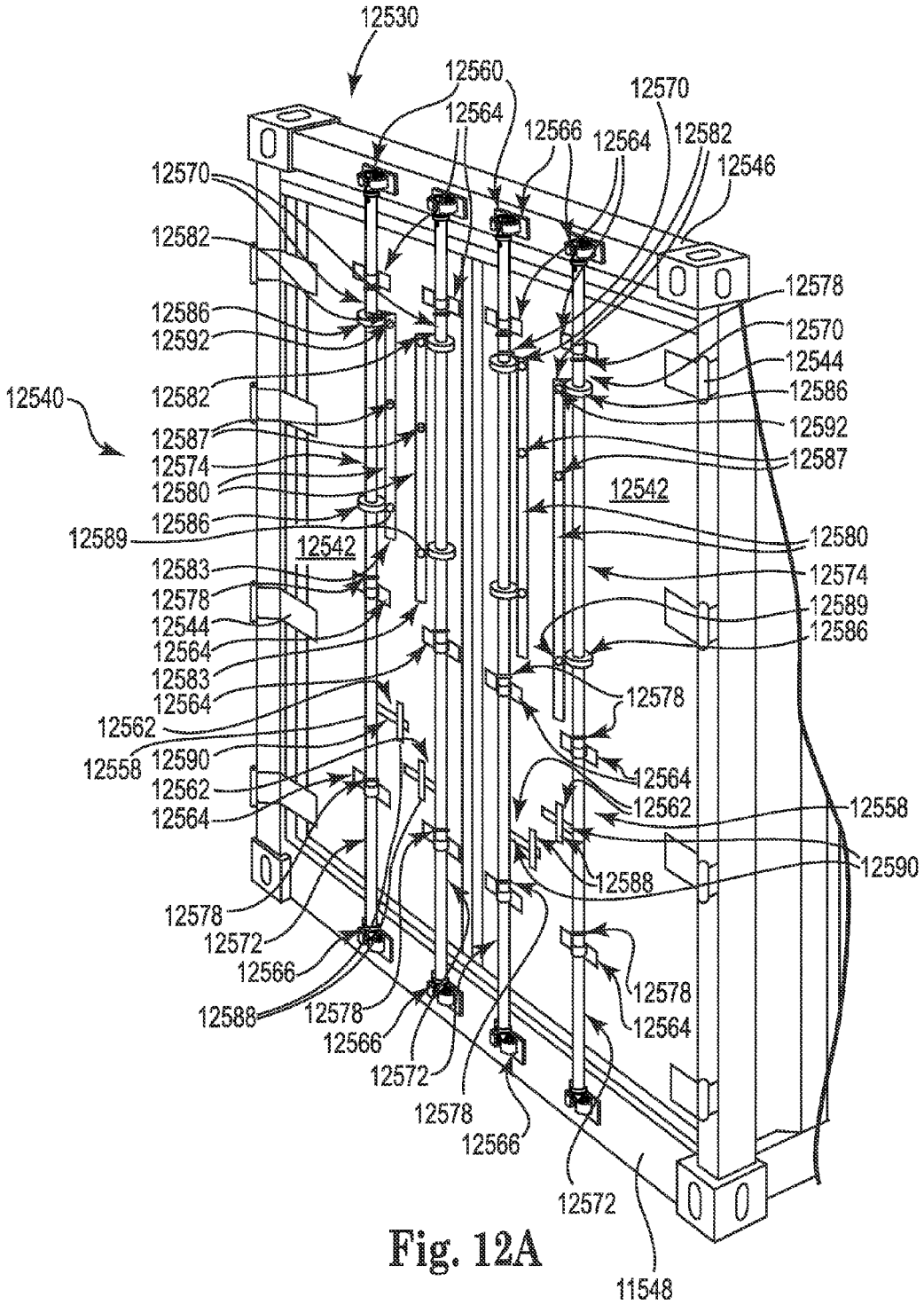
FIGS. 12A and 12B provide a perspective view of a door assembly with locking rods in the first predetermined position (FIG. 12A) and the second predetermined position (FIG. 12B) according to the present disclosure.
Figure 12B:
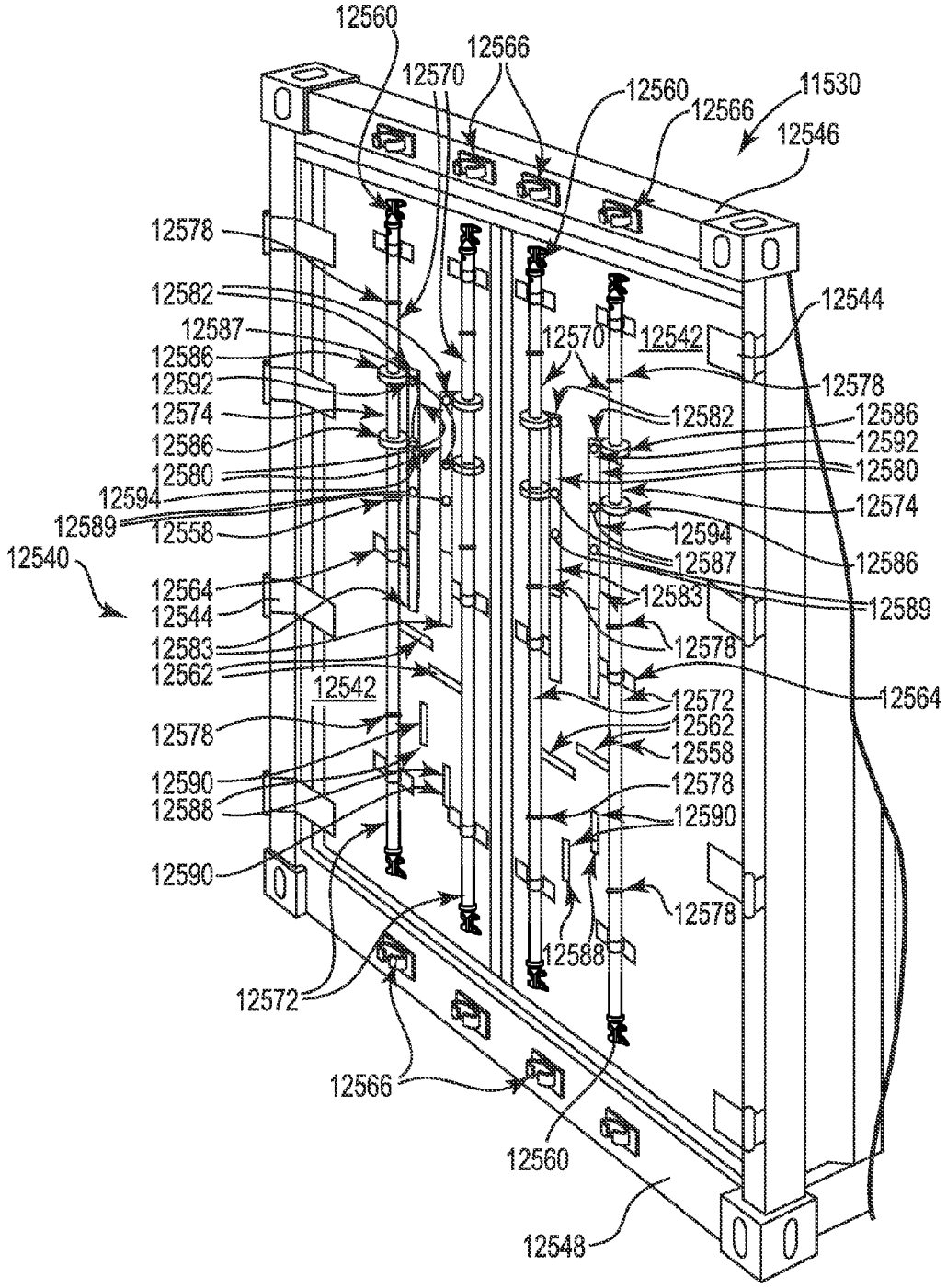
Figure 13:
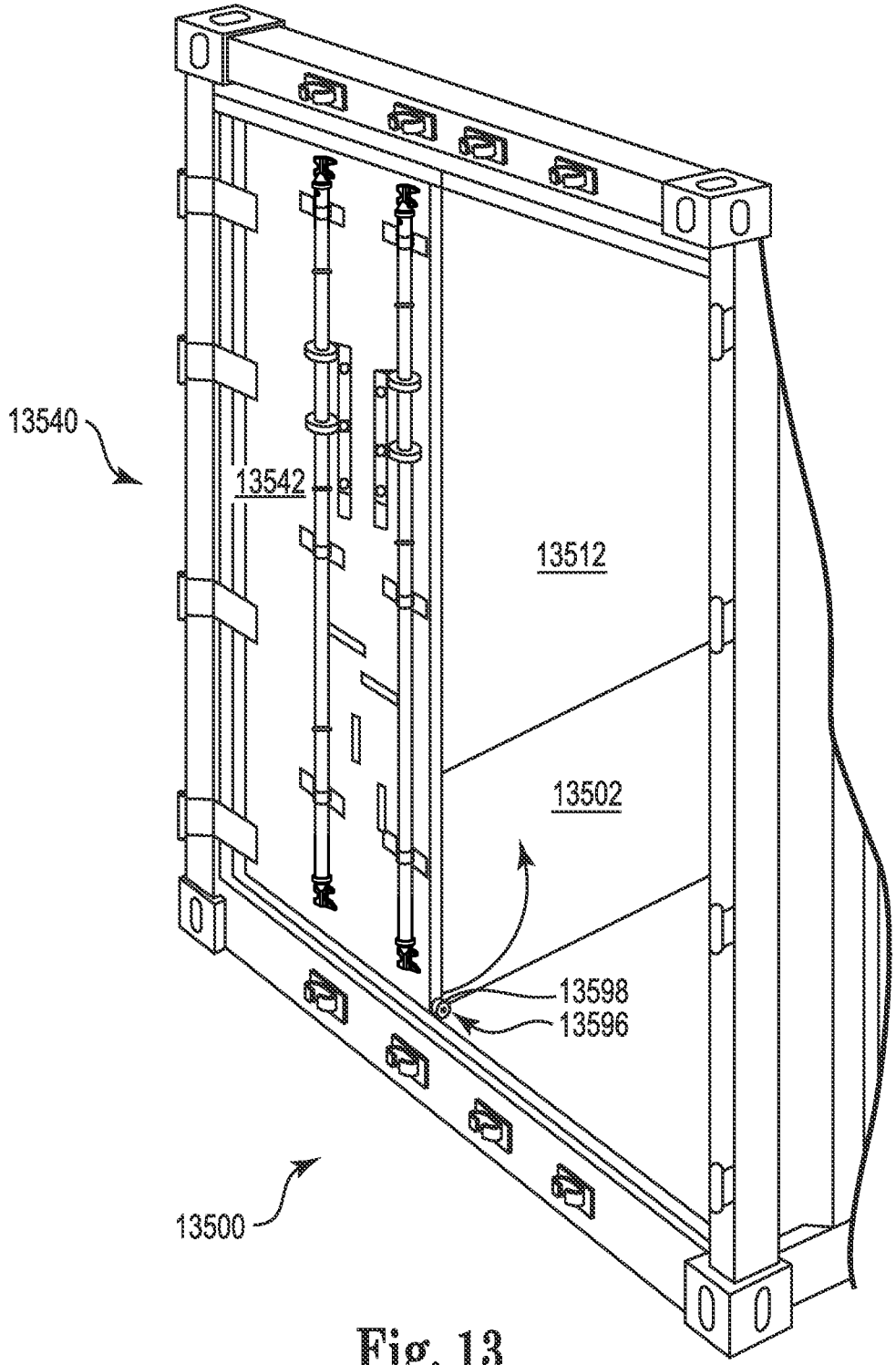
FIG. 13 provides a perspective view of the door assembly according to the present disclosure.

Referring now to FIGS. 12A and 12B there is shown the door assembly 12540 with the locking rods 12558 in the first predetermined position (e.g., the cam 12560 aligned with and can engage the cam keeper 12566 as illustrated in FIG. 12A) and the second predetermined position (e.g., the cam 12560 disengaged from the cam keeper 12566 and has a position relative the rear wall end frame 12530 that allows the cam 12560 and the door 12542 to travel into the volume of the reversibly foldable freight container 125(as illustrated in FIG. 13). As illustrated, the door assembly 12540 includes doors 12542, hinges 12544, rear wall header member 12546, rear wall sill member 12548, locking rod 12558, cam 12560, handle 12562, bearing bracket assembly 12564 and cam keeper 12566, as discussed herein. The embodiments illustrated in FIGS. 12A and 12B also include each of the first portion 12570 and the second portion 12572, where each of the portions 12570 and 12572 include a socket 12586 for receiving at least a portion of the connection shaft 12574. It is along and through the socket 12586 that each of the first portion 12570 and the second portion 12572 can travel relative the connection shaft 12574 as the locking rod 12558 telescopes to change the length of the locking rod 12558 between the first predetermined position as illustrated in FIG. 12A and the second predetermined position as illustrated in FIG. 12B.

The socket 12586 and the connection shaft 12574 can have a cross-sectional shape that does not allow the connection shaft 12574, the first portion 12570 and/or the second portion 12572 to rotate relative to each other to any significant degree. Such cross-sectional shapes can include, but are not limited to, non-circular cross sectional shapes such as oval, elliptical, or polygonal, such as triangular, square, rectangular, or higher polynomial such as pentagonal, hexagonal, etc. The connection shaft 12574 can further include a bearing bracket assembly, as discussed herein, in which to rotate and to provide support for the connection shaft 12574 in its position relative the first and second portions 12570 and 12572. It is possible that the socket 12586 may also include a bushing positioned between the connection shaft 12574 and each of the first and second portions 12570 and 12572. The bushing can be made of a polymer, such as polytetrafluoroethylene.

The first portion 12570 and the second portion 12572 can be mounted to the door 12542 with a combination of the bearing bracket assembly 12564 and the anti-rack ring 12578. For example, each of the first portion 12570 and the second portion 12572 can have bearing bracket assembly 12564 and anti-racking ring 12578 joined to each portion 12570 and 12572 that allows the portions 12570 and 12572 to rotate in the bearing bracket assembly 12564 by turning the handle 12562. The second portion 12572 can include the handle 12562. The door 12542 further includes a retainer plate 12588 and a retainer catch 12590 to receive and relesably hold the handle 12562 against the door 12542.

As illustrated, the anti-racking ring 12578 on each of the first portion 12570 and the second portion 12572 of the locking rod 12558 is positioned between the bearing bracket assembly 12564 for the connection shaft 12574 and the bearing bracket assembly 12564 for the respective portion 12570 and 12572. This configuration allows each of the first portion 12570 and/or the second portion 12572 to telescope, relative the floor structure 125 and roof structure 125, between the first predetermined position (FIG. 12A) and the second predetermined position (FIG. 12B), discussed herein. The anti-racking rings 12578 can also act as stops that limit the degree of travel of the first and second portions 12570 and 12572 of the locking rod 12558.

The locking rod 12558 also includes an adjustment member 12580 that can releasably join the first portion 12570 and the second portion 12572 of the locking rod 12558. The adjustment member 12580 includes a first end 12582 and a second end 12583, with surfaces defining a first opening 12587 adjacent the first end 12582 and a second opening 12589 between the first opening 12587 and the second end 12583 of the adjustment member 12580. The adjustment member 12580 can be non-releasably, but pivotally, attached to the first portion 12570 at or adjacent the first end 12582. The first and second openings 12587 and 12589 can then be used to releasably couple the first and second portions 12570 and 12572 of the locking rod 12558 in either one of the first predetermined position (seen in FIG. 12A) and/or the second predetermined position (seen in FIG. 12B).

The adjustment member 12580 can be a forged metal bar that is non-releasably, but pivotally, attached by a hub mount bracket 12592 to the first portion 12570. A rivet can be used to couple the adjustment member 12580 to the hub mount bracket 12592. The second portion 12572 can also include a mounting bracket 12594 that can receive and releasably couple the adjustment member 12580. In one embodiment, the mounting bracket 12594 can include a pin or a shaft over which either one of the first opening 12587 or the second opening 12589 on the adjustment member 12580 can be positioned. The pin or shaft on the mounting bracket 12594 can have a surface that defines an opening through the pin or shaft. The opening through the pin or shaft can be located such that when either one of the first opening 12587 or the second opening 12589 is positioned over the pin or shaft the opening can releasably receive an R-pin or R-clip. Once in position, the R-pin or R-clip can hold the adjustment member 12580 so as to keep the locking rod 12558 rigid (e.g., rigid along the longitudinal axis of the locking rod 358). The locking rod 12558 in its first predetermined position can perform an anti-racking function, as is known in the art. As appreciated, other structures besides R-pins or R-clips can be used to releasably secure the adjustment member 12580 between the first portion 12570 and the second portion 12572.

The adjustment member 12580 can also be used to telescope (e.g., move) the first portion 12570 of the locking rod 12558 between the first predetermined position and the second predetermined position. Similarly, the handle 12562 can be used to telescope (e.g., move) the second portion 12572 of the locking rod 12558 between the first predetermined position and the second predetermined position.

Referring now to FIG. 13, there is shown an embodiment of the door assembly 13540 of the present disclosure. As illustrated, only one door 13542 is shown so as to better illustrate the following embodiment. The door assembly 13540 includes the components as discussed herein for FIGS. 10 through 12B. For the various embodiments, the door 13542 illustrated in FIG. 13 further includes a wheel 13596 positioned between the door 13542 and the floor structure 13502. For the various embodiments, more than one wheel 13596 can be used with the door 13542 (e.g., two of wheel 13596, three of wheel 13596, etc. could be used with the door 13542).

The wheel 13596 can help to support the weight of and guide the door 13542 as it travels into the volume 13512 of the reversibly foldable freight container 13500. The wheel 13596 includes an axle 13598 on which the wheel 13596 rotates. For the various embodiments, the axle 13598 can be fixed to the wheel 13596 where the axle 13598 is supported by and rotates on a bracket housed within the door 13542 structure. Alternatively, the axle 13598 can be fixed to the door 13542, where the wheel 13596 includes a bearing or bushing that allows the wheel 13596 to rotate around the axle 13598.

Figure 14:
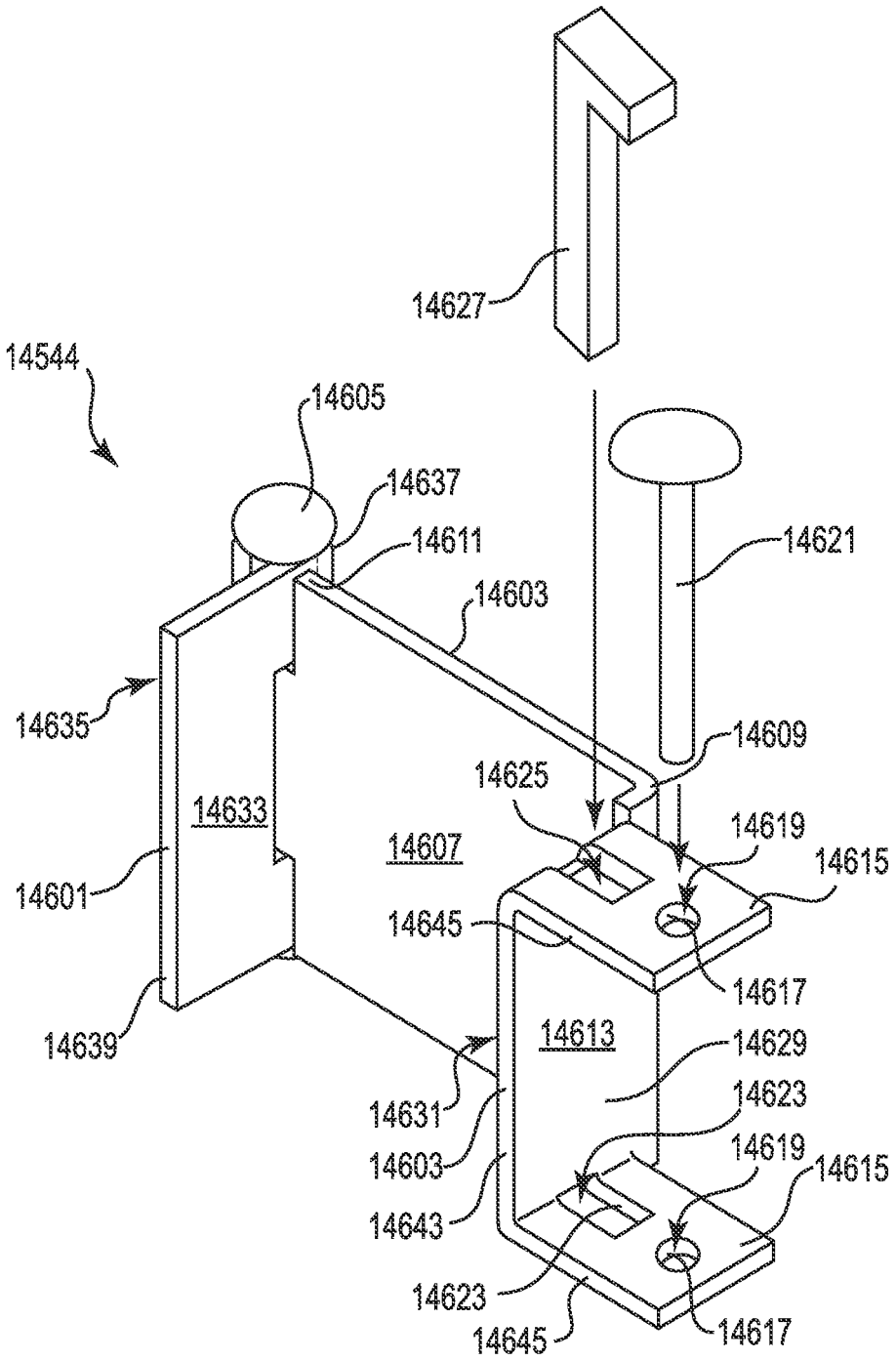
FIG. 14 provides a perspective view of a hinge according to the present disclosure.

Referring now to FIG. 14, there is shown an embodiment of the hinge 14544 according to the various embodiments of the present disclosure. As illustrated, the hinge 14544 includes a first wing 14601 and a second wing 14603, where the first wing 14601 and the second wing 14603 are pivotally connected by a first hinge pin 14605. The second wing 14603 includes a first planar portion 14607 with a first end 14609 and a second end 14611 and a second planar portion 14613 that extends perpendicular from the first end 14609 of the first planar portion 14607. The first hinge pin 14605 pivotally connects the first wing 14601 to the second end 14611 of the first planar portion 14607. As illustrated, a portion of the first planar portion 14607 of the second wing 14603 passes through an opening defined in the first wing 14601 so as to allow the second end 14611 of the first planar portion 14607 of the second wing 14603 to pivotally connect to the first hinge pin 14605 and the first wing 14601.

The hinge 14544 also includes a pair of hinge lugs 14615 that extend from the second planar portion 14613 of the second wing 14603. Each of the hinge lugs 14615 has a first set of surfaces 14617 defining openings 14619 through which a second hinge pin 14621 passes. For the various embodiments, at least one of the pair of hinge lugs 14615 has a surface 14623 defining an opening 14625 through which a locking pin 14627 travels. The locking pin 14627 can reversibly travel through the opening 14625, where in a first position with the locking pin 14627 positioned completely outside the opening 14625 the second wing 14603 is unlocked relative the first wing 14601, and when the locking pin 14627 is at least partially, or completely, positioned through the opening 14625 the second wing 14603 is locked relative the first wing 14601.

The second planar portion 14613 of the second wing 14603 includes a first major surface 14629 and a second major surface 14631 opposite the first major surface 14629. The pair of hinge lugs 14615 extends from the first major surface 14629 of the second planar portion 14613. The first wing 14601 has a first major surface 14633 and a second major surface 14635 opposite the first major surface 14633. In a first predetermined position the first wing 14601 is perpendicular to the first planar portion 14607 of the second wing 14603 and the first major surface 14633 of the first wing 14601 is directly opposite and parallel with the second major surface 14631 of the second planar portion 14613. As will be discussed more fully herein, the first predetermined position can occur with the first wing 14601 attached to a corner post of the reversibly foldable freight container and the second wing 14603 of the hinge 14544 is positioned against (e.g., adjacent to and in at least partial contact with) the corner post.

The first wing 14601 has a first end 14637 and a second end 14639, and where the first hinge pin 14605 pivotally connects the first end 14637 of the first wing 14601 to the second end 14611 of the first planar portion 14607 of the second wing 14603. The second planar portion 14613 has an end 14643 that is distal to the first end 14609 of the first planar portion 14607 and the pair of hinge lugs 14615 extending from the second planar portion 14613 have a first peripheral edge 14645, where the end 14643 of the second planar portion 14613 and the first peripheral edge 14645 of the hinge lugs 14615 lay in a common plane.

Figure 15:
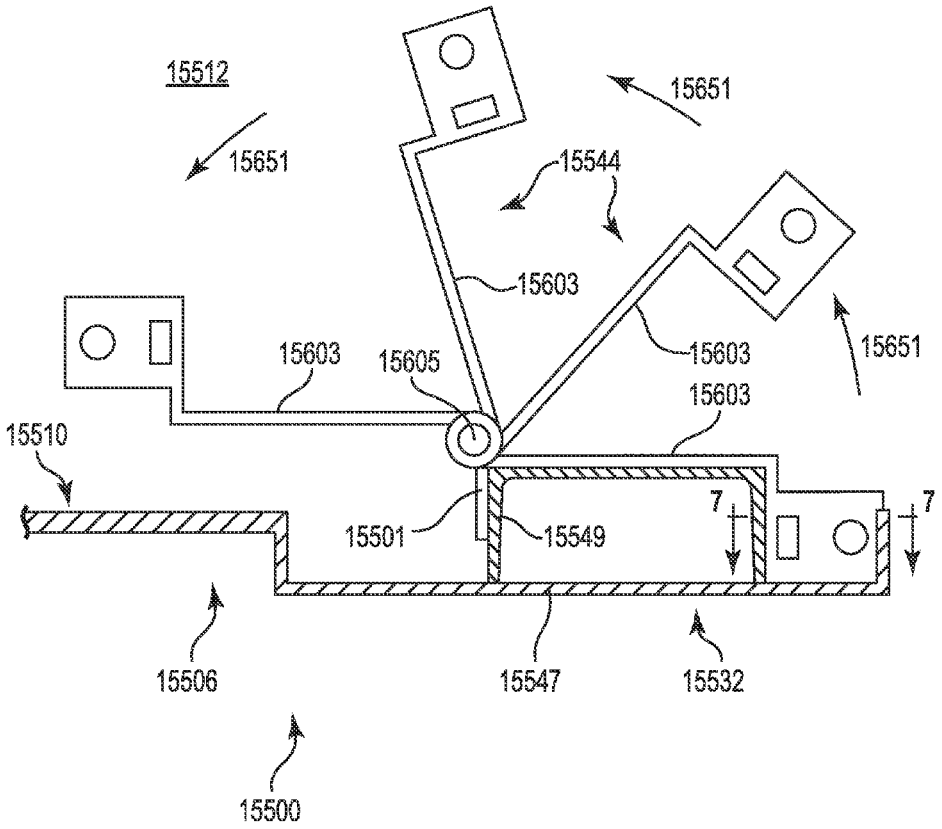
FIG. 15 provides a planar view of the hinge fastened to a corner post of a freight container according to the present disclosure.

Referring now to FIG. 15, there is shown a top down view of the hinge 15544 according to the present disclosure that has been mounted on a rear wall corner post 15532 of a reversibly foldable freight container 15500. Only a portion of the reversibly foldable freight container 15500 is illustrated in FIG. 15 to allow for a better view and understanding of the operation of the hinge 15544. The corner posts of the reversibly foldable freight container are formed from a "J" bar 15547 and a "U"-channel 15549, where the J-bar 15547 and the U-channel 15549 are welded together to form the corner post of the reversibly foldable freight container 15500. A "U"-channel 15549 is also known as an "inner post." This construction of the corner post is applicable to the both the front wall corner posts and the rear wall corner posts discussed herein.

As illustrated, the first wing 15601 is fastened to a portion of the U channel 15549. The first wing 15601 can be fastened to the portion of the U channel by a welding (e.g., arc-welding) process. The second wing 15603 (illustrated in multiple positions in FIG. 15 as the second wing 15603 pivots about the first hinge pin 15605) is free to pivot around the first hinge pin 15605. The travel path 15651 of the second wing 15603 shown in FIG. 15 is into the volume 15512 of the reversibly foldable freight container 15500 (as partially defined by the interior surface 15510 of the side wall structure 15506 of the reversibly foldable freight container 15500).

Figure 16:
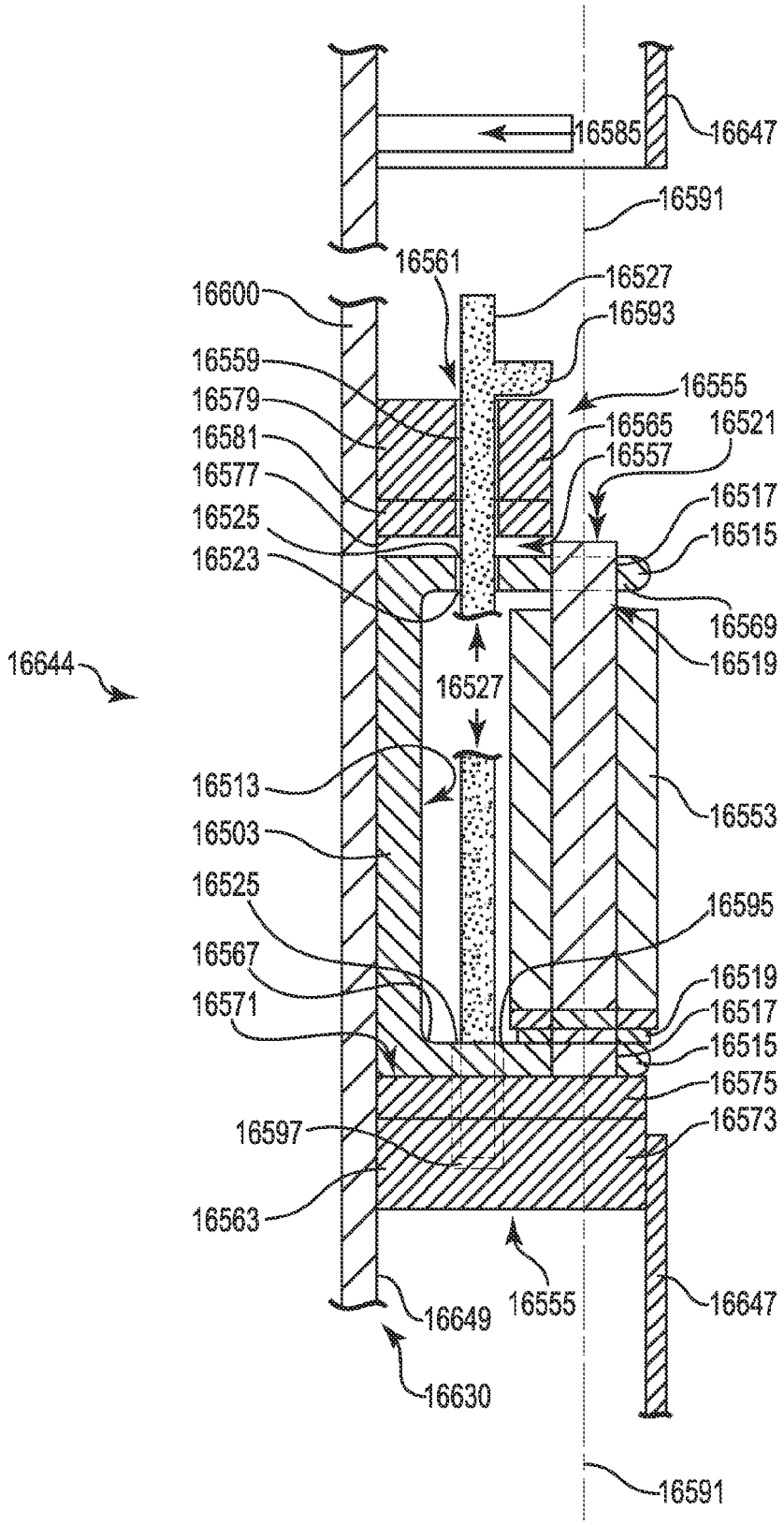
FIG. 16 provides a planar view of the hinge fastened to a corner post of a freight container according to the present disclosure.

Referring now to FIG. 16, there is shown the hinge 16544 in the first predetermined position (as illustrated in FIG. 14) on the reversibly foldable freight container 16500 as viewed along lines 7-7 in FIG. 15. The embodiment illustrated in FIG. 16 also includes the locking pin 16627 and the second hinge pin 16621 as illustrated in FIG. 14. As illustrated, the second wing 16603 includes hinge lugs 16615 that extend from the second planar portion 16613, and which hinge lugs 16615 include the first set of surfaces 16617 defining openings 16619 through which the second hinge pin 16621 passes and is seated. As will be discussed more fully herein, the door of the fright container pivots (e.g., swings) about second hinge pin 16621. The hinge lugs 16615 also include the surface 16623 defining the opening 16625 through which the locking pin 16627 travels. 166 FIG. 16 also shows the hinge 16544 having a pair of seating blocks 16655 fastened to the rear wall end frame 16530 (only a portion of which is shown) of the reversibly foldable freight container to form a socket 16657 that receives and seats the second planar portion 16613 and at least a portion of the pair of hinge lugs 16615. As illustrated, the U-channel 16549 of rear wall end frame 16530 helps to form a portion of the socket 16657. A portion of the J-bar 16547 is removed so as to create a volume into which the second wing 16603 can reside and so as to allow the hinge 16653 to pivot such that door can swing towards the exterior surface of the sidewall structure (a feature that is more fully illustrated and discussed herein). At least one of the pair of seating blocks 16655 has a surface 16659 defining an opening 16661 through which the locking pin 16627 travels to lock and un-lock the second wing 16603 from the corner post of the reversibly foldable freight container. As discussed herein, the locking pin 16627 reversibly travels to lock and un-lock the second wing 16603 from the corner post of the freight container. The door is joined to the pair of hinge lugs 16615, as illustrated herein, with the second hinge pin 16621 where the door pivots on the second hinge pin 16621 relative the pair of hinge lugs 16615 when the hinge lugs 16615 are locked to the corner post of the reversibly foldable freight container. This allows the door to extend adjacent the exterior surface of the sidewall structure. In addition, the door and the second wing 16603 can pivot on the first hinge pin when the hinge lugs 16615 are un-locked to the corner post of the reversibly foldable freight container to allow the door to travel into the volume of the reversibly foldable freight container and extend adjacent the interior surface of the sidewall structure. These embodiments will be illustrated and further discussed herein.

The pair of seating blocks 16655 can include a lower seating block 16663 and an upper seating block 16665. The pair of hinge lugs 16615 includes a lower hinge lug 16667 and an upper hinge lug 16665. The lower hinge lug 16667 can releasably seat, or rest, on the lower seating block 16663. The upper seating block 16669 can have the surface 16659 defining the opening 16661 through which the locking pin 16627 travels through the opening 16623 of the hinge lug 16669 to lock and un-lock the second wing 16603 from the corner post of the reversibly foldable freight container. The lower hinge lug 16667 can also include a surface 166 surface 16695 defining an opening 16697 through which the locking pin 16627 travels. Each of the lower seating block 16663 and the upper seating block 16665 also include a surface defining an opening through which the locking pin 16627 travels to lock and un-lock the second wing 16603 from the corner post of the reversibly foldable freight container (for this embodiment, the locking pin 16627 would be of sufficient length to travel through the opening 16623 of the hinge lug 16669 and the opening 16697 in the lower hinge lug 16667 and the lower seating block 16663 to lock and un-lock the second wing 16603 from the corner post of the reversibly foldable freight container).

As illustrated in FIG. 16, the lower seating block 16663 can include a first surface 16671, on which the lower hinge lug 16667 seats or rests, a second surface 16673 substantially perpendicular to the first surface 16671, and a third surface 16675 that slopes between the first surface 16671 and the second surface 16673 of the lower seating block

16663. The lower hinge lug 16667 travels along the third surface 16675 as the second wing 16603 pivots around the first hinge pin relative the first wing. The upper seating block 16665 includes a first surface 16677, a second surface 16679 substantially perpendicular to the first surface 16677, and a third surface 16681 that slopes between the first surface 16677 and the second surface 16679, where the upper hinge lug 16669 can travels along the third surface 16681 as the second wing 16603 pivots around the first hinge pin relative the first wing.

The end frame can also include a locking pin travel stop 16685 to limit a travel distance of the locking pin 16627. The locking pin 16627 can also include a surface 16693 defining a structure 166on which, or into which, a tool can be used to cause the locking pin to travel. For example, the structure 166can be a notch or a recess formed in the locking pin 16627 that can accommodate a pry bar or other prying tool that would help in moving the locking pin 16627. The locking pin 16627 can secure the hinge 16544 perpendicular to an axis 16691 of rotation of the second hinge pin 16621.

Figure 17:
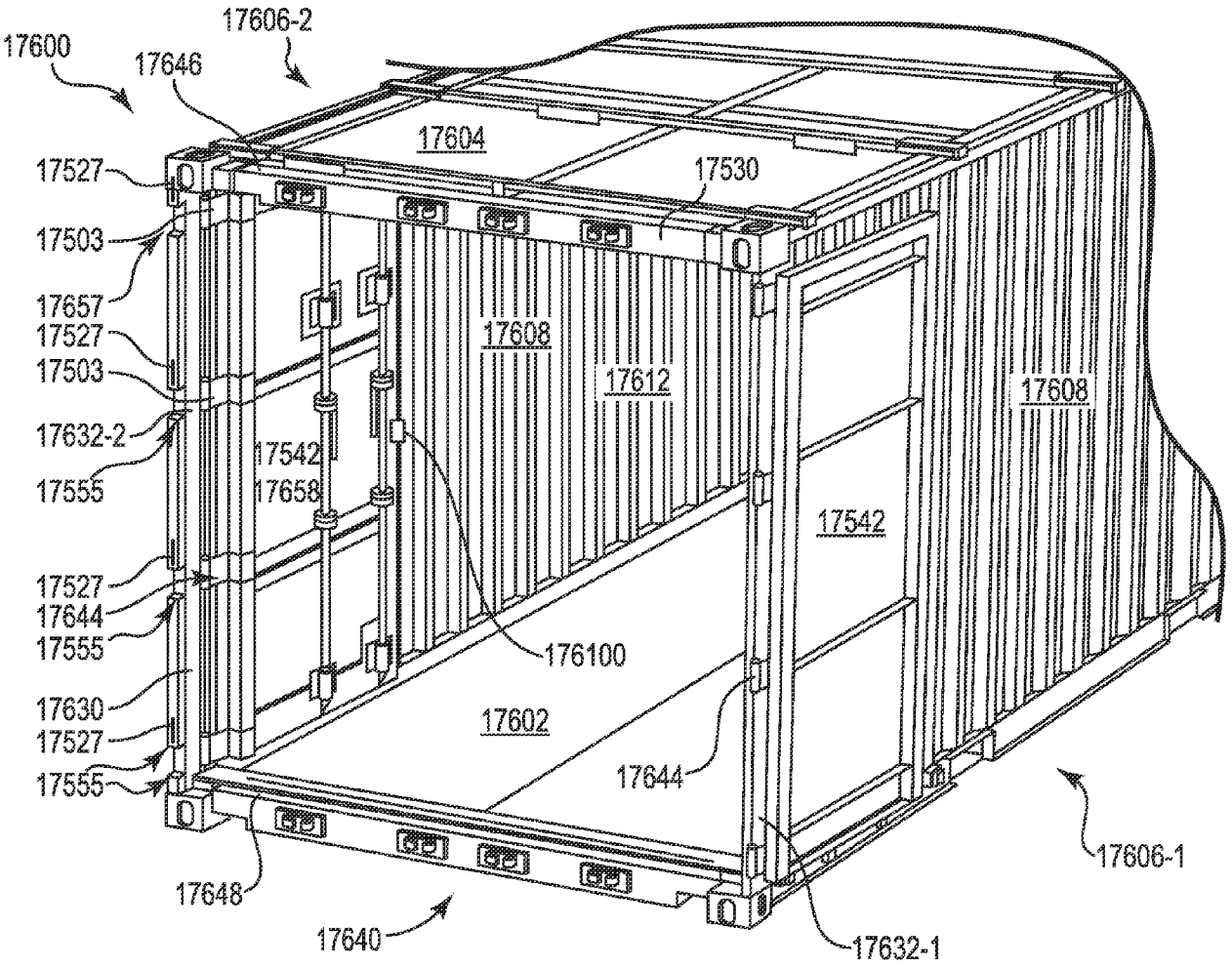
FIG. 17 provides a perspective view of a freight container according to the present disclosure.

Referring now to FIG. 17, there is shown an embodiment of the reversibly foldable freight container 17500 of the present disclosure where one of the door 17524 is positioned within the volume 17512 of the reversibly foldable freight container 17500, and the other of the door 17524 is positioned along the exterior surface 17508 of the sidewall structure 17506-1. As illustrated, the reversibly foldable freight container 17500 includes the roof structure 17504, the floor structure 17502 opposite the roof structure 17504, and the sidewall structures 17506-1 and 17506-2 between the floor structure 17502 and the roof structure 17504, as discussed herein. Each of the sidewall structures 17506-1 and 17506-2 have the exterior surface 17508 and the interior surface 17510, where the interior surface 17510 at least partially defines the volume 17512 of the reversibly foldable freight container 17500.

The reversibly foldable freight container 17500 includes the rear wall end frame 17530 joined with the roof structure 17504, the floor structure 17502 and the sidewall structures 17506-1 and 17506-2, where the rear wall end frame 17530 has the rear wall sill member 17548, the rear door header member 17546 and the rear wall corner posts 17532-1 and 17532-2 between the rear wall sill member 17548 and the rear door header member 17546. The door assembly 17540 also includes the hinge 17544 on each of the corner posts 17532-1 and 17532-2, where the hinge is as discussed herein. The first wing of the hinge 17544 is fastened to the corner posts 17532-1 and 17532-2. The first hinge pin 175 pivotally connects the first wing fastened to the corner posts 17532-1 and 17532-2 to the second end of the first planar portion of the second wing 17603, as discussed herein.

The locking pin 17627 can travel through the at least one of the pair of hinge lugs having the surface defining the opening(s) through which the locking pin travels. The reversibly foldable freight container 17500 further includes the pair of seating blocks 17655, as discussed herein, fastened to the rear wall end frame 17530 to form the socket 17557 that receives and seats the hinge lugs of the hinge 17544. As discussed herein, once the hinge 17544 is seated on the seating blocks 17655 in the socket 17557 the locking pin 17627 can travel (e.g., be moved up and/or down) to lock and un-lock the second wing of the hinge 17544 from the corner posts 17532-1 and 17532-2 of the reversibly foldable freight container 17500.

The reversibly foldable freight container 17500 further includes two of the door 17524 that are joined to the pair of hinge lugs of the hinge 17544 with the second hinge pin. Each of the doors 17524 pivots on the second hinge pin relative the pair of hinge lugs when the hinge lugs are locked to the corner posts 17532-1 and 17532-2 of the reversibly foldable freight container 17500 to allow the doors 17524 to extend adjacent the exterior surface 17508 of the sidewall structures 17506-1 and 17506-2. The door 17524 and the second wing of the hinge 17544 can also pivot on the first hinge pin when the hinge lugs are un-locked to the corner posts 17532-1 and 17532-2 of the reversibly foldable freight container 17500 to allow the door 17524 to travel into the volume 17512 of the reversibly foldable freight container 17500 and extend adjacent the interior surface 17510 of the sidewall structure 17506. Both of these embodiments are illustrated in FIG. 17.

The sidewall structures 17506-1 and 17506-2 of the reversibly foldable freight container 17500 further includes a latch 175100, where the latch 175100 can be used to engage and releasable hold the door 17524 adjacent the interior surface 17510 of the sidewall structures 17506-1 and 17506-2. The door 17524 is also shown with the locking rod 17558, as discussed herein, mounted to the door 17524. As illustrated in FIG. 17, the locking rod 17558 is shown in the first predetermined position on the door 17524 positioned along the exterior surface 17508 of the sidewall structures 17506 and the second predetermined position on the door 17524 positioned within the volume 17512 of the reversibly foldable freight container 17500.

Figure 18A:
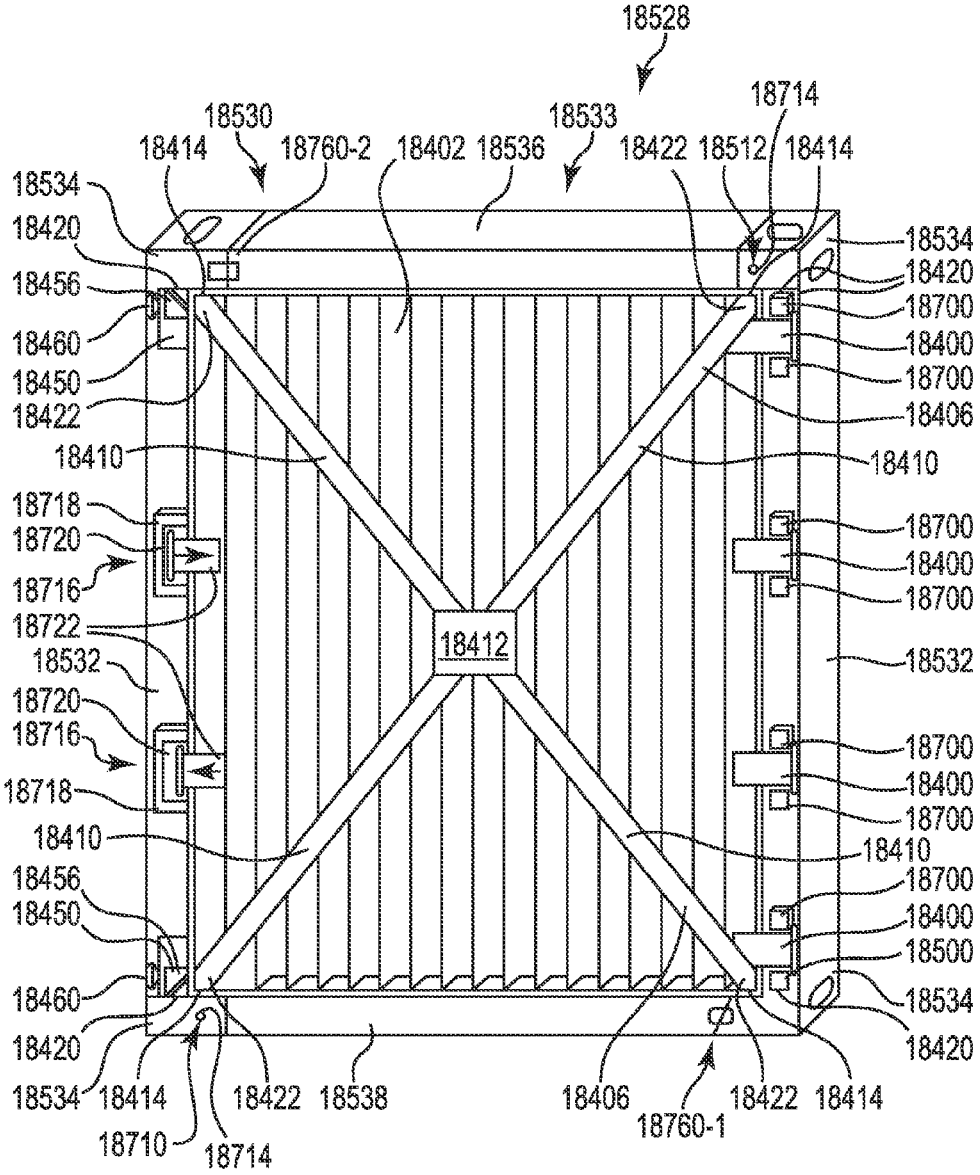
FIGS. 18A-18C provide a perspective view of an embodiment of a front wall of a foldable freight container taken along the view lines 18-18 shown in FIG. 10.
Figure 18B:
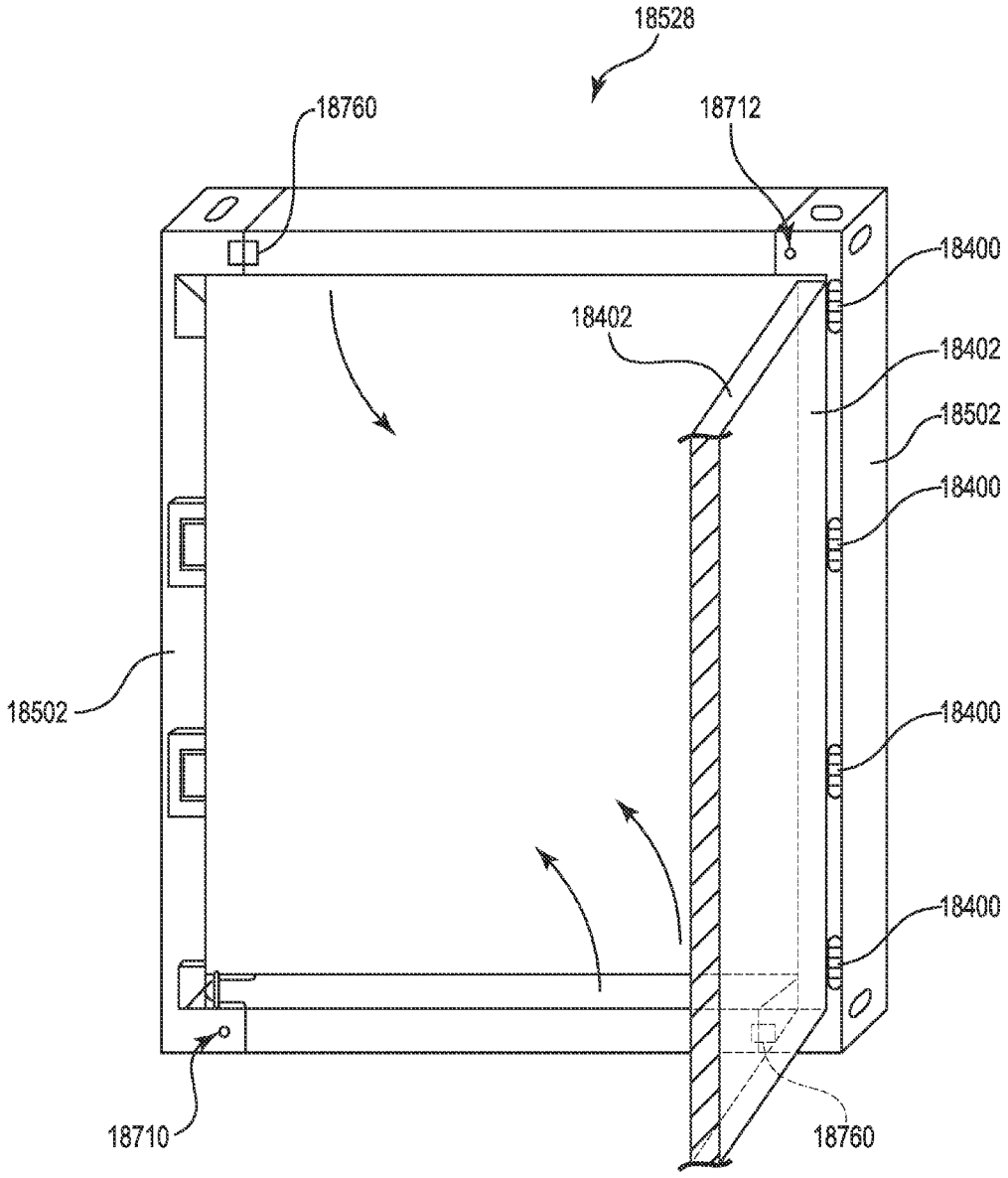
Figure 18C:
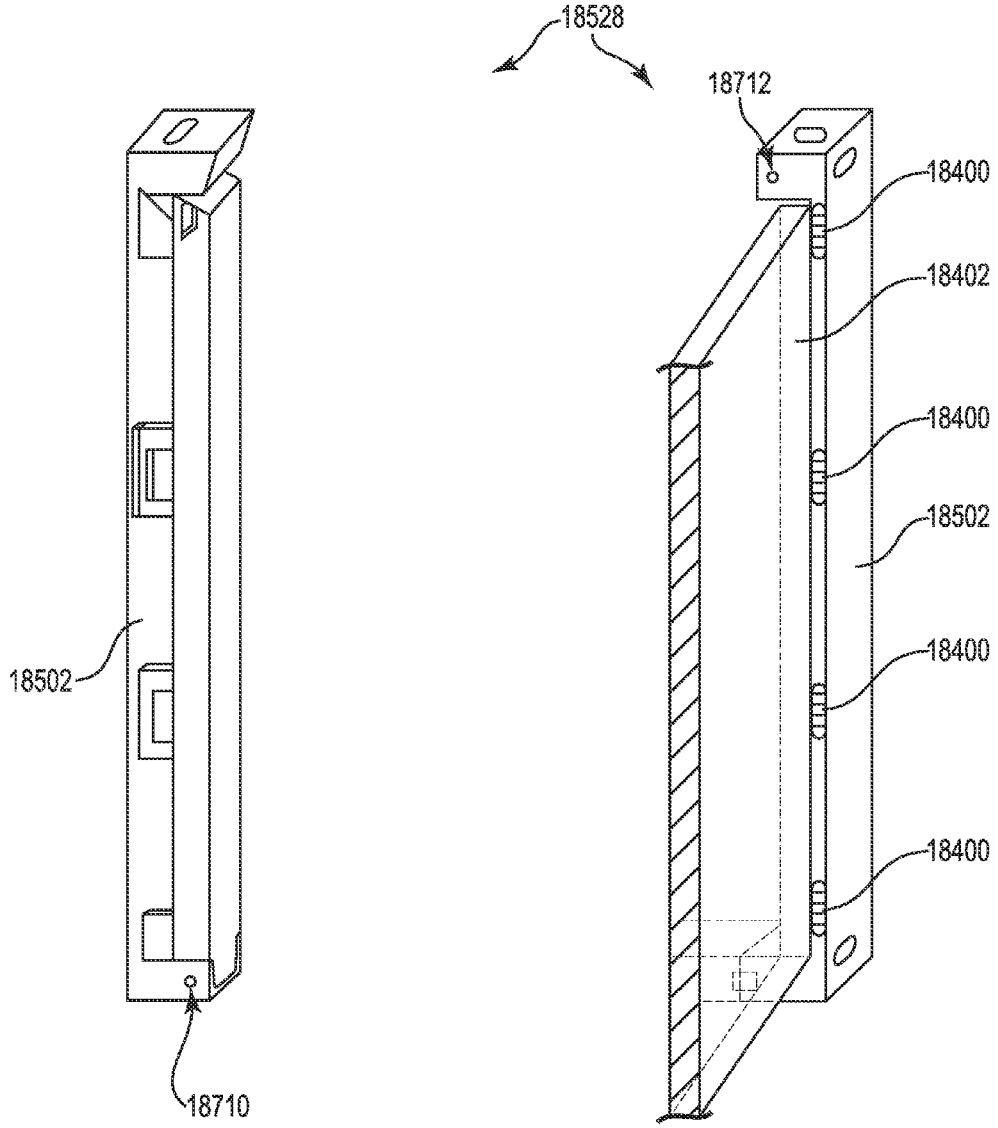

Referring now to FIGS. 18A-18C there is shown the front wall 18528 of the reversibly foldable freight container of the present disclosure. The view of the front wall 18528 illustrated in FIGS. 18A-18C is taken along the view lines 18-18 shown in FIG. 10. As illustrated, the front wall 18528 is joined with the roof structure, the floor structure and the sidewall structures, as illustrated in FIG. 10 and FIG. 11.

As illustrated, the front wall 18528 includes the front wall end frame 18533 having the front wall corner posts 18532-3 and 18532-4, a front door hinge 18400 on the front wall corner post 18532-3 and a front door 18402 joined to the front door hinge 18400. The front door 18402 can pivot on the front door hinge 18400 into the volume of the reversibly foldable freight container and extend adjacent the interior surface of the sidewall structure (as seen in FIG. 10).

The front wall end frame 18533 also includes the front wall sill member 18538 and a front wall header member 18536, where the front wall sill member 18538 and the front wall header member 18536 extend between the front wall corner posts 18532-3 and 18532-4. The front wall sill member 18538 is connected to a first of the front wall corner post 18532 with a sill hinge 18710 that allows at least a portion of the front wall sill member 18538 to fold towards a second of the front wall corner post 18532. Similarly, the front wall header member 18536 is connected to the second of the front wall corner post 18532 with a header hinge 18712 that allows at least a portion of the front wall header member 1836 to fold towards the first of the front wall corner post 18532.

This ability of both the front wall header member 18236 and the front wall sill member 18538 to fold is illustrated in FIGS. 18B and 18C. A pivot pin 18714 is used in the header hinge 18712 and the sill hinge 18710 to connect and allow for the rotation of the front wall sill member 18538 relative the first of the front wall corner post 18532, and the front wall header member 18536 relative the second of the front wall corner post 18532.

A first of a latch 18760-1 is used to relesably connect the front wall sill member 18538 to the first of the front wall corner post 18532-3. Similarly, a second of the latch

18760-2 is used to relesably connect the front wall header member 18536 to the second of the front wall corner post 18532. When in a locked position, the latch 18760 helps to prevent the front wall sill member 18236 and the front wall header member 18536 from moving relative their respective front wall corner posts 18532-3 and 18532-4. When in an unlocked position, the front wall header member 18536 and the front wall sill member 18538 can be folded towards their respective front wall corner posts 18532-3 and 18532-4 (illustrated in FIGS. 18B and 18C).

For example, the latch 18760-1 and 18760-2 can releasably connect these structures via a bolt or a fastener, where the bolt or fastener may be removed to allow the front wall header member 18536 to pivot substantially ninety degrees so that the front wall header member 18536 is adjacent (e.g. is substantially parallel to, the front wall corner post 18532-3). Likewise, the bolt or fastener that releasably connects the front wall sill member 18538 and the front wall corner post 18532-3 may be removed to allow the front wall sill member 18538 to pivot substantially ninety degrees so that the front wall sill member 18538 is adjacent (e.g. is substantially parallel to, the front wall corner post 18532-4).

As illustrated in FIG. 18A, the front door 18402 further includes a planar truss 18406. The planar truss 18406 in its seated and locked position helps to provide an anti-racking function for the reversibly foldable freight container 1800.

As illustrated, the planar truss 18406 releasably seats against and extends from the front wall corner posts 18532-3 and 18532-4 across the front door 18402. The planar truss 18406 includes straight members 18410. As illustrated, the planar truss 18406 forms a triangle, as this shape will not change shape when the lengths of the sides of the front door 18402 are fixed. As illustrated, the straight members 18410 and the corner post 18532 form nodes 18414 of the planar truss 18406 is all lie within a two dimensional plane of the front door 18402. The planar truss 18406 can be in the form of beam having a number of different cross-sectional profiles. Such cross-sectional profiles include, but are not limited to, I-beam, tubular, rectangular, triangular, and square, among others.

The front wall corner post 18532-4 also includes a socket 18420 in which an end portion 18422 of the planar truss 18406 releasably seats when the front door 18402 is in a first predetermined position. In the present embodiment, the first predetermined position is when the front door 18402 is seated within the front wall end frame 18533, where the front wall end frame 18533 includes the corner posts 18532, corner fittings 18534, the front wall header member 18536 and the front wall sill member 18538.

The socket 18420 can be formed from an extension 18450, such as a plate, that is applied to the surface of the front wall corner post 18532, a locking plate 18456, and a portion of the corner fitting 18534. When the end portion 18422 of the planar truss 18406 is seated in the socket 18420 the locking plate 18456 can be reversibly slid over the end portion 18422 to lock the planar truss 18406. From the locked position, the locking plate 18456 can be slid in an opposite direction of travel 18460 to unlock the end portion 18422 of the planar truss 18406.

When in the first predetermined position, a portion of the planar truss 18406 abuts a portion of the front door corner post 18532. As illustrated, this portion of the planar truss 18406 that abuts a portion of the front door corner post 18532 can be the end portion 18422. When abutted in the first predetermined position the planar truss 18406 can act in conjunction with the front wall end frame 18533 to minimize transverse racking of the reversibly foldable freight container.

FIG. 18A illustrates the front wall corner post 18532-3 on which the front door hinge 18400 is mounted also includes a seating block 18700 on which at least a portion of the front door hinge 18400 can seat when the door 18402 is in the first predetermined position. The seating block 18700 can help to support the weight of the front door 18402 when in the first predetermined position. The front wall 18528 further includes door locks 18716. The door locks 18716 include a bracket 18718 mounted to the front wall corner post 18532-4 and a slide member 18720. The bracket 18718 can be in the shape of a "C" that helps define a socket into which an extension member 18722 mounted to the front door 18402 can releasably seat.

When the slide member 18720 is in an open position the socket defined by the bracket 18718 can receive the extension member 18722. Once the extension member has been received in the socket, the slide member 18720 can be slid over at least a portion of the extension member 18722 so as to help "lock" the front door 18402 in its first predetermined position. When the front door 18402 is to be moved from its first predetermined position, the slide member 18720 and the locking plate 18456 the can be slid so as to open their respective sockets thereby allowing the front door 18402 to rotate on the door hinge 18400.

FIGS. 18A-18C show positioning the door 18402 of the front wall 18528 of a reversibly foldable freight container so that it can be inside a volume defined by the reversibly foldable freight container. As discussed herein, positioning the door 18402 of the front wall 18528 of the reversibly foldable freight container inside the volume defined by the reversibly foldable freight container includes unlocking the door 18402, and a portion of the door truss 18406, from the front wall end frame 18533. Once unlocked the door 18402 can pivot on the door hinge 18400 so as to position the door 18402 inside the volume defined by the reversibly foldable freight container. FIG. 18B illustrates this state. FIG. 18B also shows that once the door 18402 has swung clear of the front wall header member 18536 and the front wall sill member 18538, these members 18536 and 18538 can be folded towards their respective front wall corner post 18532. FIG. 18C illustrates the front wall header member 18536 and the front wall sill member 18538 folded relative their respective front wall corner post 18532.

Referring now to FIGS. 19A-19D there is shown the rear wall 19526 of the reversibly foldable freight container 19500 of the present disclosure. As illustrated, the rear wall 19526 is joined with the roof structure 19504, the floor structure 19502 and the sidewall structures 19506-1 and 19506-2, where the roof structure 19504, the floor structure 19502, the interior surface 19511 of the sidewall structures 19506-1 and 19506-2 and the rear wall 19526 define a volume 19512 of the reversibly foldable freight container 19500.

As illustrated, the rear wall 19526 includes rear wall corner posts 19532-1 and 19532-2, a hinge 19344, as discussed herein, on the rear wall corner posts 19532-1 and 19532-2 and a rear wall door 19542 joined to the hinge 19344. FIGS. 19A-19D show the hinge 19344 un-locked to the rear wall corner post in the second predetermined position so that the rear wall door 19542 can pivot into the volume 19112 of the reversibly foldable freight container 19500 and extend adjacent the interior surface 19511 of the sidewall structures 19506-1 and 19506-2.

Figure 19A:
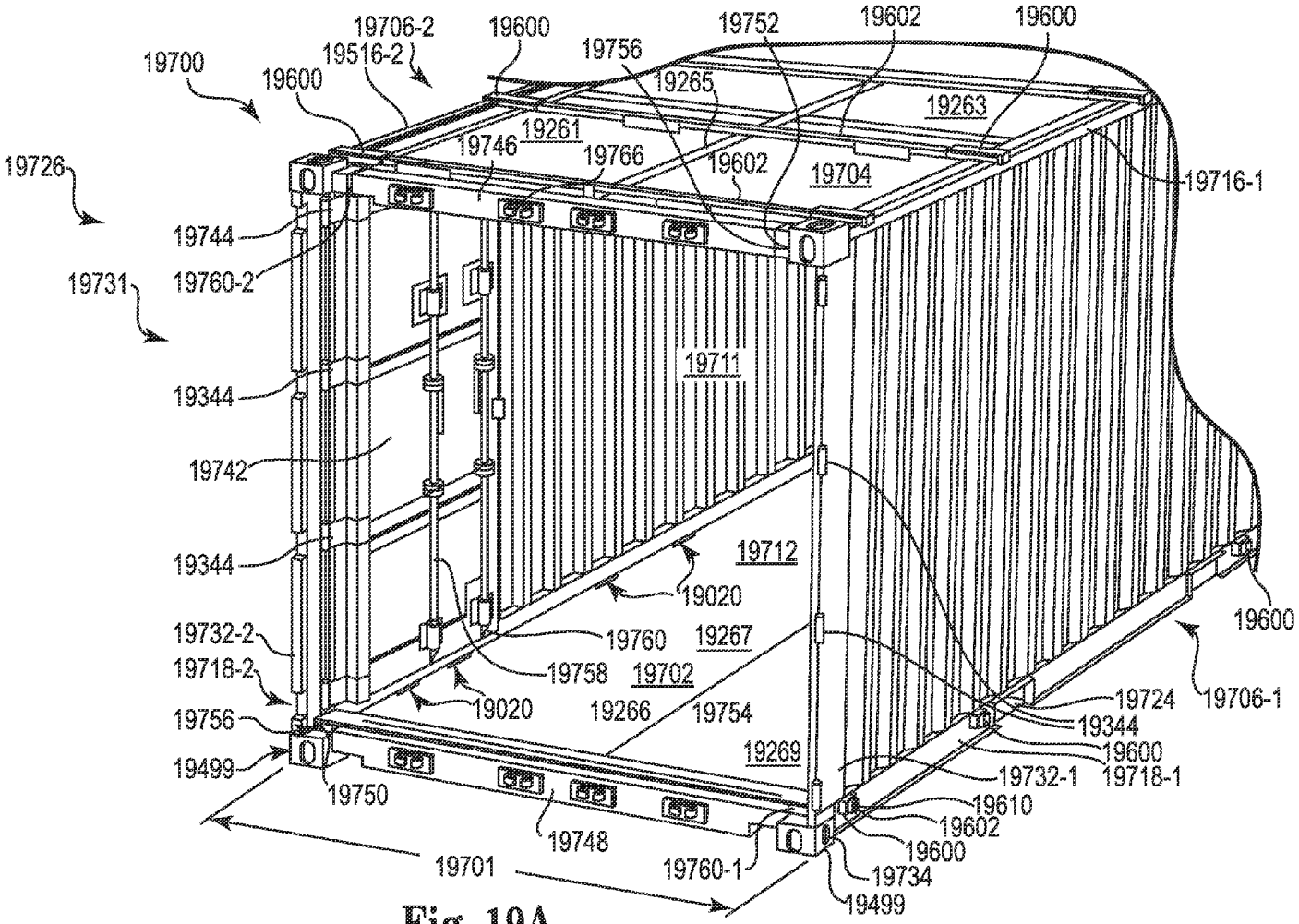
FIGS. 19A-19D provide a perspective view of an embodiment of a foldable freight container according to the present disclosure.

FIG. 19A shows the reversibly foldable freight container 19500 in an unfolded state having a predefined width 19501 measured at a predetermined point on each of two of the rear wall corner posts 19506-1 and 19506-2. Specifically, the predetermined points on each of two of the rear wall corner posts 19506-1 and 19506-2 are defined by an external surface 19499 of the corner fittings 19534 and 19534 as provided in ISO 668 Fifth Edition 1995 Dec. 15. For the various embodiments, in the unfolded state the predefined width 19501 of the reversibly foldable freight container 19500 is eight (8) feet as provided in ISO 668 Fifth Edition 1995 Dec. 15.

The rear wall 19526 includes a rear wall end frame 19531 having two of the rear wall corner posts 19532-1 and 19532-1, a rear wall sill member 19548 and a rear wall header member 19546. The rear wall sill member 19548 and the rear wall header member 19546 extend between the two of the rear wall corner posts 19532-1 and 19532-1. The rear wall sill member 19548 is connected to a first of the rear wall corner post 19532-2 with a sill hinge 19750 that allows at least a portion of the rear wall sill member 19548 to fold towards the first of the rear wall corner post 19532-1. The rear wall header member 19546 is connected to a second of the rear wall corner post 19532-1 with a header hinge 19752 that allows at least a portion of the rear wall header member 19546 to fold towards the second of the rear wall corner post 19532-1.

Figure 19B:
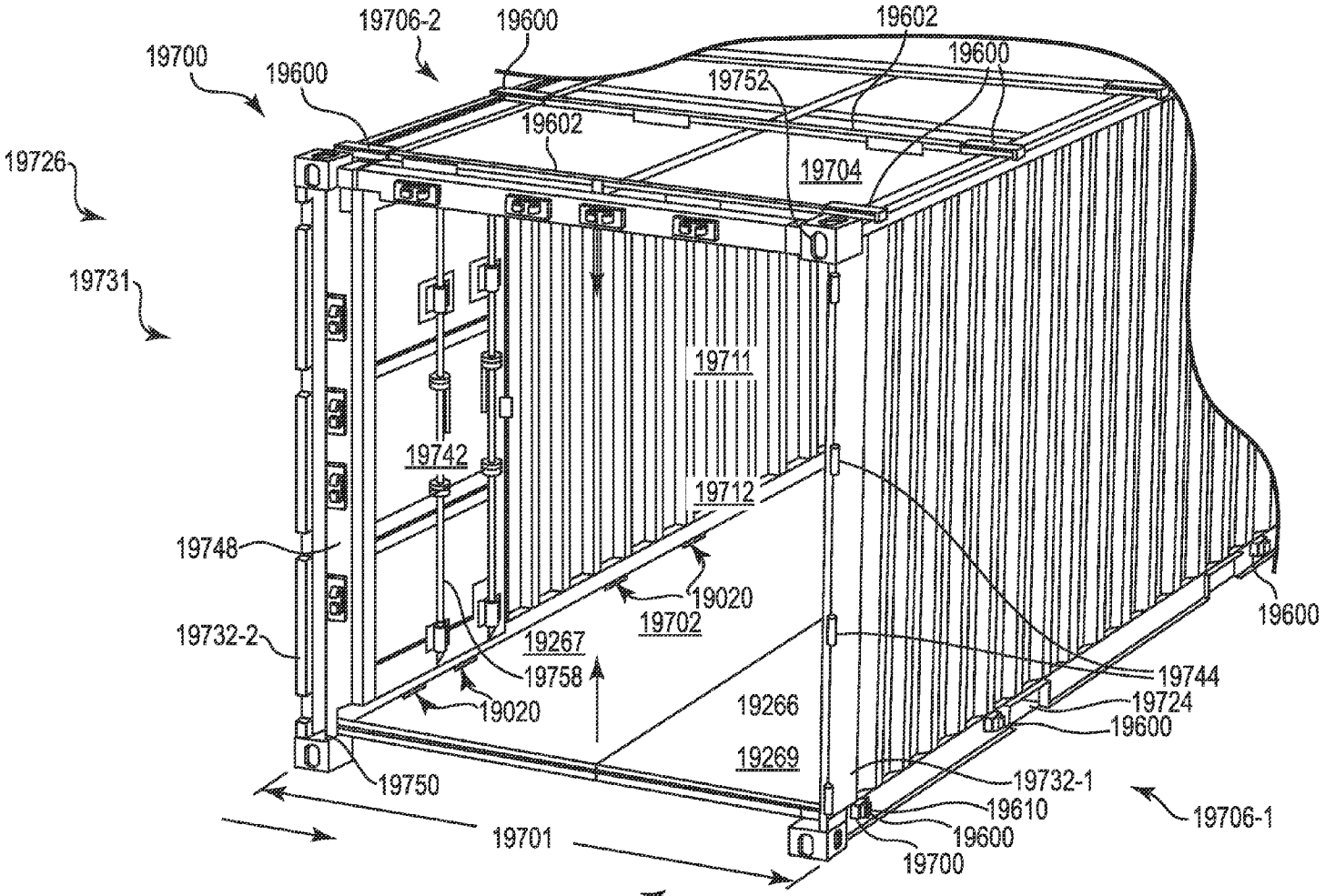

This ability of both the rear wall header member 19546 and the rear wall sill member 19548 to fold is illustrated in FIGS. 19A and 19B. A pivot pin 19756 is used in the header hinge 19752 and the sill hinge 19750 to connect and allow for the rotation of the rear wall sill member 19548 relative the first of the rear wall corner post 19502-2, and the rear wall header member 19546 relative the second of the rear wall corner post 19536-2.

A first of a latch 19760-1 is used to relesably hold the rear wall sill member 19548 to the first of the front wall corner post 19532-1. Similarly, a second of the latch 19760-2 is used to relesably hold the rear wall header member 19546 to the second of the rear wall corner post 19532-2. When in a locked position, the latch 19760-1 and 19760-2 helps to prevent the rear wall sill member 19548 and the rear wall header member 19546 from moving relative their respective rear wall corner posts 19532-1 and 19532-2. When in an unlocked position, the rear wall header member 19546 and the rear wall sill member 19548 can be folded towards their respective rear wall corner post 19532-1 and 19532-2 (illustrated in FIGS. 19A and 19B).

FIGS. 19A-19D show positioning the rear doors 19542 of the rear wall 19526 of a reversibly foldable freight container 19500 so that it can be inside the volume 195A12 defined by the reversibly foldable freight container 19500. As discussed herein, positioning the rear doors 19542 of the front wall 19526 of the reversibly foldable freight container 19500 inside the volume 19512 defined by the reversibly foldable freight container 19500 includes moving the locking rod 19558 into its second predetermined position where the cam 19560 is disengaged from the cam keeper 19566 and has a position relative the rear wall end frame 19531 that allows the cam 19560 and the door 19542 to travel through the area 19554, past the rear wall end frame 19531 and the cam keeper 19566, and into the volume 19512 of the reversibly foldable freight container 19500. FIGS. 19A and 19B show that once the rear doors 19542 have swung clear of the rear wall header member 19546 and the rear wall sill member 19548, these members 19546 and 19548 can be folded towards their respective rear wall corner posts 19532-1 and 19532-2. FIG. 19B illustrates the rear wall header member 19546 and the rear wall sill member 19548 folded relative their respective front wall corner posts 19532-1 and 19532-2.

FIG. 19A also illustrates that the floor structure 19502 includes the bottom side rails 19518-1 and 19518-2, where the plurality of jointed members in the floor structure 19502 are joined to the bottom side rails 19518-1 and 19518-2 with a hinge 19020. This structure will be more fully discussed with respect to FIG. 20. The reversibly foldable freight container 19500 also includes a beam box 19600. As illustrated, the beam box 19600 can be located in the bottom side rails 19518-1 and 19588-2, where the beam box includes surfaces defining an opening through which a lateral lock member 19602 can pass. For the present embodiment, the lateral lock member 19602 and the roof structure 19504 provide examples of structures, as discussed herein, that have a fixed length and/or width that cannot, or should not, be extended beyond the predefined width 19501 of the freight container 19500 due to the jointed member 1950 extending beyond its defined maximum length as defined in an unfolded state.

Figure 19C:
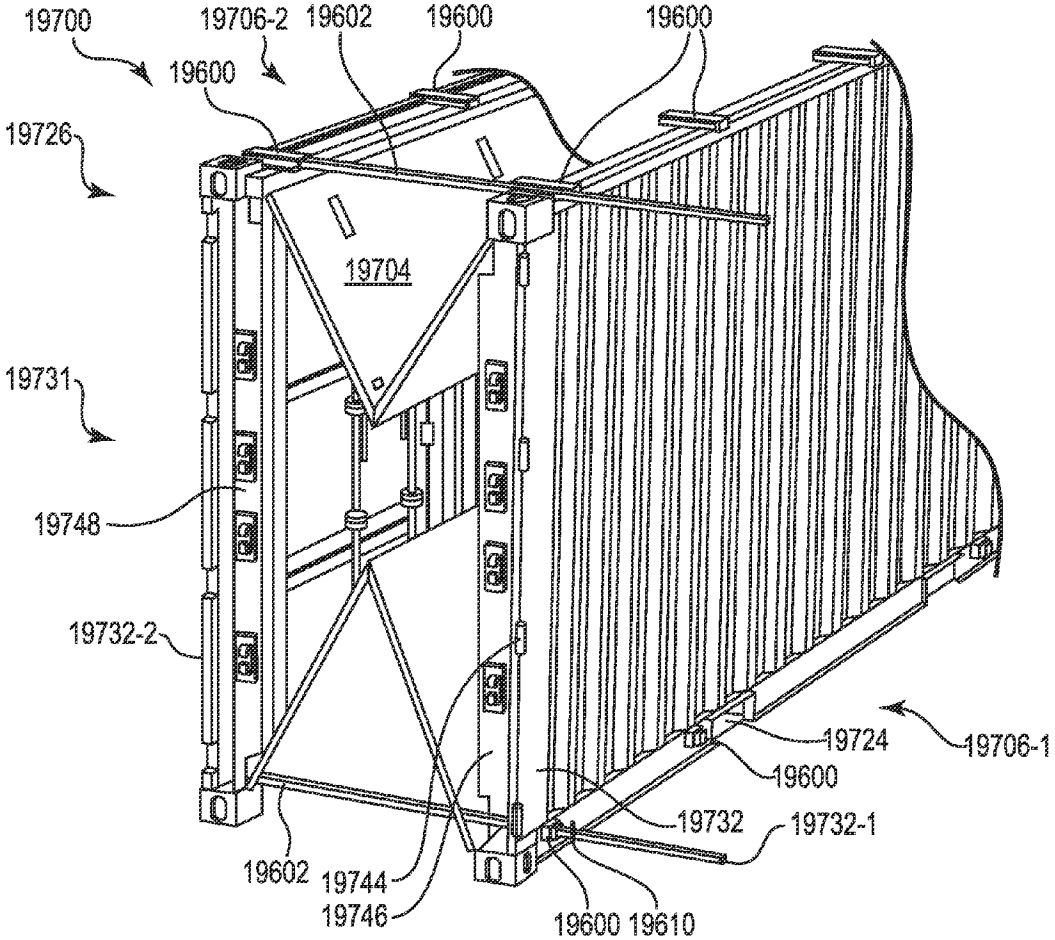
Figure 19D:
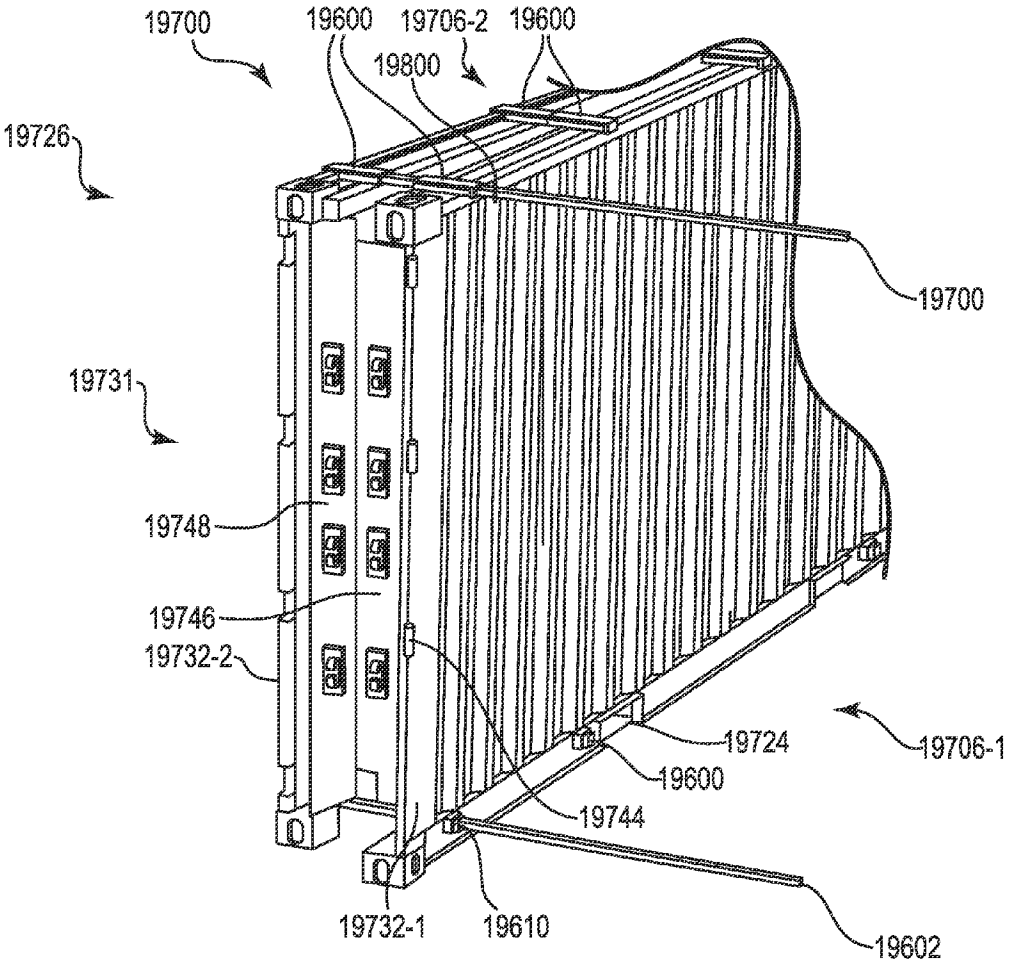

The lateral lock member 19602 can pass through the beam box 19600 in the bottom side rails 19518-1 and 19518-2 when the reversibly foldable freight container 19500 is in a folded state (e.g., the second predetermined state). An example of this is illustrated in FIGS. 19C and 19D. The lateral lock member 19602 can have surfaces defining openings at predetermined locations along the lateral lock member 19602 through which a pin 19610 can be relesably seated. In one embodiment, the surfaces defining the openings through the lateral lock member 19602 allow for the lateral lock member 19602 to help maintain the reversibly foldable freight container 19500 in an unfolded state with the predefined width 19501 of eight (8) feet as provided in ISO 668 Fifth Edition 1995 Dec. 15.

The roof structure 19504 of the reversibly foldable freight container 19500 further includes the beam box 19600 having surfaces defining an opening through which the lateral lock member 19602 can pass. The beam box 19600 of roof structure 19504 and the bottom side rails 19518-1 and 19518-2 help to define a minimum width of the reversibly foldable freight container 19500 when in its second predetermined state. An example of this second predetermined state is illustrated in FIG. 19D.

The roof structure 19504 may include a first roof panel section 19261, a second roof panel section 19263, and a third roof panel section 19265. The roof structure 19504 is reversibly foldable, as discussed herein. For example, as the joined member folds into the reversibly foldable freight container 19500, the roof panel sections 19261, 19263, 19265 may also fold into the reversibly foldable freight container 19500. The roof 19264 may be connected by one or more hinges to the first upper side rail 19516-1 and the second upper side rail 19516-2.

The third roof panel section 19265 can be positioned between the first roof panel section 19261 and the second roof panel section 19263. The third roof panel section 19265 is connected to the first roof panel section 19261 and the second roof panel section 19263 by one or more hinges. For one or more embodiments, the one or more hinges can be a flexure bearing (e.g. a living hinge) that extends along a longitudinal axis of the roof structure.

In the unfolded state, each of the roof panel sections 19261, 19263, 19265 may be substantially parallel to one another (e.g. each roof panel section may be substantially parallel to the jointed members in the first predetermined state). In the unfolded state the roof may be referred to as flat. In the second predetermined state, roof panel sections 19261, 19263 may be substantially parallel to one another, while each of the roof panel sections 19261, 19263 is substantially perpendicular to the roof panel section 19265. In the second predetermined state, the roof may be referred to as a partial rectangle.

For one or more embodiments, the reversibly foldable freight container includes a flooring surface 19266. The flooring surface 19266 may include a first floor section 19267 and a second floor section 19269. The flooring surface 19266 is reversibly foldable, as discussed herein. For example, as the joined member folds into the reversibly foldable freight container 19500, the floor sections 19267, 19269 may also fold into the reversibly foldable freight container 19500. The flooring surface 19266 may be connected to a number the plurality of jointed members (e.g. adjacent the first bottom side rail 19506-1 and/or the second bottom side rail 19506-2). The reversibly foldable freight container 19500 also includes forklift pockets 19524. The forklift pockets 19524 may each be a respective opening in the first and second bottom side rails 19518-1 and 19518-2.

Figure 20:
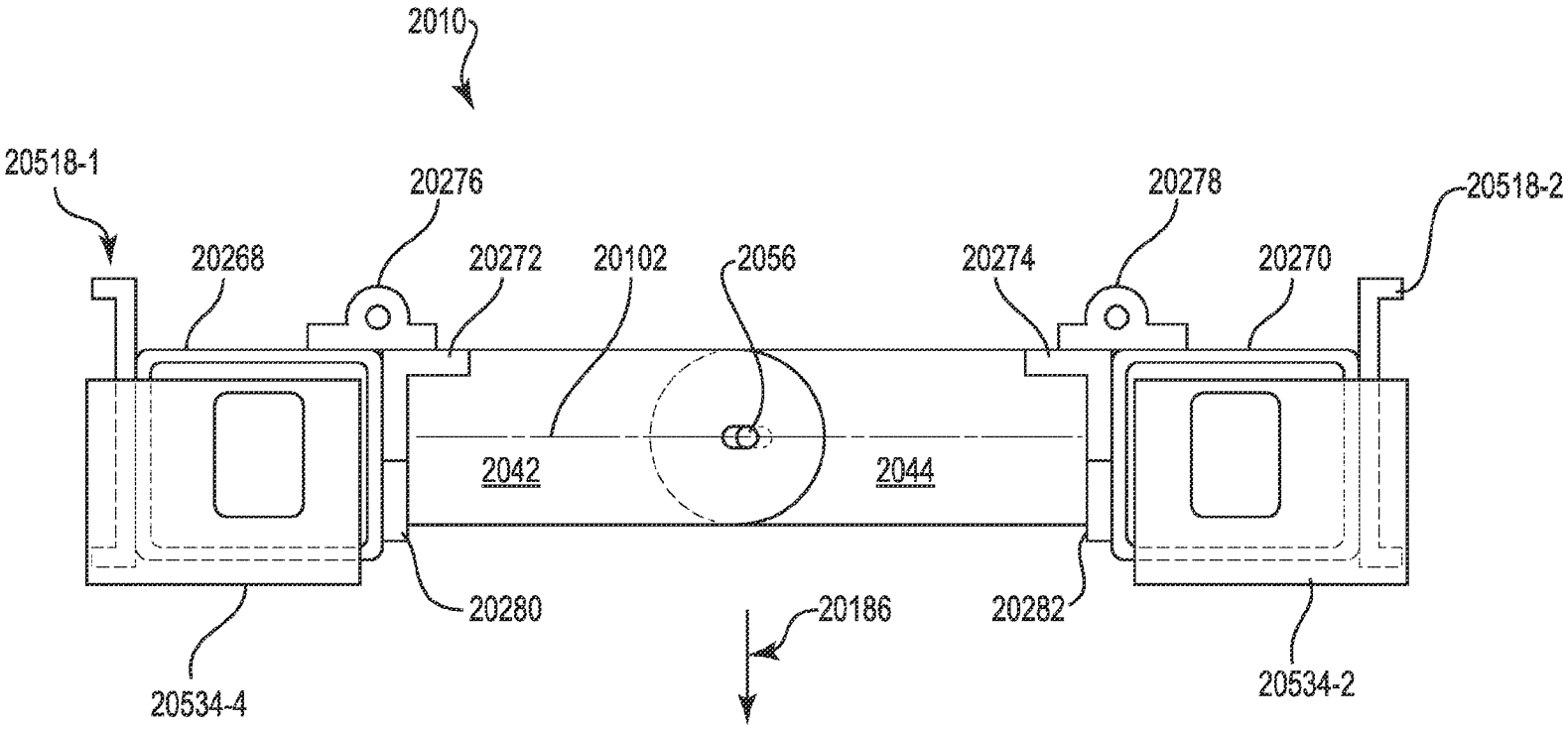
FIG. 20 illustrates a portion of a reversibly foldable freight container according to the present disclosure.

FIG. 20 illustrates a portion of a reversibly foldable freight container according to one or more embodiments of the present disclosure. The reversibly foldable freight container includes jointed member 2010 that may or may not include the abutment members, as discussed herein. The jointed member 2010 shown in FIG. 20 is an example that does not include the abutment members.

For one or more embodiments, the reversibly foldable freight container includes the first bottom side rail 20518-1 and the second bottom side rail 20518-2. In FIG. 20, the first bottom side rail 20518-1 includes a first polygonal tube 20268. Similarly, the reversibly foldable freight container includes the second bottom side rail 20518-2. In FIG. 20, the second bottom side rail 20518-1 includes a second polygonal tube 20270. For one or more embodiments, the first polygonal tube 20268 spans a length of the first bottom side rail 20518-1 and the second polygonal tube 20270 spans a length of the second bottom side rail 20518-2. For example, the first polygonal tube 20268 may contact corner fitting 20104-4 and/or another corner fitting such 20104-8, which is not shown in FIG. 20. Similarly, the second polygonal tube 20270 may contact corner fitting 20104-2 and/or another corner fitting, such 20104-6, which is not shown in FIG. 20.

While the first polygonal tube and the second polygonal tube are discussed herein, there may be a polygonal tube connected to each of the longitudinal members of the reversibly foldable freight container. For example, while the first polygonal tube is connected to the first bottom side rail and the second polygonal tube is connected to the second bottom side rail, there may be a third polygonal tube connected to the first upper side rail, and/or a fourth polygonal tube connected to the second upper side rail. Each of the polygonal tubes may be similarly described, while differing in their respective connections and/or contacts.

The first polygonal tube may have a rectangular cross section, when taken from a plane that is parallel to and includes the longitudinal axis 20102 of the first elongate section 2042 when the jointed member is in the first predetermined state. For one or more embodiments, the rectangular cross section is substantially square. The polygonal shape of the polygonal tubes discussed herein may help to nullify a rotational force (e.g. upon one or more of the jointed members) that may be present due to contents within the reversibly foldable freight container.

For one or more embodiments, the reversibly foldable freight container may include a first angle member 20272. The first angle member may be connected to a number of the first elongate sections 2042. For one or more embodiments, the reversibly foldable freight container may include a second angle member 20274. The second angle member may be connected to a number of the second elongate sections 2044.

For one or more embodiments, the angle members do not prevent forklift forks from engaging the reversibly foldable freight container. For embodiments including one or more of the forklift pockets, as discussed herein, the reversibly foldable freight container may include a plurality of angle members running along a longitudinal member of the reversibly foldable freight container. For example, embodiments may include one, two, three, or more angle members running along a longitudinal member (e.g. the first lower longitudinal member and/or the second lower longitudinal member).

For one or more embodiments, the reversibly foldable freight container may include a first hinge 20276 that contacts the first polygonal tube 20268 and the first angle member 20272. For one or more embodiments, the reversibly foldable freight container may include a second hinge 20278 that contacts the second polygonal tube 20270 and the second angle member 20274. While the first hinge and the second hinge are discussed herein, embodiments are not intended to be limited to these two hinges.

For one or more embodiments, the reversibly foldable freight container may include a first stop member 20280 attached to the first polygonal tube 20268 and a second stop member 20282 attached to the second polygonal tube 20270. The first stop member and second stop member may span the length of the first polygonal tube and the second polygonal tube, respectively.

As illustrated in FIG. 20, in the first predetermined state the first elongate section 2042 abuts the first stop member 20280 and the second elongate section 2044 abuts the second stop member 20282. Additionally, in the first predetermined state, the first angle member 20272 abuts the first polygonal tube 20268 and the first stop member 20280. Similarly, in the first predetermined state, the second angle member 20274 abuts the second polygonal tube 20270 and the second stop member 20282. The stop members may further help provide that the jointed member 2010 is non-moveable in the non-moveable direction 20186. Additionally, the stop members may help reduce a force applied to the hinges (e.g. the first hinge, the second hinge, etc.).

As discussed the reversibly foldable freight containers transition from the unfolded state to the second predetermined state without expanding the container beyond the unfolded state. In the unfolded state the reversibly foldable freight containers may be considered to be in its predefined width (e.g. an unfolded width) as seen in FIG. 1. In the second predetermined state the reversibly foldable freight containers may have a width that is less than 60 percent of the predefined width. For example, in the second predetermined state the reversibly foldable freight containers may have a width that is 50 percent of the predefined width, 40 percent of the predefined width, 30 percent of the predefined width, 25 percent of the predefined width, or 20 percent of the predefined width. In the example where the reversibly foldable freight container has a width, in the second predetermined state, which is 25 percent of the predefined width, four folded reversibly foldable freight containers may be stored in the space of one unfolded container.

Figure 21A:
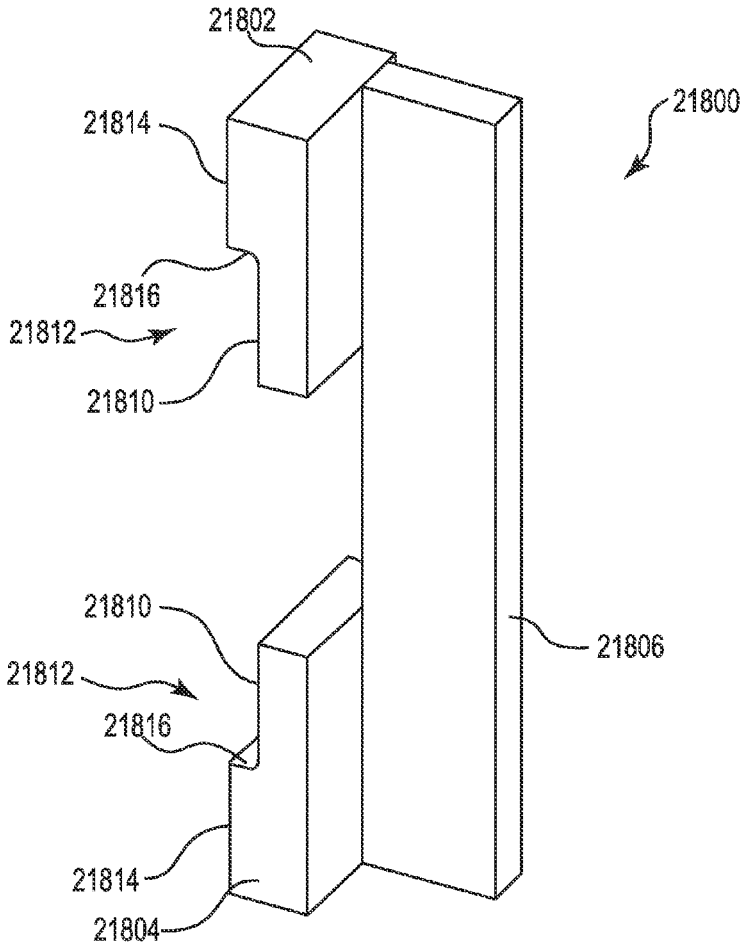
FIGS. 21A-21B provide a perspective view of an anti-racking support according to the present disclosure.
Figure 21B:
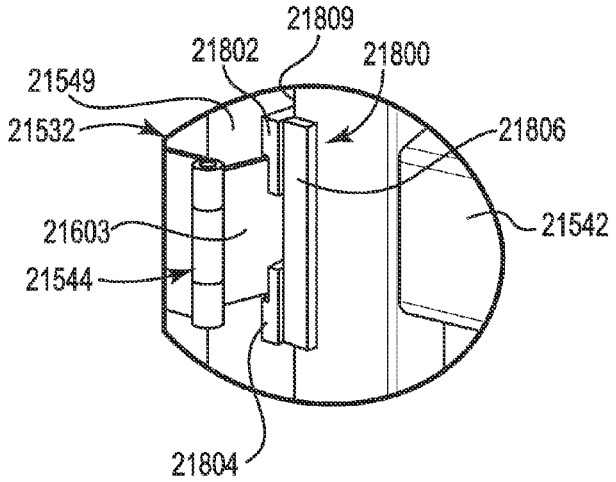
Figure 22A:
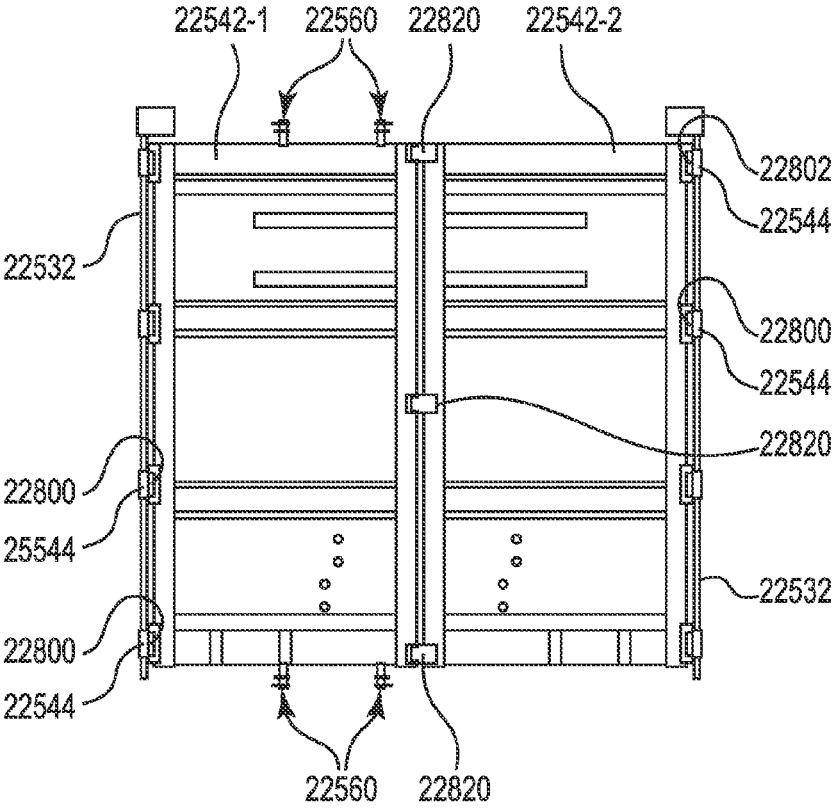
FIGS. 22A-22B provide a perspective view of an anti-racking block for the doors of a freight container according to the present disclosure.

Freight containers can be exposed to a variety of forces when on a ship and/or vehicle. For example, on a ship they can be exposed to movement in six degrees of freedom: rolling, pitching, heaving, swaying, surging and yawing. These motions can impart transverse racking forces on the freight container, especially when they are in a stacked configuration (e.g., fully loaded freight containers stacked ten high). These transverse racking forces can act to distort the walls and the end frames of the container. Referring now to FIGS. 21A and 21B, there is shown an anti-racking support 21800 that can be used with the doors 21542 of the freight container (to be illustrated more fully herein). The anti-racking support 21800 includes a first lug 21802 and a second lug 21804, both of which extend from a mounting support 21806 in a common direction. The mounting support 21806 can have an elongate configuration with a square or rectangular cross-sectional shape (as seen). The mounting support 21806 can be welded and/or fastened (e.g., bolted or screwed) to the door 21542 (e.g., an inside surface as illustrated in FIG. 22A) of the freight container to mount the anti-racking support 21800 in such a way that the first lug 21802 and the second lug 21804 of the anti-racking support 21800 extend from a peripheral edge 21809 of the door 21542 of the freight container.

The first lug 21802 and the second lug 21804 each have a first surface 21810 that defines a recess 21812 relative a second surface 21814. The first surfaces 21810 and the second surfaces 21814 of each of the first lug 21802 and the second lug 21804 can be parallel to each other. When mounted to the door 21542 of the freight container, the recess 21812 of the first lug 21802 and the second lug 21804 can receive and straddle at least a portion of the second wing 21603 of the hinge 21544, as provided herein, when the door is in a closed and/or locked (cams of door engaged with the cam keepers) position. The first surface 21810 of the first lug 21802 and the second lug 21804 can also be directly adjacent to (e.g., no intervening structures) and/or make physical contact with the at least a portion of the second wing 21603 of the hinge when the door is in a closed and/or locked (cams of door engaged with the cam keepers) position. Similarly, the second surface 21814 of the first lug 21802 and the second lug 21804 can also be directly adjacent to and/or make physical contact with the "U"-channel 21549 of the corner post 21532 of the freight container when the door is in a closed and/or locked (cams of door engaged with the cam keepers). As a result, the anti-racking support 21800 can be directly adjacent to and/or in contact with both the hinge 21544 and the corner post 21532 when the cam is engaged with the cam keeper.

Each of the first lug 21802 and the second lug 21804 also include a third surface 21816 that extends between the first surface 21814 and the second surface 21810. The third surface 21816 helps to define the recess 21812. The third surface 21816 also can be directly adjacent to and/or make physical contact with at least a portion of the second wing 21603 of the hinge 21544 when the door 21542 is in a closed and/or locked (cams of door engaged with the cam keepers) position.

One of the anti-racking support 21800 can be mounted to the door 21542 of the freight container relative to each hinge 21544 (e.g., one anti-racking support 21800 for each hinge 21544). When the door 21542 of the freight container is closed and locked (cams of door engaged with the cam keepers) the anti-racking support 21800 can help to impede transverse racking of the freight container. For example, the anti-racking support 21800 can make contact with the U-channel 21549 during racking so as to help the doors 21542 keep parallel to the plane of the corner posts. The anti-racking support 21800 can also help to minimize mechanical stresses on the hinge 21544 of the door 21542 of the freight container when it is closed and locked (cams of door engaged with the cam keepers). One way this is accomplished is by the anti-racking support 21800 making contact with the hinge 21544 (e.g., the second wing 21603) and pressing the hinge 21544 against the U-channel 21549 so as to keep the hinge 21544 in its same relative position under non-racking conditions.

The use of the anti-racking support 21800 on the door 21542, as discussed herein, helps to limit the impact of racking forces the freight container. When in their closed and locked configuration, the anti-racking support 21800 and the locking rods help to maintain the relative perpendicular position of the doors 21542 under racking conditions (e.g., maintain their rectangular shape against the external racking forces). When racking is occurring the anti-racking support 21800 can provide a "node" through which racking forces (e.g., lateral forces) can be transferred through the doors 21542. These racking forces can be absorbed through either the anti-racking supports 21800 on the adjacent door and/or locking rods via the cam, cam keepers and end frame of the freight container. The use of the anti-racking support 21800 in conjunction with the hinge and freight container of the present discloser can allow a freight container, as provided herein, to meet the requirements of ISO 1496 (fifth edition 1990 Aug. 15) and its amendments.

Figure 22B:
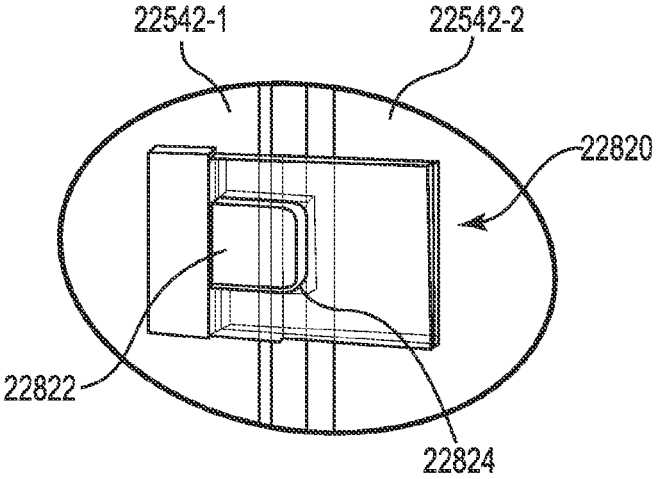

Referring now to FIGS. 22A and 22B there is shown an embodiment of a door 22542 (as viewed from the "inside" of the freight container) with the anti-racking support 22800 positioned adjacent the hinge 22544 mounted to the corner post 22532. FIGS. 22A and 22B also provide an illustration of an anti-racking block 22820 mounted to the doors 22542-1 and 22542-2. The anti-racking block 22820 includes a tab 22822 and a slot 22824 to releasably receive the tab 22822. As illustrated, the tab 22822 extends from the first of the door 22542-1 and the slot 22824 extends from the second of the door 22542-2 such that the tab 22822 can seat within the slot 22824 (e.g., completely within the slot 22824) when the cam 22560 of each of the first of the door 22542-1 and the second of the door 22542-2 are engaged with their respective cam keeper.

The anti-racking block 22820 helps to limit the impact of racking forces the freight container. The anti-racking block 22820 also helps to maintain the perpendicular symmetry of the end frame and the doors 22542 of the freight container during transverse racking. As illustrated, the anti-racking block 22820 can transfer forces in both the horizontal and vertical planes (e.g., via all three sides of the slot 22824). This helps to keep the doors 22542-1 and 22542-2 in a common plane and helps to maintain the perpendicular symmetry of the end frame and the doors 22542 of the freight container during transverse racking. This also helps to make the two doors (22542-1 and 22542-2) act as one large structure instead of two independent structures.

So, the anti-racking block 22820 used in conjunction with the anti-racking support 22800 and the locking rods helps to maintain the relative symmetrical position of the doors 22542 under racking conditions (e.g., maintain their rectangular shape against the external racking forces). For example, when racking is occurring the anti-racking support 22800 and the anti-racking block 22820 can provide the "nodes" through which racking forces (e.g., lateral forces) can be transferred through the doors 22542. These racking forces can be absorbed through either the anti-racking supports 22800 on the adjacent door and/or locking rods via the cam, cam keepers and end frame of the freight container.

Figure 23A:
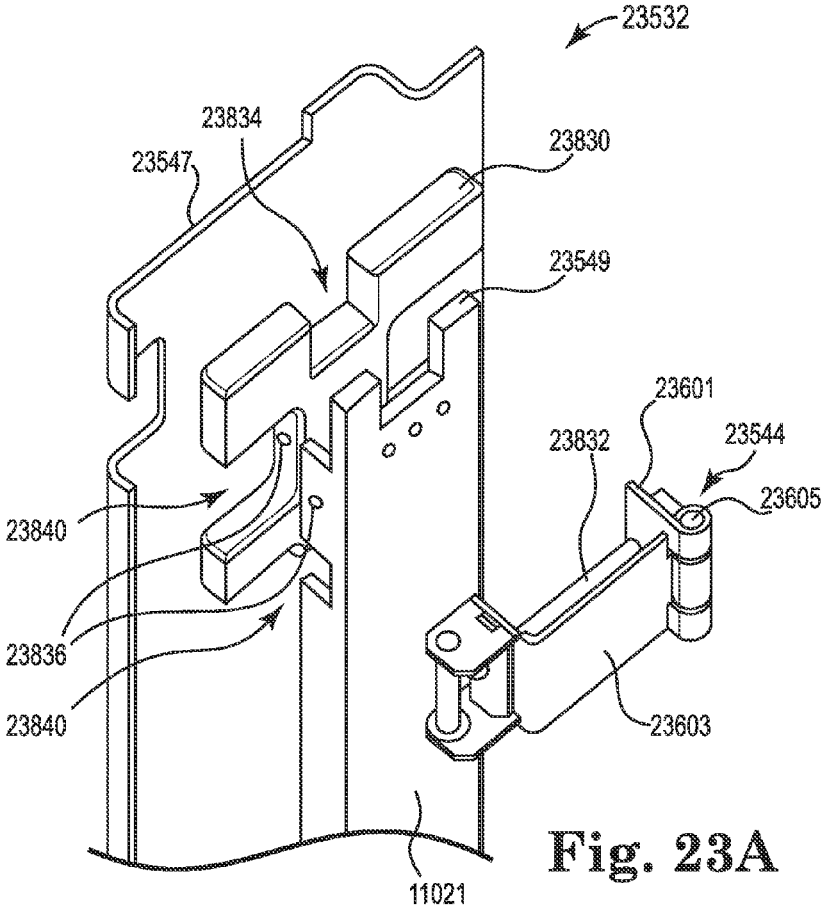
FIGS. 23A-23B provide a perspective view of a hinge for the doors of a freight container according to the present disclosure.
Figure 23B:
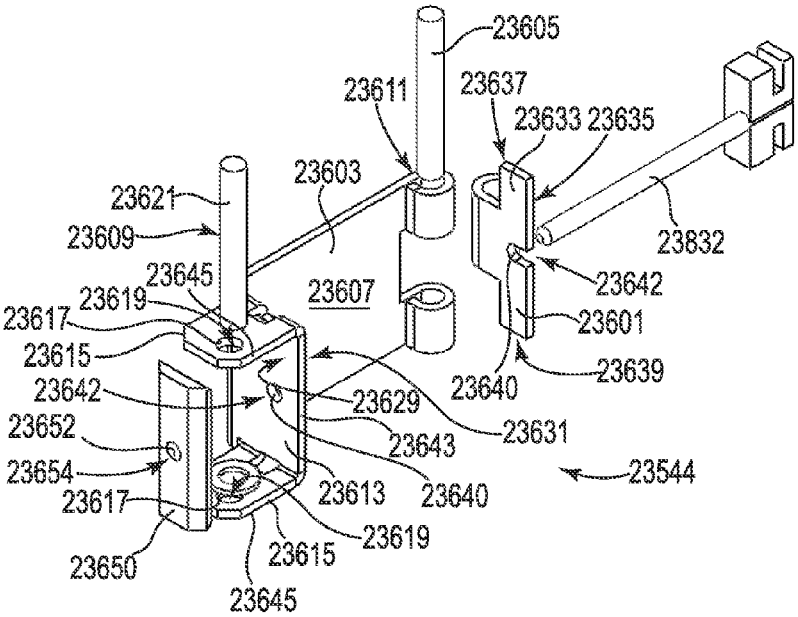

Referring now to FIGS. 23A-23B, there is shown an additional embodiment of the hinge 23544 and corner post 23532 of the present disclosure. FIG. 23A shows an exploded partial view of the corner post 23532, an "H"-Block 23830 and the hinge 23544 of the present disclosure. As illustrated, the H-Block 23830 can be positioned between J-Bar 23547 and the U-Channel 23549 of the corner post 23532. The H-Block 23830 can be fastened (e.g., welded) to the corner post 23532. Specifically, the H-Block 23830 can be welded to the J-Bar 23547 of the corner post 23532. To accommodate the H-Block 23830 portions of the U-Channel 23549 are removed, where the edges of the U-channel 23549 can abut and, if desired, be welded to the H-Block 23830. H-Blocks 23830 located at the top and bottom of the corner post 23532 can also be welded directly to the top and bottom corner fittings.

When the hinge 23544 is secured to the U-channel 23549, as discussed herein, the H-Block 23830 can help to protect the hinge 23544 from forces (e.g., stacking forces) that are transmitted through the corner post 23532. Specifically, the H-Block 23830 can help to transmit the forces around the hinge 23544. The H-Block 23830 also serves as a seating block for the hinge 23544 (e.g., the hinge 23544 can rest in the opening of the H-Block 23830 on one end and the other end of the H-Block 23830 provides an open space for a locking pin 23832, as discussed herein. As such, the H-Block 23830 can help to protect both the locking pin 23832 and the hinge 23544. The H-Block 23830 also includes notches 23834 that extend in from the legs of the "H," where these notches 23834 help to relieve stresses formed when the freight container is stacked (confirmed by Finite Element Analysis modeling).

Both the U-Channel 23549 and the H-Block 23830 also include a surface 23836 that defines a hole 23840 through the U-Channel 23549 and the H-Block 23830. The hole 23840 is sized to receive and reversibly pass at least a portion of a locking pin 23832. The locking pin 23832 is used to releasably lock the second wing 23603 of the hinge 23544 to both the corner post 23532 and the H-Block 23830. The locking pin 23832 is manipulated from the inside of the freight container.

For the various embodiments, the locking pin 23832 can be positioned through the hole 23840 so as to releasably lock the second wing 23603 of the hinge 23544 to both the corner post 23532 and the H-Block 23830, and removed from the hole 23840 so as to unlock the second wing 23603 of the hinge 23544 from both the corner post 23532 and the H-Block 23830. Specifically, the locking pin 23832 can be retracted from the hole 23840 so as to release the second wing 23603 of the hinge 23544 from the corner post 23532 and the H-Block 23830. Once released, the second wing 23603 can rotate around first hinge pin 23605. To lock the second wing 23603 to the corner post 23532 and the H-Block 23830, the locking pin 23832 is aligned and reinserted though the hole 23840 of the corner post 23532 and the H-Block 23830. As discussed herein, the first wing 23601 can be fastened to the portion of the U channel 23549 and the H-Block 23830 by a welding (e.g., arc-welding) process.

FIG. 23B provides an exploded view of the hinge 23544. As illustrated, the hinge 23544 includes the first wing 23601 and the second wing 23603, where the first wing 23601 and the second wing 23603 are pivotally connected by the first hinge pin 23605. For the various embodiments, the second wing 23603 includes the first planar portion 23607 with the first end 23609 and the second end 23611 and the second planar portion 23613 that extends perpendicular from the first end 23609 of the first planar portion 23607. The first hinge pin 23605 pivotally connects the first wing 23601 to the second end 23611 of the first planar portion 23607. As illustrated, a portion of the first planar portion 23607 of the second wing 23603 passes through an opening defined in the first wing 23601 so as to allow the second end 23611 of the first planar portion 23607 of the second wing 23603 to pivotally connect to the first hinge pin 23605 and the first wing 23601.

The hinge 23544 also includes a pair of hinge lugs 23615 that extend from the second planar portion 23613 of the second wing 23603. Each of the hinge lugs 23615 has a first set of surfaces 23617 defining openings 23619 through which the second hinge pin 23621 passes. For the various embodiments, the first wing 23601 and the second planar portion 23613 of the second wing 23603 include a surface 23640 that defines an opening 23642 through which the locking pin 23832 reversibly travels.

The second planar portion 23613 of the second wing 23603 includes the first major surface 23629 and the second major surface 23631 opposite the first major surface 23629. The pair of hinge lugs 23615 extends from the first major surface 23629 of the second planar portion 23613. The first wing 23601 has the first major surface 23633 and the second major surface 23635 opposite the first major surface 23633. In a first predetermined position the first wing 23601 is perpendicular to the first planar portion 23607 of the second wing 23603 and the first major surface 23633 of the first wing 23601 is directly opposite and parallel with the second major surface 23631 of the second planar portion 23613. As discussed herein, the first predetermined position can occur with the first wing 23601 attached to the corner post 23532 of the freight container and the second wing 23603 of the hinge 23544 positioned against (e.g., adjacent to and in at least partial contact with) the corner post.

The first wing 23601 has a first end 23637 and a second end 23639. The first hinge pin 23605 pivotally connects the first end 23637 of the first wing 23601 to the second end 23611 of the first planar portion 23607 of the second wing 23603. The second planar portion 23613 has an end 23643 that is distal to the first end 23609 of the first planar portion 23607 and the pair of hinge lugs 23615 extending from the second planar portion 23613 have a first peripheral edge 23645, where the end 23643 of the second planar portion 23613 and the first peripheral edge 23645 of the hinge lugs 23615 lay in a common plane.

The hinge 23544 further includes a support block 23650. Support block includes a surface 23652 that defines an opening 23654. Support block 23650 can be positioned against the second planar portion 23613 of the second wing 23603, where the opening 23654 concentrically aligns with the opening 23642 through which the locking pin 23832 travels. Support block 23650 can be welded to the second planar portion 23613 of the second wing 23603. Support block 23650 can also be chamfered so as to allow the door of the freight container to swing unencumbered.

For the various embodiments, the components of the reversibly foldable freight container provided herein can be formed of materials suitable for and built so as to comply with ISO standard 1496-1 (fifth edition 1990 Aug. 15) and its amendments, which are all incorporated herein by reference in its entirety. For the various embodiments, the components of the reversibly foldable freight container discussed herein can be formed of steel. Examples of such steel include, but are not limited to, 'weathering steel' as specified within standard BS EN 10025-5:2004, which is also known as CORTEN steel. For the various embodiments, the floor of the reversibly foldable freight container can be made of planking wood or plywood. In addition, gaskets as are known to be used with freight containers can be used with the reversibly foldable freight container of the present disclosure as needed.

What is claimed:

1. A reversibly foldable freight container, comprising:

a roof structure;

a floor structure opposite the roof structure;

sidewall structures between the floor structure and the roof structure, each of the sidewall structures having an exterior surface and an interior surface opposite the exterior surface;

a front wall joined with the roof structure, the floor structure and the sidewall structures, the front wall including front wall corner posts, a front door hinge on at least one of the front wall corner posts and a front door joined to the front door hinge;

a rear wall joined with the roof structure, the floor structure and the sidewall structures, where the roof structure, the floor structure, the interior surface of the sidewall structures and the rear wall define a volume of the reversibly foldable freight container, the rear wall including rear wall corner posts, a hinge on the rear wall corner posts and a rear wall door joined to the hinge, where the hinge can be locked to the rear wall corner posts in a first predetermined position so that the rear wall door can pivot on the hinge to extend adjacent the exterior surface of the sidewall structure or can be un-locked to the rear wall corner posts in a second predetermined position so that the rear wall door can pivot into the volume of the reversibly foldable freight container and extend adjacent the interior surface of the sidewall structure, and where in an unfolded state the reversibly foldable freight container has a predefined width measured at a predetermined point on each of two of the rear wall corner posts and a plurality of jointed members in the floor structure, where each of the jointed members includes:

a first elongate section having a first surface defining a first oblong opening;

a second elongate section having a second surface defining a second oblong opening; and a fastener passing through the first oblong opening and the second opening to connect the first elongate section and the second elongate section, where the first oblong opening and the second oblong opening move relative each other and the fastener as the jointed member transitions from a first predetermined state having a minimum overlap of the first oblong opening and the second oblong opening towards a second predetermined state having a maximum overlap of the first oblong opening and the second oblong opening relative the minimum overlap, where as the reversibly foldable freight container in an unfolded state moves toward a folded state the first oblong opening and the second oblong opening move relative each other and the fastener so that the predetermined points on the rear wall corner posts do not extend beyond the predefined width of the reversibly foldable freight container in the unfolded state.

2. The reversibly foldable freight container of claim 1, including a latch on the sidewall structures, where the latch engages and releasably holds the rear wall door adjacent the interior surface of the sidewall structure.

3. The reversibly foldable freight container of claim 1, including a locking rod mounted to the rear wall door, the locking rod having a first portion and a second portion joined to the first portion with a connection shaft, where the first portion and the second portion telescope relative the connection shaft to change a length of the locking rod.

4. The reversibly foldable freight container of claim 3, where the locking rod has a handle and each of the first portion and the second portion of the locking rod has a cam, where the cam engages and disengages a cam keeper mounted to the rear wall end frame of the reversibly foldable freight container as the handle turns the locking rod.

5. The reversibly foldable freight container of claim 4, where the locking rod travels past the rear wall end frame and the cam keeper as the rear door travels into the volume of the reversibly foldable freight container.

6. The reversibly foldable freight container of claim 1, where a hinge joins a first member end of each of the plurality of jointed members to a first bottom side rail and a second member end of each of the plurality of jointed members to a second bottom side rail.

7. The reversibly foldable freight container of claim 6, where the bottom side rail includes a beam box having surfaces defining an opening through which a lateral lock member can pass.

8. The reversibly foldable freight container of claim 7, where the lateral lock member passes through the beam box in the bottom side rail when the reversibly foldable freight container is in the folded state.

9. The reversibly foldable freight container of claim 1, where the roof structure includes a beam box having surfaces defining an opening through which a lateral lock member can pass.

10. The reversibly foldable freight container of claim 1, where the first elongate section includes a first abutment member and the second elongate section includes a second abutment member, where in the first predetermined state the first abutment member and the second abutment member are under a compressive force while the first surface defining the first oblong opening and the second surface defining the second oblong opening apply a shearing stress to the fastener.

11. The reversibly foldable freight container of claim 10, where each of the first surface and the second surface includes a first end and a second end opposite the first end, where the shearing stress in the first predetermined state is applied by the first end of both the first surface and the second surface.

12. The reversibly foldable freight container of claim 11, where each of the first end and the second end are in the shape of an arc, and where the first end of the first oblong opening and the second oblong opening form a circular shape when in the first predetermined state.

13. The reversibly foldable freight container of claim 10, where the first abutment member and the second abutment member define a first point of rotation for the first elongate section and the second elongate section; and the second end of both the first surface and the second surface, when positioned against the fastener, define a second point of rotation for the first abutment member and the second abutment member that is different than the first point of rotation.

14. The reversibly foldable freight container of claim 13, where the first elongate section and the second elongate section turn on the first point of rotation prior to turning on the second point of rotation as the jointed member transitions from the first predetermined state towards the second predetermined state.

15. The reversibly foldable freight container of claim 13, where the first end of each of the first surface and the second surface does not contact the fastener when the second end of both the first surface and the second surface are seated against the fastener.

16. The reversibly foldable freight container of claim 13, where the first elongate section includes a first member end opposite the first abutment member and the second elongate section includes a second member end opposite the second abutment member, where in the first predetermined state a distance between the first member end of the first elongate section and the second member end of the second elongate section provides a defined maximum length of the jointed member.

17. The reversibly foldable freight container of claim 16, where the distance between the first member end of the first elongate section and the second member end of the second elongate section does not exceed the defined maximum length as the jointed member transitions from the first predetermined state towards the second predetermined state.

18. The reversibly foldable freight container of claim 16, where in the first predetermined state the fastener, the first abutment member and the first member end, all in a common plane, define a right triangle of the first elongate section, where a hypotenuse of the right triangle is between the fastener and the first member end, and a first leg of the right triangle is defined by the first member end and a perpendicular intersection of a first line extending from the first member end and a second line extending from a geometric center of the fastener, where the first and second lines are in the common plane.

19. The reversibly foldable freight container of claim 18, where in the first predetermined state the fastener, the second abutment member and the second member end, all in a common plane, define a right triangle of the second elongate section, where a hypotenuse of the right triangle is between the fastener and the second member end, and a first leg of the right triangle is defined by the second member end and a perpendicular intersection of a first line extending from the second member end and a second line extending from a geometric center of the fastener, where the first and second lines are in the common plane.

20. The reversibly foldable freight container of claim 1, where the first oblong opening and the second oblong opening have an obround shape.

* * * * *